US009867483B2

(12) United States Patent
Shea

(10) Patent No.: US 9,867,483 B2
(45) Date of Patent: Jan. 16, 2018

(54) SIGNAGE SYSTEMS AND MERCHANDISING DISPLAY ASSEMBLIES

(71) Applicant: T.M. SHEA PRODUCTS, INC., Troy, MI (US)

(72) Inventor: Thomas M. Shea, Troy, MI (US)

(73) Assignee: T.M. SHEA PRODUCTS, INC., Troy, MI (US)

( * ) Notice: Subject to any disclaimer, the term of this patent is extended or adjusted under 35 U.S.C. 154(b) by 0 days.

(21) Appl. No.: 15/044,336

(22) Filed: Feb. 16, 2016

(65) Prior Publication Data

US 2016/0157636 A1 Jun. 9, 2016

Related U.S. Application Data

(63) Continuation of application No. 14/019,658, filed on Sep. 6, 2013, now abandoned.

(51) Int. Cl.

| | |
|---|---|
| ***A47F 5/08*** | (2006.01) |
| ***G09F 23/06*** | (2006.01) |
| *A47F 5/00* | (2006.01) |

(52) U.S. Cl.

CPC ..... *A47F 5/0815* (2013.01); *G09F 23/06* (2013.01); *A47F 5/0823* (2013.01); *A47F 2005/0012* (2013.01)

(58) Field of Classification Search

CPC .... A47F 5/0815; A47F 5/0807; A47F 5/0823; A47F 2005/0012; G09F 23/06

USPC ..... 211/57.1, 59.1, 113, 106.01, 117, 118, 211/119.003, 13.1, 54.1; 248/220.21, 248/220.22, 220.31, 220.41, 220.42, 248/220.43, 222.41, 225.11, 225.21

See application file for complete search history.

(56) References Cited

U.S. PATENT DOCUMENTS

| | | | | |
|---|---|---|---|---|
| 1,039,359 A * | 9/1912 | Brown | 211/118 | |
| 1,093,856 A * | 4/1914 | Hurff | A01F 25/12 211/113 | |
| 2,606,734 A * | 8/1952 | Magnuson | A47G 25/0678 248/215 | |
| 2,793,762 A * | 5/1957 | Broussard | D06F 57/00 211/113 | |
| 2,905,328 A * | 9/1959 | Munao | A47F 7/02 211/59.1 | |
| 2,937,758 A * | 5/1960 | Tabb | A47F 5/04 211/1 | |

(Continued)

FOREIGN PATENT DOCUMENTS

EP EP 2732731 A1 * 5/2014 ..... A47F 5/0823

*Primary Examiner* — Joshua J Michener
*Assistant Examiner* — Devin Barnett
(74) *Attorney, Agent, or Firm* — Stephen T. Olson; Harness, Dickey & Pierce, P.L.C.

(57) ABSTRACT

A merchandising display assembly includes an ornamental panel and at least one frame. The at least one frame includes a plurality of upright members. First and second upright members of the plurality of upright members cooperate to slidably receive the ornamental panel in an opening defined therebetween. Each upright member defines a plurality of openings along a length thereof. The assembly further includes a plurality of merchandising support members. A plurality of adjustable members carry the plurality of merchandising support members. Each adjustable member includes first and second ends for selectively engaging apertures of the plurality of upright members.

5 Claims, 68 Drawing Sheets

(56) References Cited

U.S. PATENT DOCUMENTS 3,071,400 A * 1/1963 Bellock ..... F16B 7/0446 211/206
3,252,678 A * 5/1966 Lasch ..... A47F 5/06 211/123
3,998,332 A * 12/1976 Lambertson ..... A47F 5/0838 182/92
4,286,764 A * 9/1981 Pfeifer ..... A47F 5/0869 248/220.22
4,367,819 A * 1/1983 Lewis ..... A47F 5/0876 211/106.01
4,434,960 A * 3/1984 Berry ..... A47F 5/0815 248/220.43
4,557,064 A * 12/1985 Thompson ..... G09F 3/20 40/361
4,662,592 A * 5/1987 Garfinkle ..... A47F 5/0823 248/220.42
4,671,417 A * 6/1987 O'Brien ..... A47F 5/11 211/59.1
4,726,554 A * 2/1988 Sorrell ..... A47F 5/0846 211/106.01
4,733,782 A * 3/1988 Spezial ..... A47F 5/0876 211/106.01
4,850,557 A * 7/1989 Valiulis ..... A47F 5/0823 211/57.1
4,869,376 A * 9/1989 Valiulis ..... A47F 5/0869 211/54.1
5,088,606 A * 2/1992 Boas ..... A47F 5/0869 211/57.1
5,413,297 A * 5/1995 Adams ..... A47G 25/0614 248/215
5,415,370 A * 5/1995 Valiulis ..... A47F 5/0006 211/57.1
5,439,120 A * 8/1995 Brozak ..... A47F 5/0838 206/806
5,441,161 A * 8/1995 Merl ..... A47F 5/0869 211/57.1
5,503,277 A * 4/1996 O'Brien ..... A47B 57/20 211/106.01
5,657,884 A * 8/1997 Zilincar, III ..... A47F 5/0043 211/103
D384,534 S * 10/1997 Kiggins ..... D6/567
5,702,008 A * 12/1997 Thalenfeld ..... A47F 5/0869 211/57.1
5,743,403 A * 4/1998 Crysdale ..... A47F 5/0006 206/482
5,887,731 A * 3/1999 Thalenfeld ..... A47F 5/0869 211/103
5,957,422 A * 9/1999 Shea ..... A47F 5/0807 211/87.01
6,006,463 A * 12/1999 Mueller ..... A47F 5/0869 211/57.1
6,029,827 A * 2/2000 Valiulis ..... A47F 5/0823 211/59.1
6,070,747 A * 6/2000 Shea ..... A47F 5/0807 211/103
6,085,916 A * 7/2000 Kovacevic ..... A47F 5/0815 211/86.01
6,131,748 A * 10/2000 Kawasaki ..... A47F 1/128 211/54.1
6,199,706 B1 * 3/2001 Shea ..... A47F 5/08 211/103
6,234,330 B1 * 5/2001 Gray ..... A47F 5/0838 211/103
6,269,571 B1 * 8/2001 Thalenfeld ..... A47F 5/0869 211/57.1
6,354,546 B1 * 3/2002 Mueller ..... A47F 5/0068 248/220.41
6,389,722 B1 * 5/2002 Josefsson ..... A47F 5/0869 211/57.1
D459,132 S * 6/2002 Shea ..... D6/566
D465,372 S * 11/2002 Shea ..... D6/567
D466,352 S * 12/2002 Shea ..... D6/514
6,502,706 B1 * 1/2003 Kent ..... A47F 5/0823 211/57.1
6,581,789 B1 * 6/2003 Spanski ..... A47F 5/101 211/103
6,601,808 B1 * 8/2003 Nagel ..... A47F 5/0823 211/57.1
6,604,637 B2 * 8/2003 Lane ..... A47F 5/0823 211/57.1
6,612,527 B1 * 9/2003 Nagel ..... A47F 5/0823 211/57.1
6,698,124 B2 * 3/2004 Kump ..... A47F 5/0823 248/220.41
6,896,232 B2 * 5/2005 Crowell ..... B25B 5/06 248/229.12
6,951,290 B2 * 10/2005 Speed ..... A47F 5/0068 211/113
6,966,446 B1 * 11/2005 Wise ..... A47F 5/0006 206/806
7,467,719 B2 * 12/2008 Crowell ..... F41A 23/18 211/4
7,467,720 B2 * 12/2008 Williquette ..... A47F 5/0006 211/113
7,584,930 B2 * 9/2009 Zich ..... A47F 5/0861 211/57.1
7,909,183 B2 * 3/2011 Oh ..... A47F 5/0823 211/59.1
8,177,075 B2 * 5/2012 Hathorn ..... A47F 5/0006 211/113
D701,584 S * 3/2014 Kasbohm ..... D22/108
8,794,453 B2 * 8/2014 Kologe ..... A47F 5/0861 211/57.1
8,814,108 B2 * 8/2014 Bernstein ..... 211/107
8,857,087 B1 * 10/2014 Wildrick ..... G09F 3/204 40/661.03
8,869,983 B2 * 10/2014 Bruegmann ..... E05B 73/00 206/1.5
D720,985 S * 1/2015 Veilleux ..... D8/367
D734,134 S * 7/2015 Bauerle ..... D8/372
D744,322 S * 12/2015 Cobianco ..... D8/370
9,211,023 B1 * 12/2015 Weiss ..... A47G 25/0614
9,307,848 B2 * 4/2016 Bernstein ..... A47F 5/04
2001/0047974 A1 * 12/2001 Berlingieri ..... A47F 5/0838 211/106
2002/0029505 A1 * 3/2002 Faneuf ..... G09F 1/10 40/658
2002/0175132 A1 * 11/2002 Shea ..... A47F 5/0807 211/87.01
2003/0111580 A1 * 6/2003 Catteau ..... A47F 5/0869 248/222.51
2003/0163906 A1 * 9/2003 Wildrick ..... G09F 1/103 24/459
2003/0164346 A1 * 9/2003 Shea ..... A47F 5/0823 211/59.1
2003/0196974 A1 * 10/2003 Cuzzocrea ..... A47F 5/0006 211/113
2004/0035809 A1 * 2/2004 Su ..... G09F 23/00 211/86.01
2004/0262250 A1 * 12/2004 Kosir ..... A47F 5/0006 211/113
2005/0029205 A1 * 2/2005 Mansfield ..... A47F 5/0861 211/7
2005/0098518 A1 * 5/2005 Shea ..... A47F 5/0807 211/87.01
2005/0109719 A1 * 5/2005 Shea ..... A47F 5/0838 211/86.01
2005/0258121 A1 * 11/2005 Shea ..... A47F 5/0807 211/195
2006/0091092 A1 * 5/2006 Vosbikian ..... A47F 5/083 211/87.01
2006/0163183 A1 * 7/2006 Iwasaki ..... B65D 73/0028 211/113
2006/0283818 A1 * 12/2006 Shea ..... A47F 5/0838 211/59.1
2007/0102377 A1 * 5/2007 Kikuchi ..... A47F 5/0823 211/57.1

(56) References Cited

U.S. PATENT DOCUMENTS

| | | | | |
|---|---|---|---|---|
| 2007/0102378 | A1* | 5/2007 | Innis | A47F 5/0853 211/59.1 |
| 2007/0278163 | A1* | 12/2007 | Barkdoll | A47F 5/0807 211/59.1 |
| 2008/0054142 | A1* | 3/2008 | Deland | A47F 5/0815 248/223.31 |
| 2008/0142460 | A1* | 6/2008 | Belokin | A47F 5/0892 211/113 |
| 2008/0149576 | A1* | 6/2008 | Onachilla | A47F 5/0807 211/85.5 |
| 2009/0230272 | A1* | 9/2009 | Miyaue | A47F 5/0838 248/304 |
| 2010/0089849 | A1* | 4/2010 | Sheppard | A63B 71/0045 211/85.7 |
| 2012/0305505 | A1* | 12/2012 | Barkdoll | A47F 5/0823 211/59.1 |
| 2014/0061401 | A1* | 3/2014 | Bernstein | A47F 5/0006 248/125.3 |
| 2014/0346129 | A1* | 11/2014 | Hall | A47J 47/16 211/162 |
| 2015/0068990 | A1* | 3/2015 | Shea | A47F 5/0815 211/57.1 |

* cited by examiner

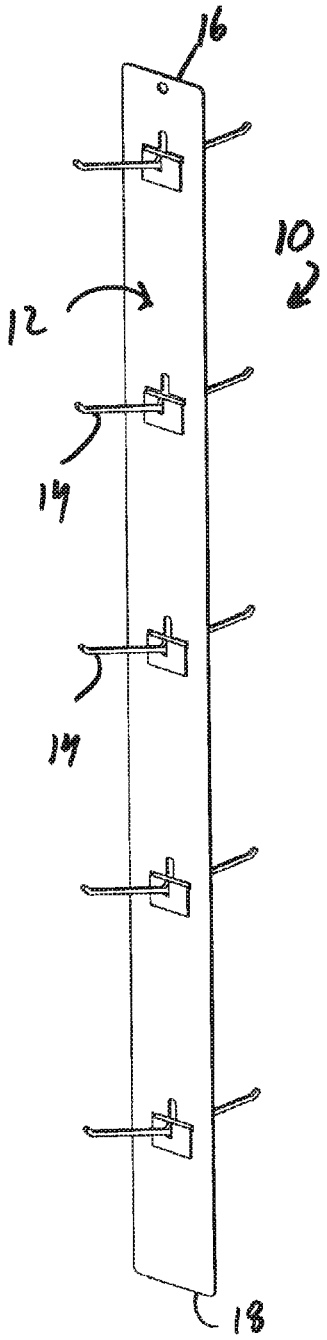
FIG. 1
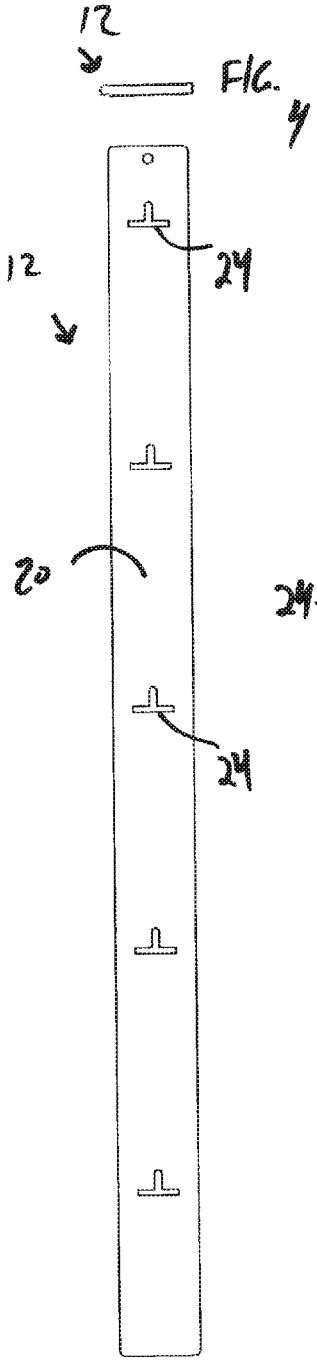
FIG. 2
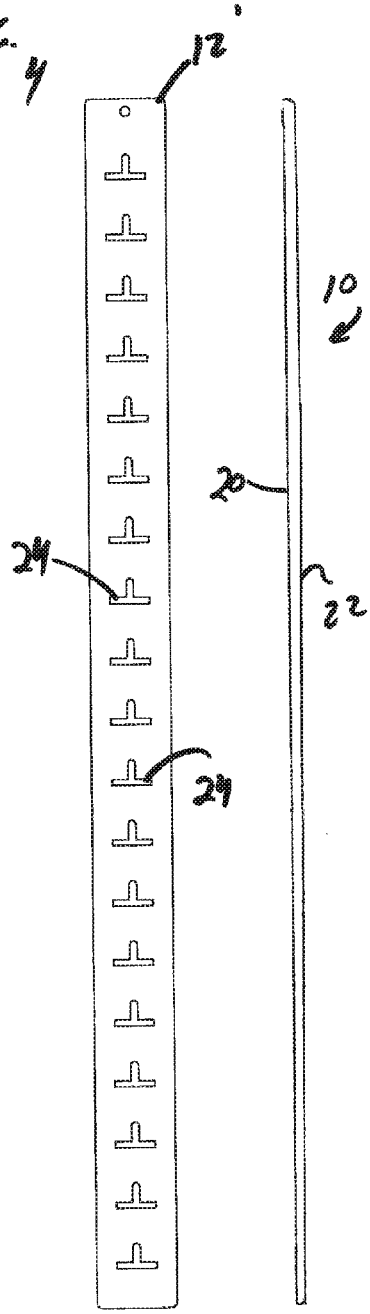
FIG. 5
FIG. 3

200

200

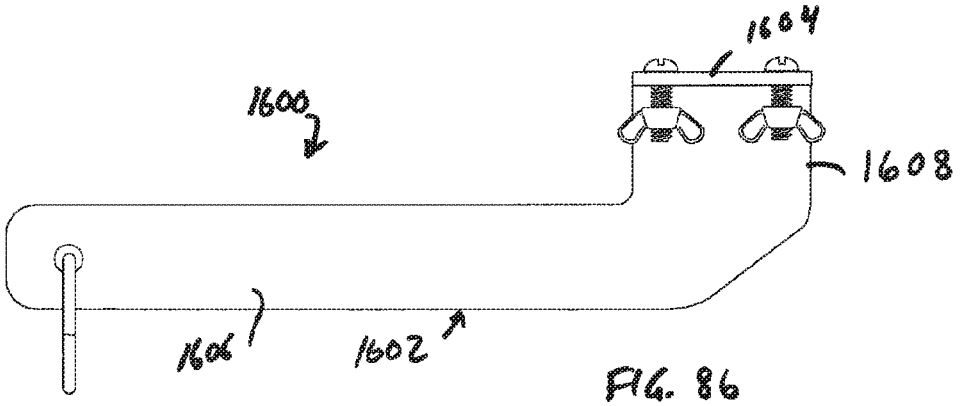
FIG. 86
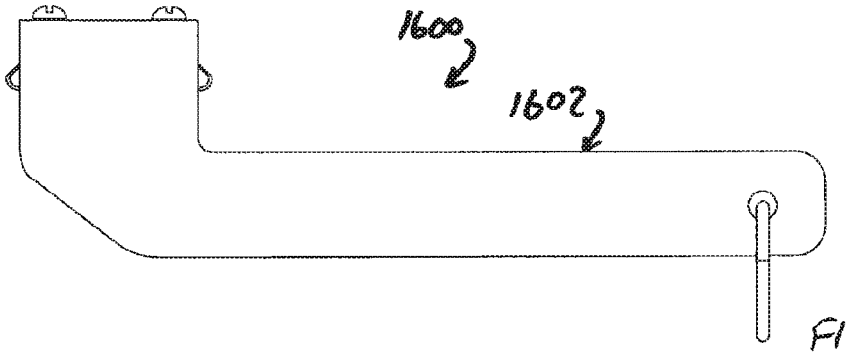
FIG. 87
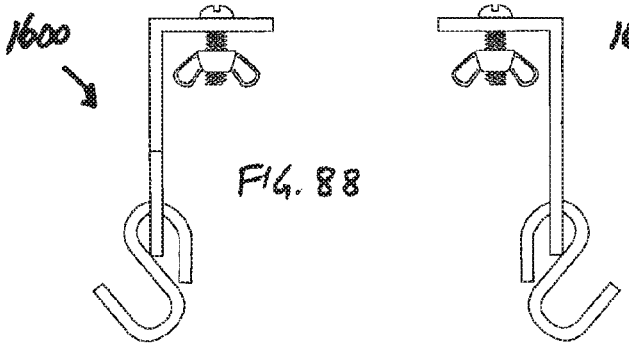
FIG. 88
FIG. 89
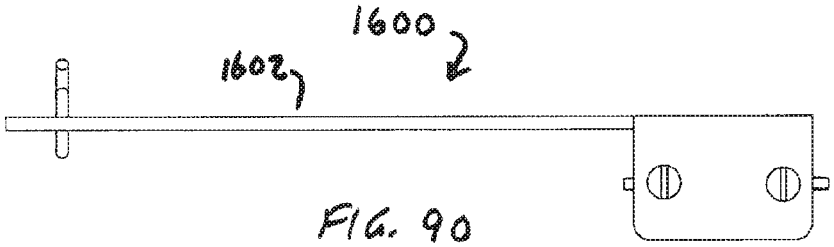
FIG. 90
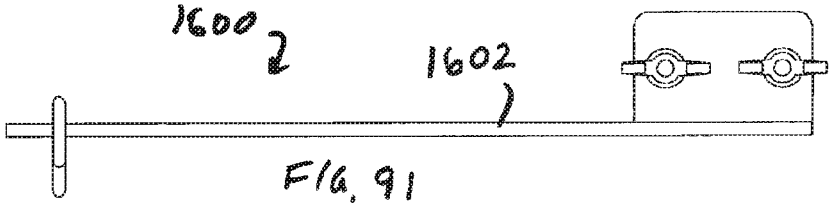
FIG. 91

1900

1900

1900

SIGNAGE SYSTEMS AND MERCHANDISING DISPLAY ASSEMBLIES

CROSS-REFERENCE TO RELATED APPLICATIONS

This application claims priority to U.S. patent application Ser. No. 14/019,658 filed 6 Sep. 2013, which application is herein expressly incorporated by reference.

FIELD

The present teachings generally relate to retail signage systems and merchandising display assemblies.

DISCUSSION

A multitude of product and product categories crowd the aisles and merchandise displays of retail stores. Signage systems can be used to showcase products or product categories, attract attention and provide guidance to different sections of the store. For example, various signage systems are shown and described in commonly owned U.S. Publication No. 2012/0240436, U.S. Publication No. 2012/0240436 is incorporated by reference as if fully disclosed herein.

Merchandising display assemblies can be used to more effectively position merchandise within the store. For example, one known merchandise display assembly is shown and described in commonly owned U.S. Pat. No. 5,957,422. U.S. Pat. No. 5,957,422 is incorporated by reference as if fully disclosed herein.

While existing signage systems and merchandising display assemblies have proven to be satisfactory for their intended purposes, there remains a need for continuous improvement within the relevant art.

SUMMARY

In accordance with one particular aspect, the present teachings provide various merchandising display assemblies.

In accordance with another particular aspect, the present teachings provide various signage systems.

In accordance with yet another particular aspect, the present teachings provide various merchandising display brackets.

In accordance with yet another particular aspect, the present teachings provide various merchandising support members.

In accordance with still yet another particular aspect, the present teachings provide various ornamental designs for merchandising display assemblies, merchandising display brackets and signage systems.

In one particular form, the present teachings provide a merchandising display system including a first generally planar panel and a second generally planar panel. The merchandising display system further includes at least one bracket interconnecting the first and second generally planar panels such that the first and second generally planar panels cooperate with a flat structure to have a triangular cross section in a horizontal plan.

In another particular form, the present teachings provide a merchandising display assembly includes an ornamental panel and at least one frame. The at least one frame includes a plurality of upright members. First and second upright members of the plurality of upright members cooperate to slidably receive the ornamental panel in an opening defined therebetween. Each upright member defines a plurality of openings along a length thereof. The assembly further includes a plurality of merchandising support members. A plurality of adjustable members carry the plurality of merchandising support members. Each adjustable member includes first and second ends for selectively engaging apertures of the plurality of upright members.

In yet another particular form, the present teachings provide a merchandising display assembly including a frame, at least one plate member and a plurality of merchandising support members. The at least one plate member is carried by the frame and oriented in a generally horizontal direction. The plurality of merchandising support members is carried by the at least one plate member.

In still yet another particular form, the present teachings provide a signage system a stationary structure, a sign holder and bracket. The bracket interconnects the stationary structure and the sign holder. The bracket includes a lower portion defining a lower channel for receiving the stationary structure and an upper portion defining an upper channel.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present invention will become more fully understood from the detailed description and the accompanying drawings, wherein:

FIG. 1 is a perspective view of a merchandising display assembly in accordance with the present teachings.

FIG. 2 is a front view thereof, the merchandising display assembly shown with the merchandising support members removed for purposes of illustration, the opposite side being a mirror image thereof.

FIG. 3 is a left side view thereof, the opposite side being a mirror image thereof.

FIG. 4 is a top view thereof, the opposite side being a mirror image thereof.

FIG. 5 is a front view of an alternative merchandising display assembly, the opposite side being a mirror image thereof. The remaining details of this merchandising display assembly will be understood to be identical to the merchandising display assembly of FIGS. 1-4.

FIG. 86 is a right side view thereof.

FIG. 87 is a left side view thereof.

FIG. 88 is a front view thereof.

FIG. 89 is a rear view thereof.

FIG. 90 is a top view thereof.

FIG. 91 is a bottom view thereof.

FIG. 108 is a right side view thereof.

FIG. 119 is a front side view thereof, the opposite side to that shown being a mirror image thereof.

FIG. 120 is a right side view thereof, the opposite side to that shown being a mirror image thereof.

FIG. 121 is a top side view thereof.

FIG. 122 is a perspective view of another merchandising display in accordance with the present teachings.

FIG. 123 is a front side view thereof, the opposite side to that shown being a mirror image thereof.

FIG. 124 is a right side view thereof, the opposite side to that shown being a mirror image thereof.

FIG. 125 is a top side view thereof.

FIG. 126 is a perspective view of another merchandising display in accordance with the present teachings.

FIG. 127 is a front side view thereof, the opposite side to that shown being a mirror image thereof.

FIG. 128 is a right side view thereof, the opposite side to that shown being a mirror image thereof.

FIG. 129 is a top side view thereof.

FIG. 130 is a perspective view of another merchandising display in accordance with the present teachings.

Figure 131:
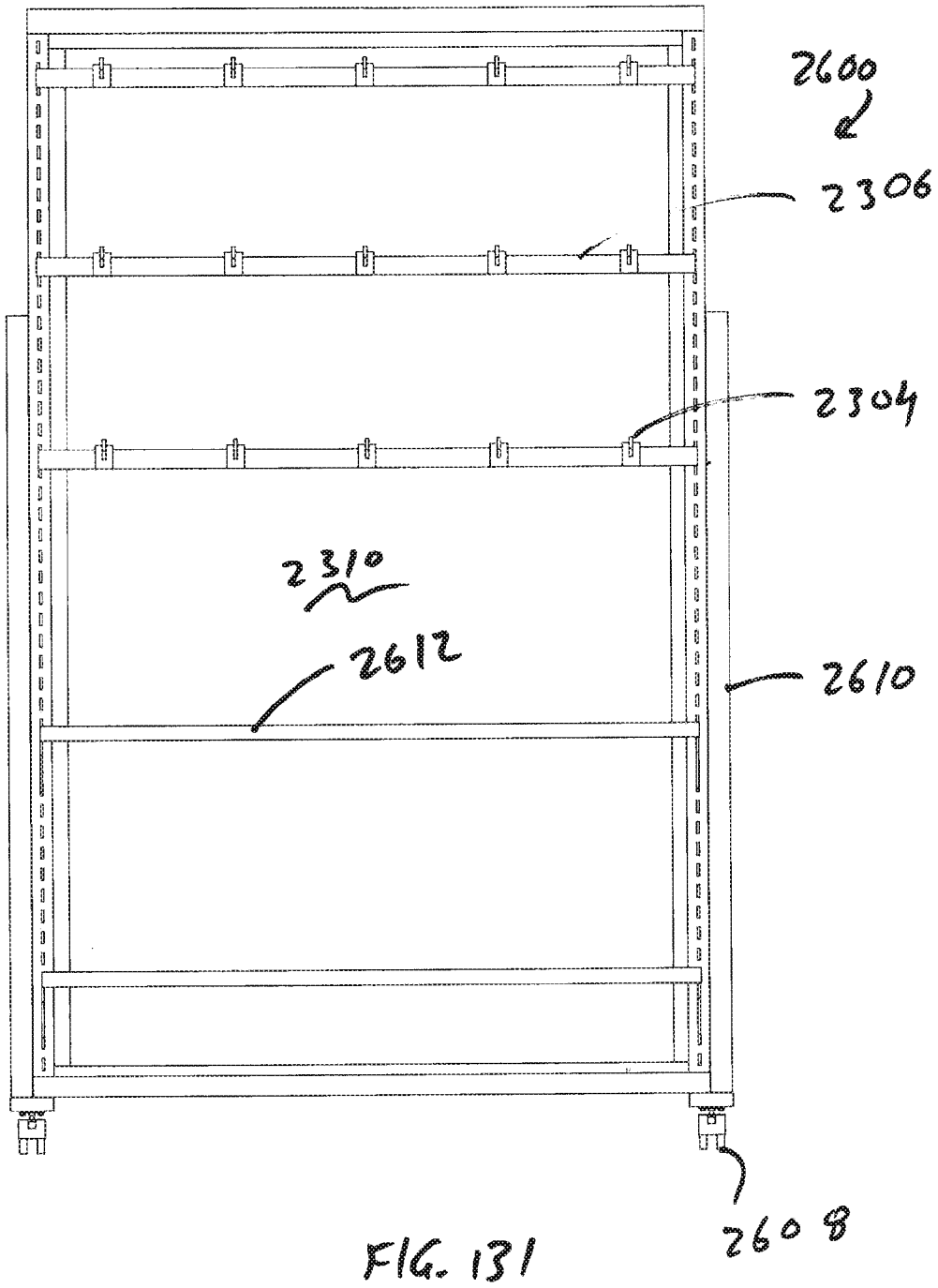

FIG. 131 is a front side view thereof, the opposite side to that shown being a mirror image thereof.

Figure 132:
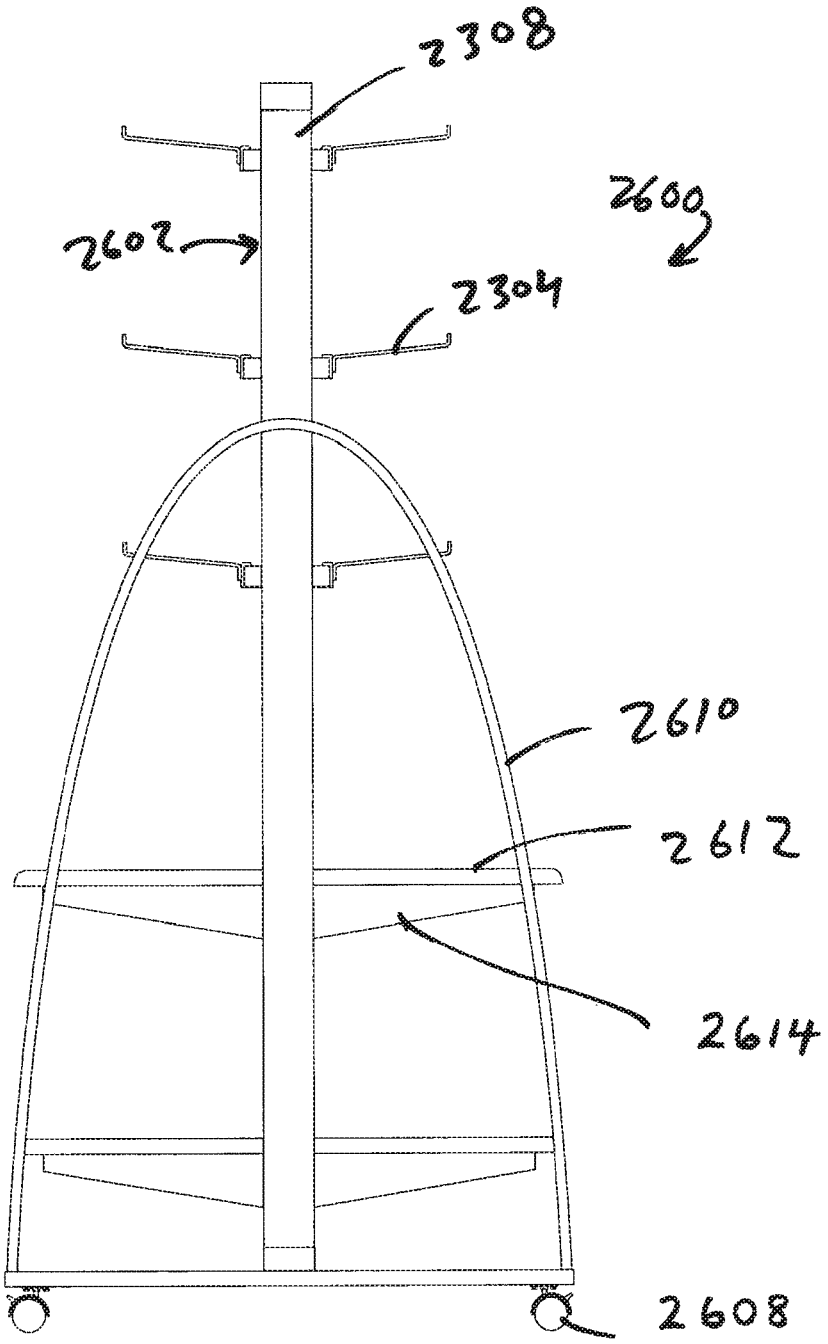

FIG. 132 is a right side view thereof, the opposite side to that shown being a mirror image thereof.

Figure 133:
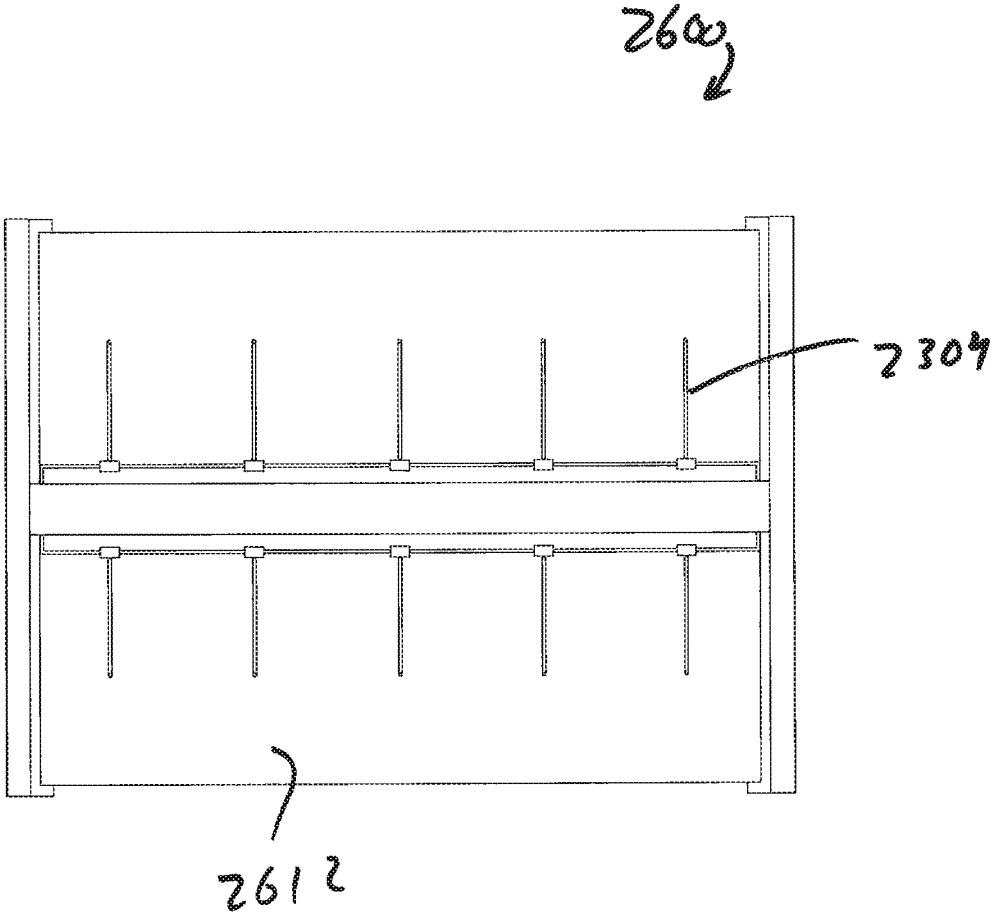

FIG. 133 is a top side view thereof.

Figure 134:
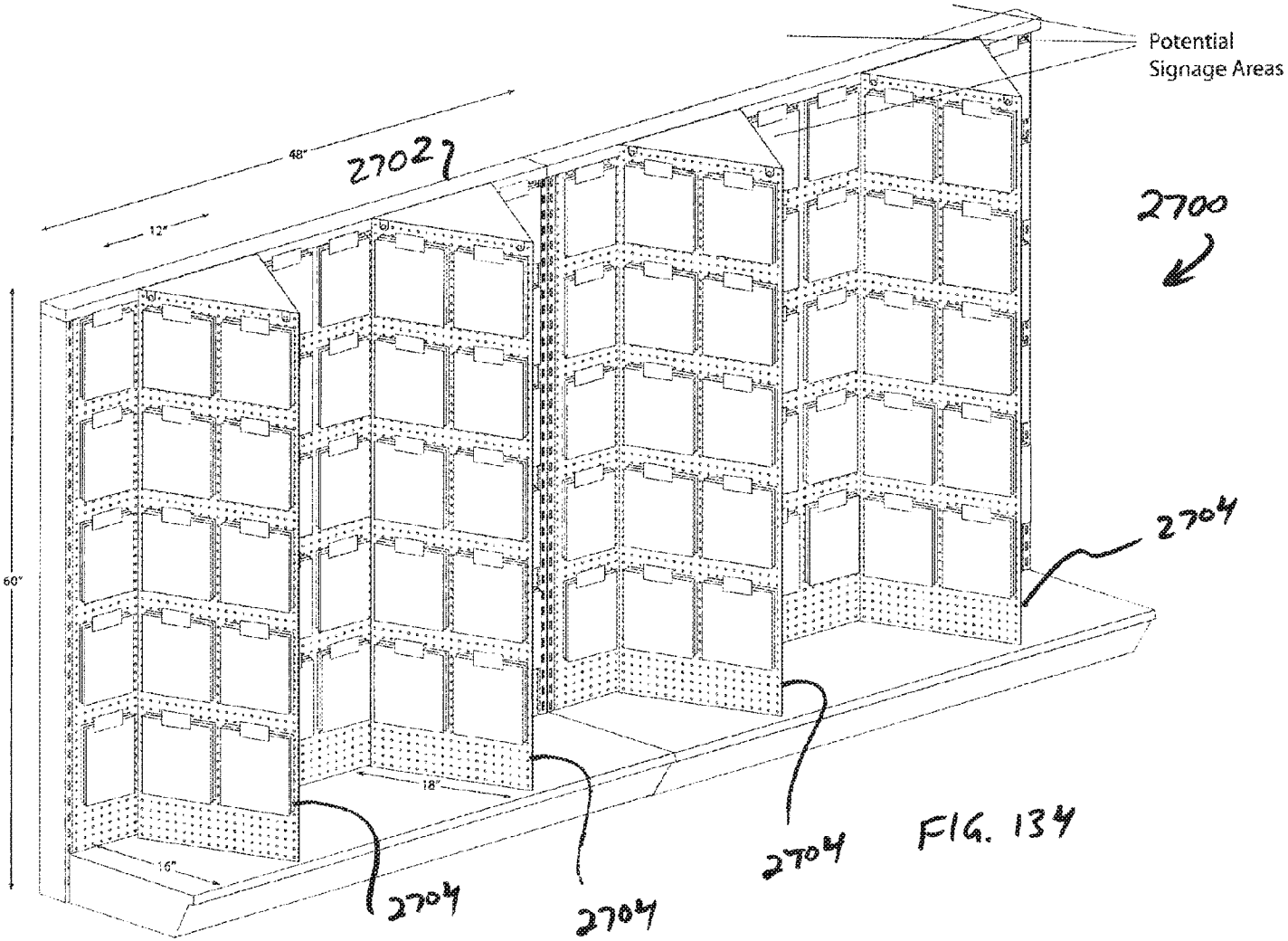

FIG. 134 is a perspective view of another merchandising arrangement including a plurality of merchandising systems in accordance with the present teachings.

Figure 135:
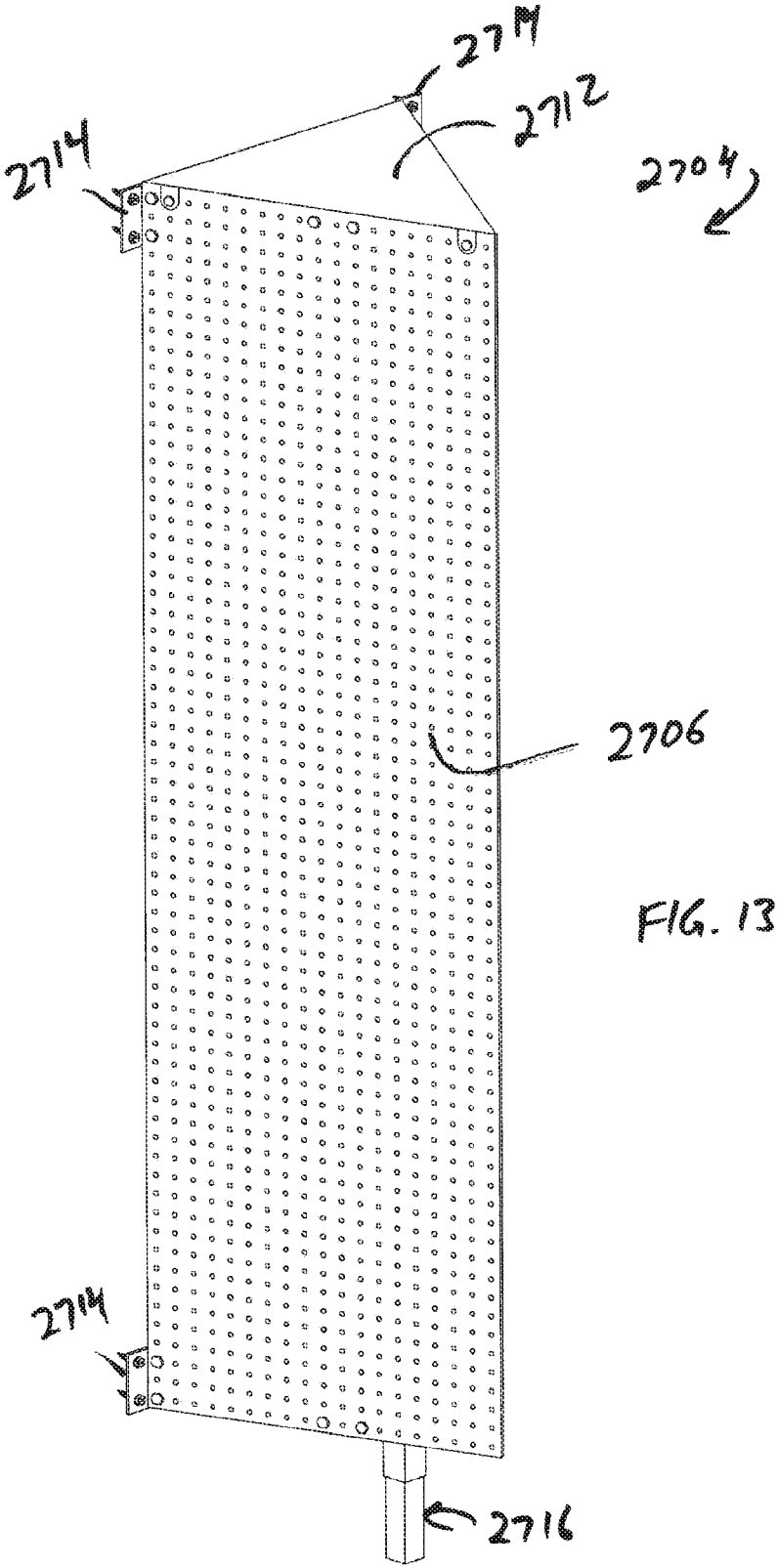

FIG. 135 is a perspective view of one of the merchandising display systems of FIG. 134, the retail product and associated suspension members removed for purposes of illustration.

Figure 136:
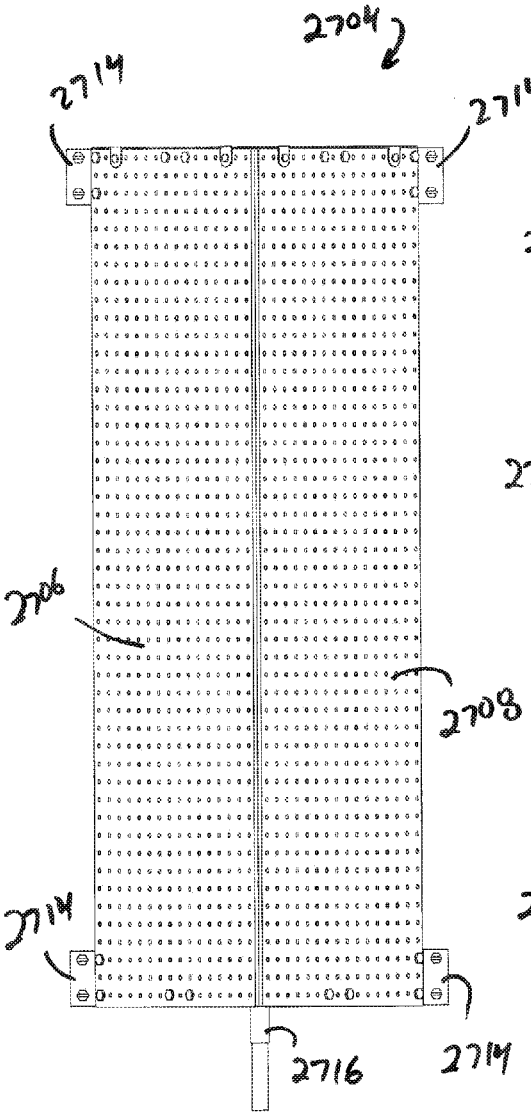

FIG. 136 is a front side view thereof.

Figure 137:
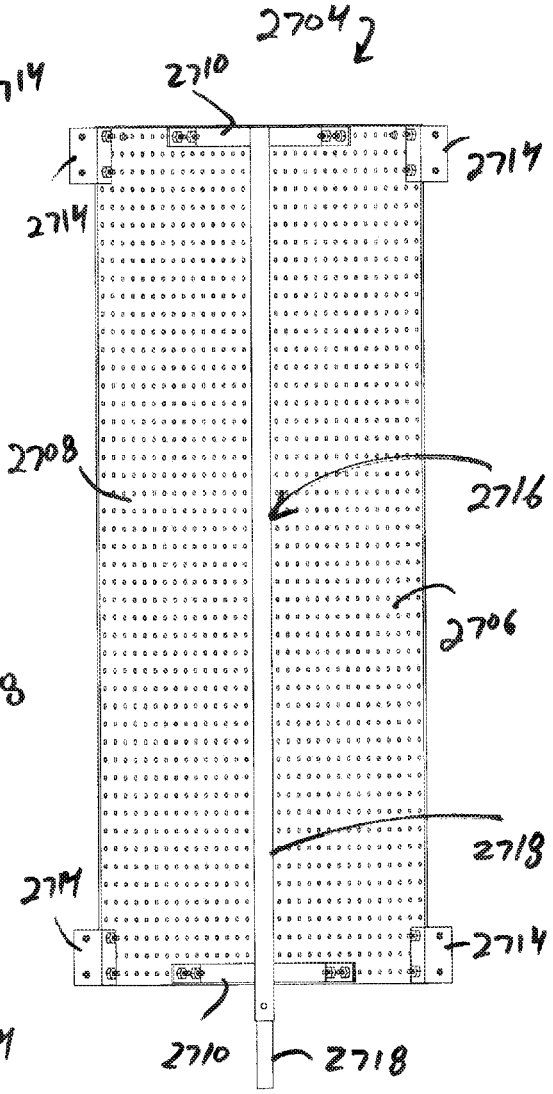

FIG. 137 is a rear side view thereof.

Figure 138:
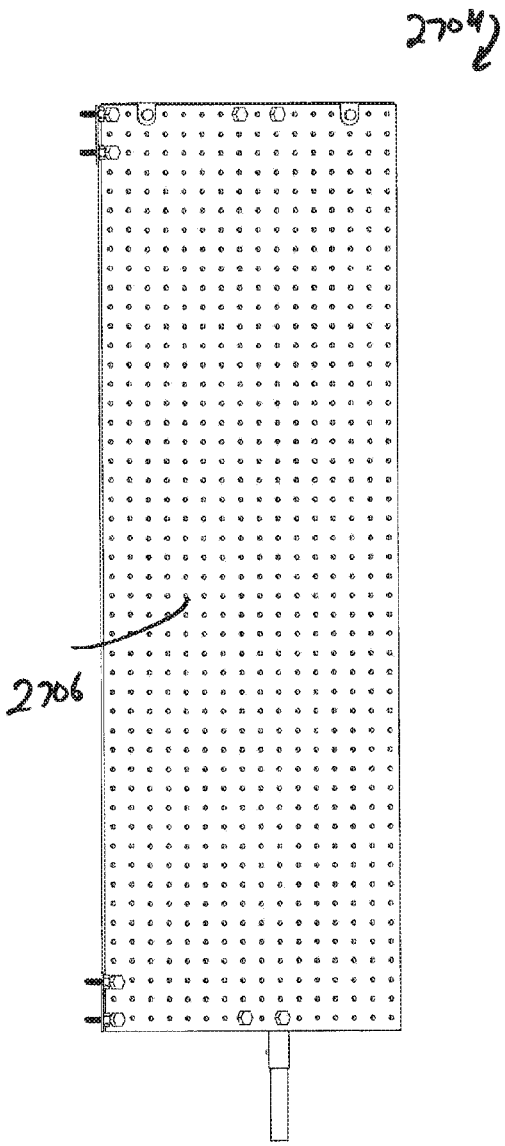

FIG. 138 is a left side view thereof.

Figure 139:
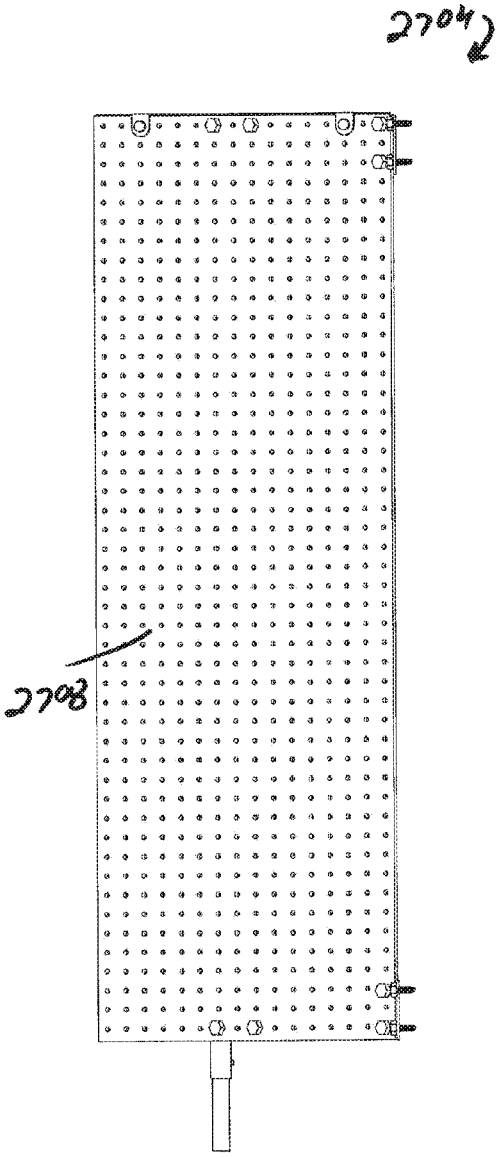

FIG. 139 is a right side view thereof.

Figure 140:
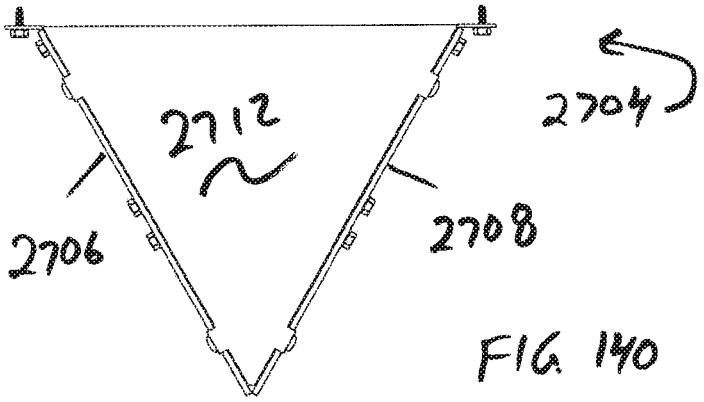

FIG. 140 is a top view thereof.

Figure 141:
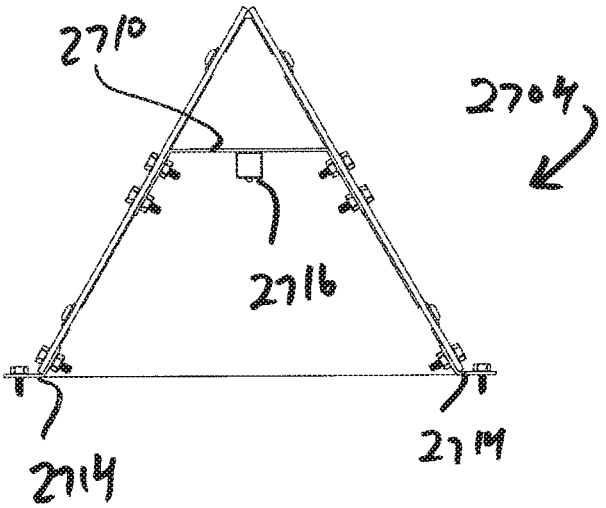

FIG. 141 is a bottom view thereof.

It will be understood that the various embodiments shown throughout the application are drawn to scale.

DESCRIPTION OF VARIOUS ASPECTS

The following description is merely exemplary in nature and is in no way intended to limit the invention, its application, or uses.

With initial reference to FIGS. 1 through 4, a merchandising display assembly constructed in accordance with the present teachings is illustrated and generally identified at reference character 10. The merchandising display assembly 10 is generally illustrated to include a generally planar member 12 and a plurality of merchandising support members 14. FIGS. 2 through 4 show the merchandising display assembly 10 with the merchandising support members 14 removed for purposes of further illustrating the generally planar member 12.

The generally planar member 12 includes an upper end 16, a lower end 18, a front planar face 20 and a rear planar face 22. The generally planar member 12 is preferably constructed of a corrugated plastic material, paperboard or other suitable material, the purpose of which is to provide rigidity and deflection resistant support to the generally planar member 12 along both axial and lateral directions 10.

The generally planar member 12 is formed to include a plurality of apertures 24. The apertures 24 are formed at selected locations along the height of the generally planar member 12 and extend through both the front and rear planar faces 20 and 22. As shown, each of the apertures 24 may have the general shape of an inverted T. The size and shape of the apertures 24 are intended to functionally receive and retain the merchandising support members 14. In the embodiment illustrated, the generally planar member 12 is shown to include five (5) apertures 24. It will be understood, however, that a greater or lesser number of apertures may be incorporated within the scope of the present teachings.

Turning particularly to FIGS. 2 through 4, one of the merchandising support members 14 is illustrated and will be further described. It will be understood that the merchandising support members 14 are generally identical but may alternatively be different. The merchandising support member 14 is generally illustrated to include a mounting portion 26 and a pair of support arms 28. It will be understood that the mounting portion 26 and the pair of support arms 28 are monolithically formed of a common material. In the embodiment illustrated, the mounting portion 26 and the pair of support arms 28 are formed of a plastic or other suitable material. As such, the merchandising support member 14 retains a degree of flexibility. It will be appreciated, however, that the support arms 28 are sufficiently rigid to suspend typical merchandise.

The arms 28 extend outwardly from the mounting portion 26 in a generally horizontal but slightly, upwardly inclined direction. At their terminal ends, the arms 28 include and upwardly turned section for retaining product thereon.

In side view, the mounting portion 26 has the shape generally of an inverted U. In this regard, the mounting portion 26 opens in a downward direction. On an inner side thereof, the mounting portion 26 includes a plurality of projections or teeth integrally formed therewith. In the embodiment illustrated, the mounting portion 26 includes three such projections. It will be appreciated, however, that the mounting portion 26 may be alternatively formed to include a greater or lesser number of projections. The projections may be integrally formed with the mounting portion 26 and the remainder of the merchandising support member 14.

The merchandising support members 14 are attached to the generally planar member 12 by inserting one of the support arms 28 through a corresponding one of the apertures 24. The open and of the mounting portion 26 receives a lower edge of the opening 24 and the mounting portion 26 is downwardly translated such that the generally planar member 12 is engaged by the projections of the mounting portion 26.

With reference to FIGS. 11 through 15, another merchandising support member constructed in accordance with the present teachings is illustrated and generally identified at reference character 14'. Given the similarities between the merchandising support member 14' and the merchandising support member 14, like reference characters have been used to identify similar elements throughout the drawings. The merchandising support member 14' primarily differs from the merchandising support member 14 in that the merchandising support member 14' additionally incorporates a second pair of arms 30. The second pair of arms 30 may be integrally formed with the remainder of the merchandising support member 14' and may be used to retain product information. The merchandising support member 14' may be similarly secured to the generally planar member 12.

With reference now given to FIGS. 16 through 21, a signage system constructed in accordance with the present teachings is illustrated and generally identified at reference character 100. The signage system 100 is generally illustrated to include a base member or gondola 102, a sign support member 104, and a merchandising display bracket 106 interconnecting a base member 102 and the sign support member 104. FIGS. 17 through 21 show the bracket 106 removed from the remainder of the signage system 100 for purposes of further illustrating the bracket 106.

With particular reference to FIGS. 17 through 21, the merchandising display bracket 106 will be further described. In the embodiment illustrated, the merchandising display bracket 16 is unitary formed of a common material. In one application, the merchandising display bracket while six is extruded of a plastic material. It will be appreciated, however, that other suitable materials and manufacturing techniques may be employed within the scope of the present teachings.

The bracket 16 includes a lower portion 108 defining a lower channel 110 and an upper portion 112 defining an upper channel 114. As shown in the environmental view of FIG. 16, the lower portion 108 receives an upper end of the gondola 102. The upper portion 112 may slidably receive the sign support member 104. The bracket 106 includes a length L and a height H. in the embodiment illustrated, the length L is greater than the height H. The lower portion 108 includes a pair of cowardly extending arms. The downwardly extending arms are formed to include a plurality of gripping teeth at a distal end thereof and on and inner side thereof. The material of the bracket 106 is selected such that the arms have a degree of flexibility for accommodating and gripping the gondola 102.

Turning to FIGS. 22 through 27, another signage system constructed in accordance with the present teachings is illustrated and generally identified at reference character 200. The signage system 200 is generally illustrated to include a plurality of panels and cooperating mounting structure. In the embodiment illustrated, side system 200 defines a generally rectangular, structure. At least the front panel and side panels may be adapted to slidably receive signage.

Turning to FIGS. 28 through 33, another signage system constructed in accordance with the present teachings is illustrated and generally identified at reference character 300. Given the similarities between the signage system 200 and the signage system 300, like reference characters have been used to identify similar elements throughout the drawings. The signage system 300 primarily differs from the signage system 200 in that the front panel of the signage system 300 is shorter than the rear panel and the signage system 300 no longer has a rectangular shape.

Turning to FIGS. 34 through 39, another signage system constructed in accordance with the present teachings is illustrated and generally identified at reference character 300. Given the similarities between the signage system 400 and the signage systems 200 and 300, like reference characters have been used to identify similar elements throughout the drawings. The signage system 400 primarily differs from the signage systems 200 and 300 in that the side panels of the signage system 400 may have different lengths.

With reference now to FIGS. 40 through 44, another merchandising support assembly constructed in accordance with the present teachings is illustrated and generally identified at reference character 500. The merchandising support assembly 500 is generally illustrated to include a support structure 502 and a plurality of merchandising support members 504. FIGS. 41 through 44 show the support structure 502 with the merchandising support members 504 removed for purposes of further illustrating the support structure 502.

Support structure 502 may be constructed of metal or other suitable material. The support structure 502 includes a main portion having a generally T-shape with a vertically extending arm 506 and a horizontally extending arm 508. A mounting bracket 510 is carried at a lower end of the vertically extending arm 506 and is adapted to receive and amounts to a gondola or similar structure. In this regard, the bracket 510 is generally U-shaped and carries a pair of thumbscrews.

The support structure 502 further includes a pair of arms or plates 512. In the embodiment illustrated, these structures are plates which extend in horizontal directions and are secured proximate their longitudinal midpoints to the distal ends of the horizontally extending arm 508. The plates 512 are adapted to slidably receive the merchandising support members 504. It will be understood that the merchandising support members 504 and their attachment to the plates 512 is generally conventional insofar as the present invention is concerned.

With reference now to FIGS. 45 through 50, another merchandising support assembly constructed in accordance with the present teachings is illustrated and generally identified at reference character 600. Given the similarities between the merchandising support assembly 600 and the merchandising support assembly 500, like reference characters have been used to identify similar elements throughout the drawings. The merchandising support assembly 600 is generally illustrated to include a support structure 602 and a plurality of merchandising support members 504. FIGS. 46 through 50 show the support structure 602 with the merchandising support members 504 removed for purposes of further illustrating the support structure 602.

The support structure 602 is generally illustrated to include a vertically extending arm 604. The vertically extending arm 604 may have a generally rectangular cross-section and may include first and second members 606 and 608 that are telescopic weight associated with one another. In this regard, the vertically extending arm 604 may be adjusted in length. A spring loaded button 612 may be carried by the first member 604. The spring-loaded button 612 may be selectively received within one of a plurality of apertures 614 defined by the second member 608 in a conventional manner.

A mounting bracket 610 is carried at a lower distal end of the vertically extending arm 604. Again, the mounting bracket 610 is generally U-shaped and carries a pair of thumbscrews. The mounting bracket 610 defines a channel for receiving a stationary structure such as a rail or the like. In this embodiment, the channel defined by the mounting bracket 16 extends at an angle to the horizontal.

A plate 512 or similar structure is carried at an upper distal end of the vertically extending arm 604. The plate is adapted to slidably receive the merchandising support members 504 as described above.

With reference now to FIGS. 51 through 56, another merchandising support assembly constructed in accordance with the present teachings is illustrated and generally identified at reference character 700. Given the similarities between the merchandising support assembly 700 and the merchandising support assemblies 500 and 600, like reference characters have been used to identify similar elements throughout the drawings. The merchandising support assembly 700 is generally illustrated to include a support structure 702 and a plurality of merchandising support members 504. FIGS. 52 through 56 show the support structure 702 with the merchandising support members 504 removed for purposes of further illustrating the support structure 702. The merchandising support assembly 700 primarily differs from the merchandising support assembly 600 in that the channel defined by the bracket 610 extends in a generally horizontal direction. This embodiment further illustrates that the mounting bracket may be secured to cooperating stationary structure with a single thumbscrew or other well-known structure in the art.

Turning now to FIGS. 57 through 62, another merchandising support assembly constructed in accordance with the present teachings is illustrated and generally identified at reference character 800. Given the similarities between the merchandising support assembly 800 and the prior described merchandising support assemblies, like reference characters have been used to identify similar elements throughout the drawings. The merchandising support assembly 800 is generally illustrated to include a support structure 802 and a plurality of merchandising support members 504. FIGS. 58 through 62 show the support structure 802 with the merchandising support members 504 removed for purposes of further illustrating the support structure 802.

The merchandising support structure 800 differs from the merchandising support structure 700 in that the merchandise support structure 800 is self-supporting. In this regard, a lower distal end of the vertically extending arm 604 may be welded or otherwise securely fastened to a horizontally oriented plate 804. Attachment of the plate 804 to the vertically extending arm 604 may be reinforced with a supplemental member 806. The plate 804 may be sized for stable supporting of the merchandising support assembly 800 when loaded with product and positioned upon a flat surface. In the embodiment illustrated, the plate 804 may be generally square in shape. It will be appreciated, however, that any suitable shape may be incorporated within the scope of the present teachings.

Turning now to FIGS. 63 through 68, another merchandising support assembly constructed in accordance with the present teachings is illustrated and generally identified at reference character 900. Given the similarities between the merchandising support assembly 900 and the prior described merchandising support assemblies, like reference characters have been used to identify similar elements throughout the drawings. The merchandising support assembly 900 is generally illustrated to include a support structure 902 and a plurality of merchandising support members 504. FIGS. 64 through 68 show the support structure 902 with the merchandising support members 504 removed for purposes of further illustrating the support structure 902.

The merchandising support assembly 900 is perhaps most similar to the merchandising support assembly 600. In this environment, the merchandising support assembly 900 includes an alternatively shaped vertically extending arm 904. The arm 904 is constructed of a single member and in this particular embodiment is not extendable.

Turning now to FIGS. 69 through 74, another merchandising support assembly constructed in accordance with the present teachings is illustrated and generally identified at reference character 1000. Given the similarities between the merchandising support assembly 800 and the prior described merchandising support assemblies, like reference characters have been used to identify similar elements throughout the drawings. The merchandising support assembly 1000 is generally illustrated to include a support structure 1002 and a plurality of merchandising support members 504. FIGS. 70 through 74 show the support structure 1002 with the merchandising support members 504 removed for purposes of further illustrating the support structure 1002.

The merchandising support assembly 1000 is perhaps most similar to merchandising support assembly 900. The merchandising support assembly 1000 primarily differs from the merchandising support assembly 900 in that the channel defined by the bracket 610 extends in a generally horizontal direction. This embodiment further illustrates that the mounting bracket 610 may be secured to cooperating stationary structure with a single thumbscrew or other well-known structure in the art.

Turning now to FIGS. 75 through 80, another merchandising support assembly constructed in accordance with the present teachings is illustrated and generally identified at reference character 1100. Given the similarities between the merchandising support assembly 800 and the prior described merchandising support assemblies, like reference characters have been used to identify similar elements throughout the drawings. The merchandising support assembly 1100 is generally illustrated to include a support structure 1102 and a plurality of merchandising support members 504. FIGS. 76 through 80 show the support structure 1102 with the merchandising support members 504 removed for purposes of further illustrating the support structure 1102.

The merchandising support assembly 1100 is illustrated to include the vertically extending arm 904 of the merchandising support assembly 900. Additionally, the merchandising support assembly 1100 illustrated to include the support plate 804 of the merchandising support assembly 800.

Figure 6:
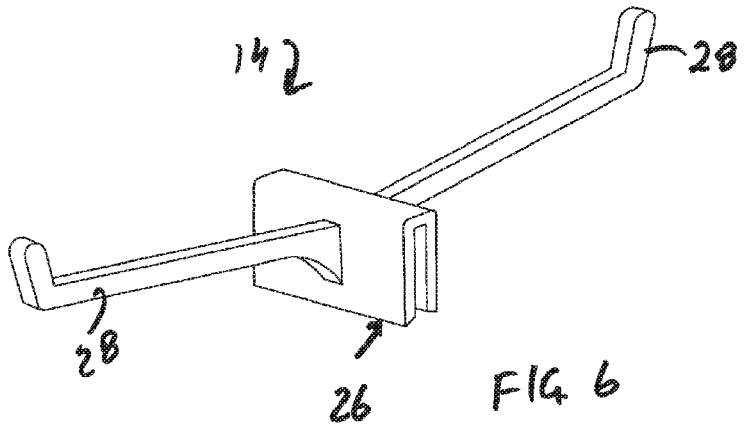
FIG. 6 is a perspective view of the merchandising support member of FIG. 1.
Figure 7:
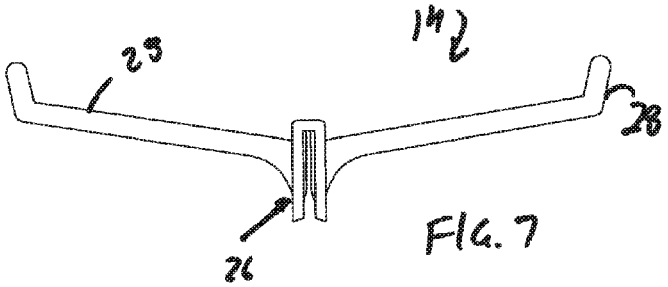
FIG. 7 is a right side view thereof, the opposite side being a mirror image thereof.
Figure 8:
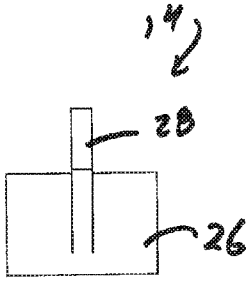
FIG. 8 is a front view thereof, the opposite side being a mirror image thereof.
Figure 9:
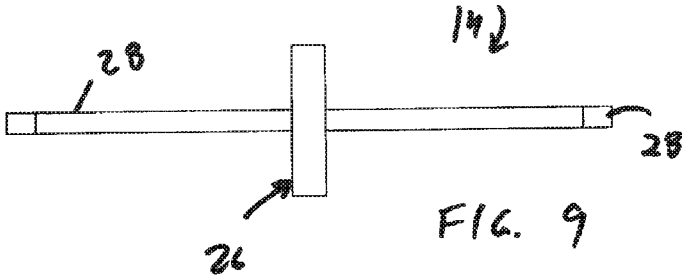
FIG. 9 is a top view thereof.
Figure 10:
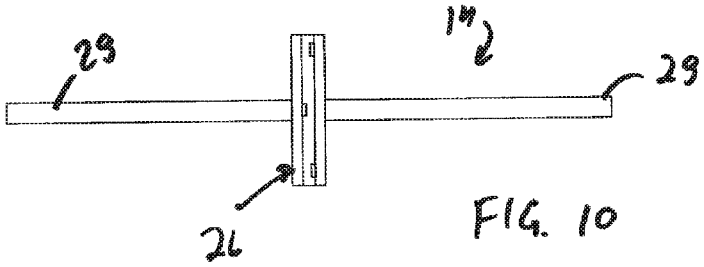
FIG. 10 is a bottom view thereof.
Figure 11:
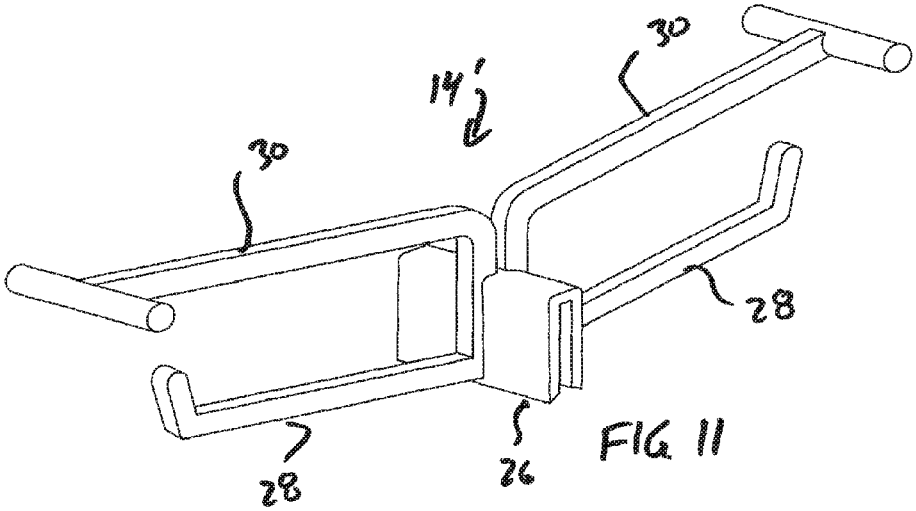
FIG. 11 is a perspective view of another merchandising support member in accordance with the present teachings.
Figure 12:
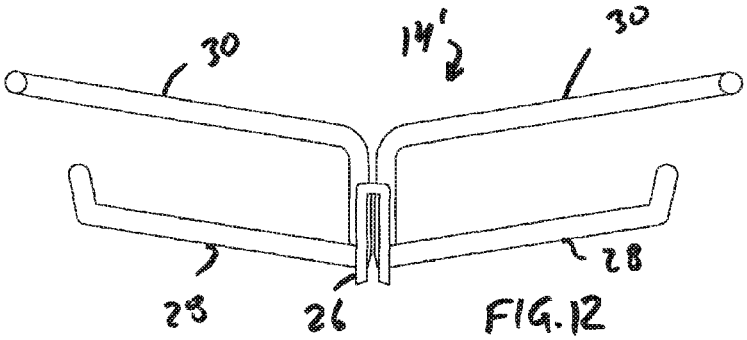
FIG. 12 is a right side view thereof, the opposite side being a mirror image thereof.
Figure 13:
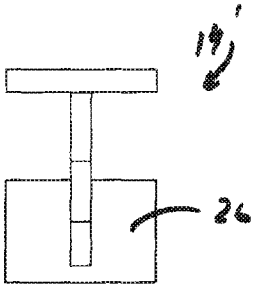
FIG. 13 is a front view thereof, the opposite side being a mirror image thereof.
Figure 14:
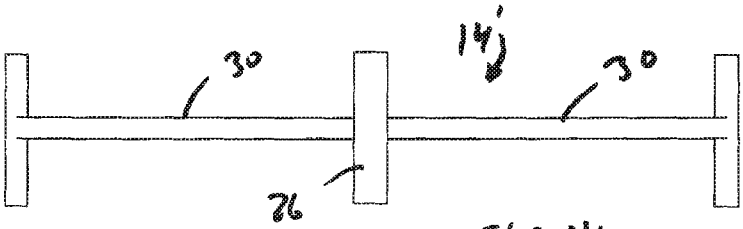
FIG. 14 is a top view thereof.
Figure 15:
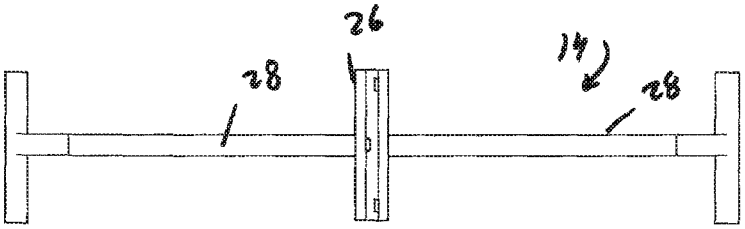
FIG. 15 is a bottom view thereof.
Figure 16:
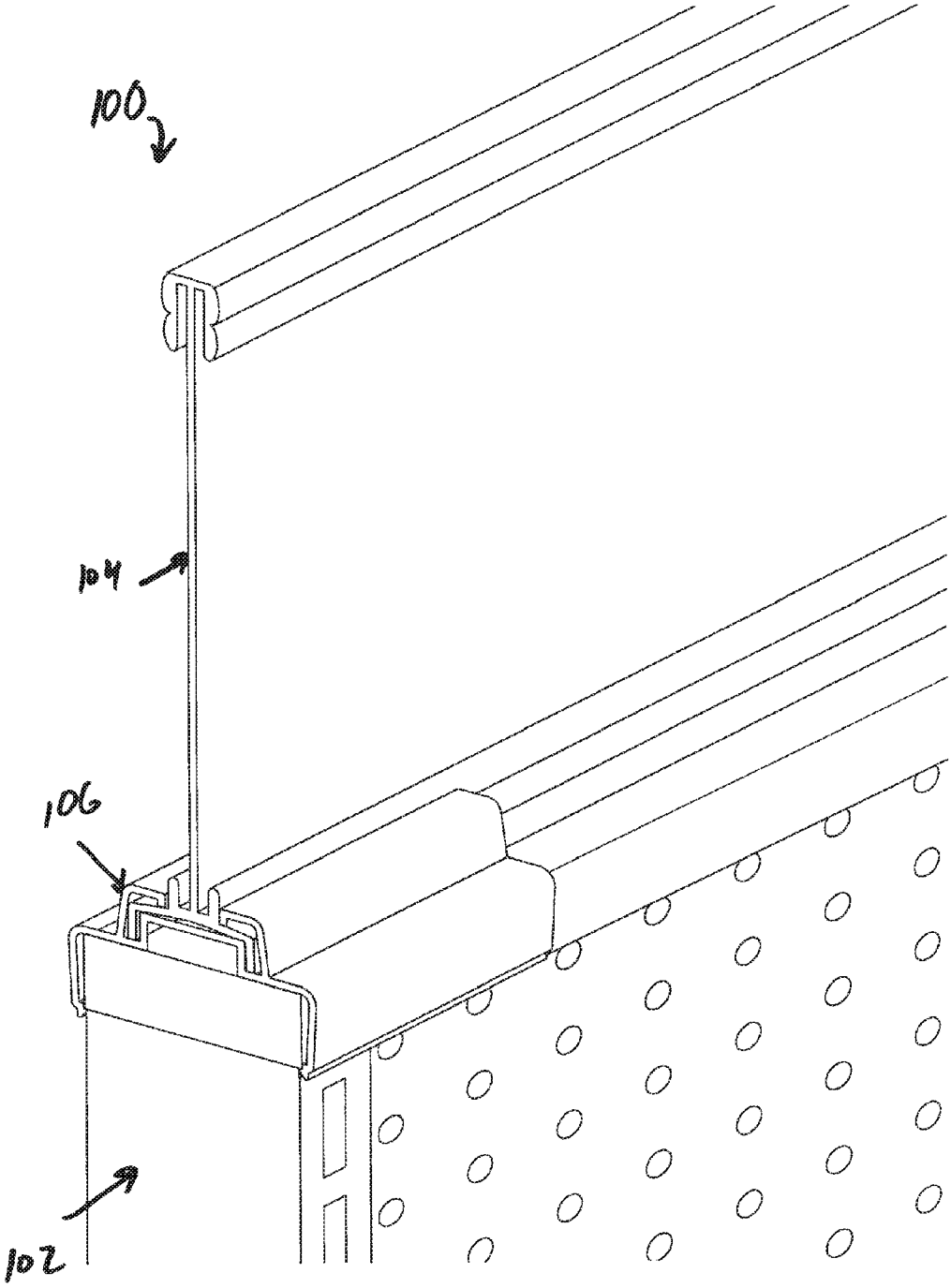
FIG. 16 is a perspective view of a signage system in accordance with the present teachings.
Figure 17:
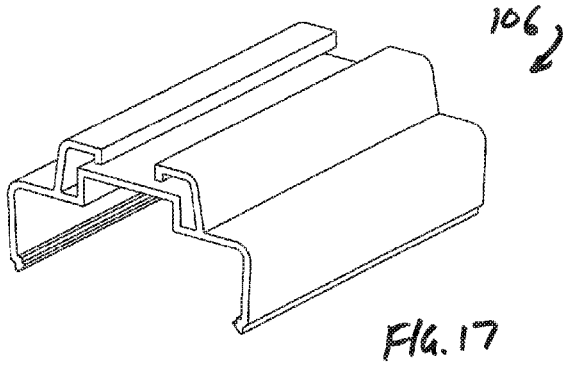
FIG. 17 is a perspective view of a merchandising display bracket thereof shown removed from the remainder of the system for purpose of illustration.
Figure 18:
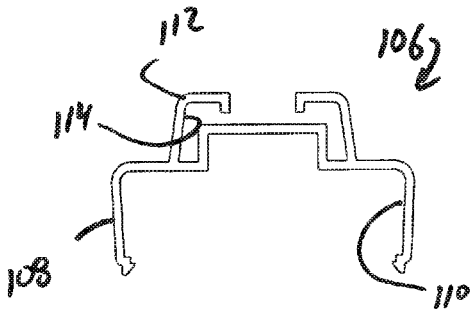
FIG. 18 is a front view thereof, the opposite side being a mirror image thereof.
Figure 19:
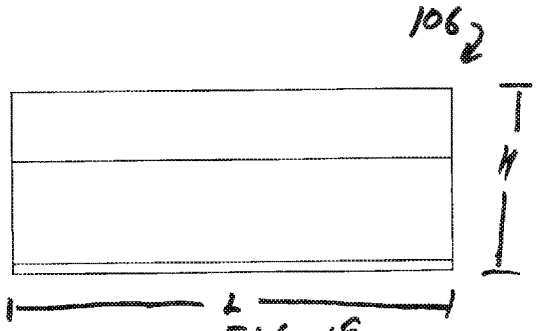
FIG. 19 is a right side view thereof, the opposite side being a mirror image thereof.
Figure 20:
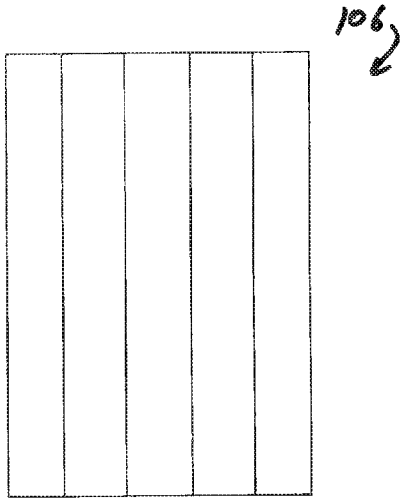
FIG. 20 is a top view thereof.
Figure 21:
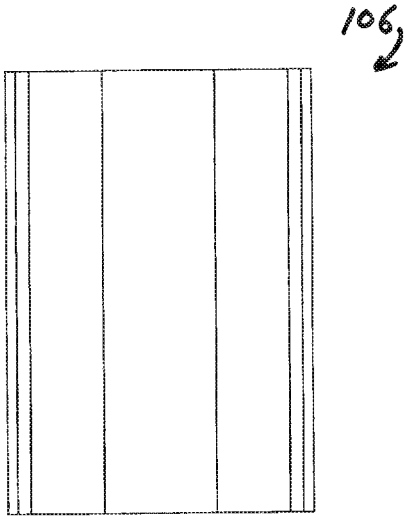
FIG. 21 is a bottom view thereof.
Figure 22:
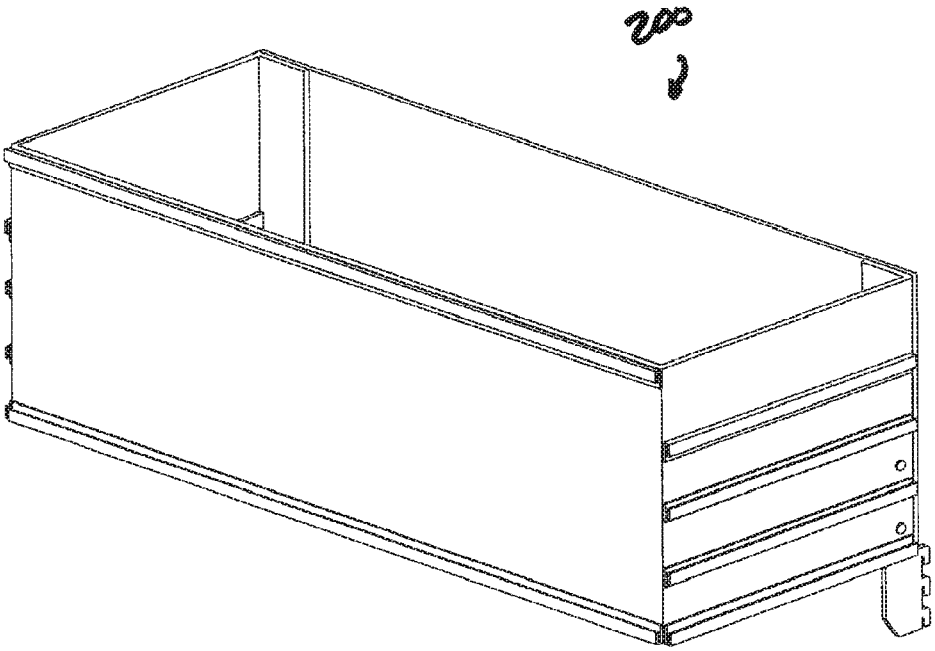
FIG. 22 is a perspective view of a signage system in accordance with the present teachings.
Figure 23:
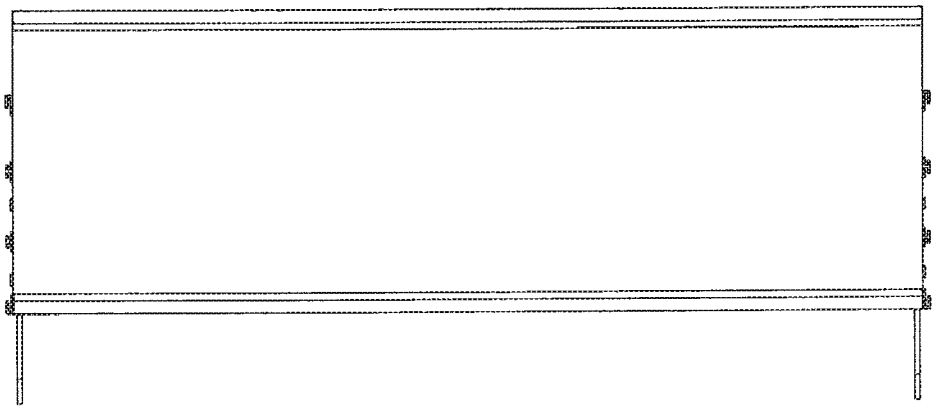
FIG. 23 is a front view thereof.
Figure 24:
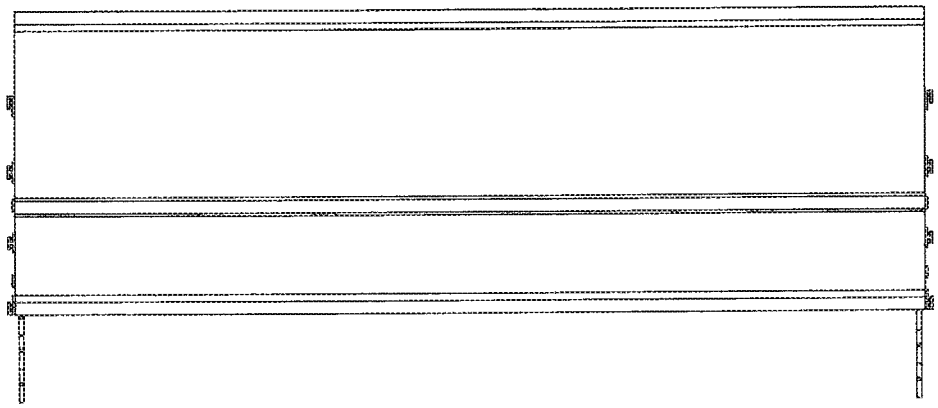
FIG. 24 is a rear view thereof.
Figure 25:
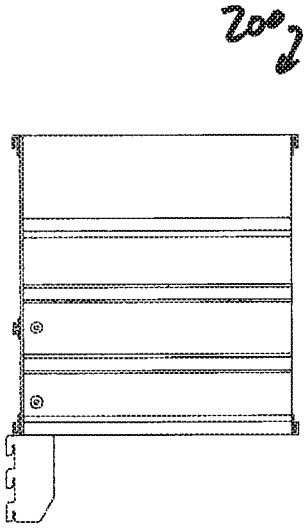
FIG. 25 is a left side view thereof.
Figure 26:
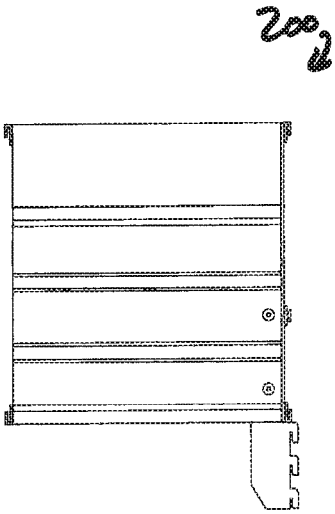
FIG. 26 is a right side view thereof.
Figure 27:
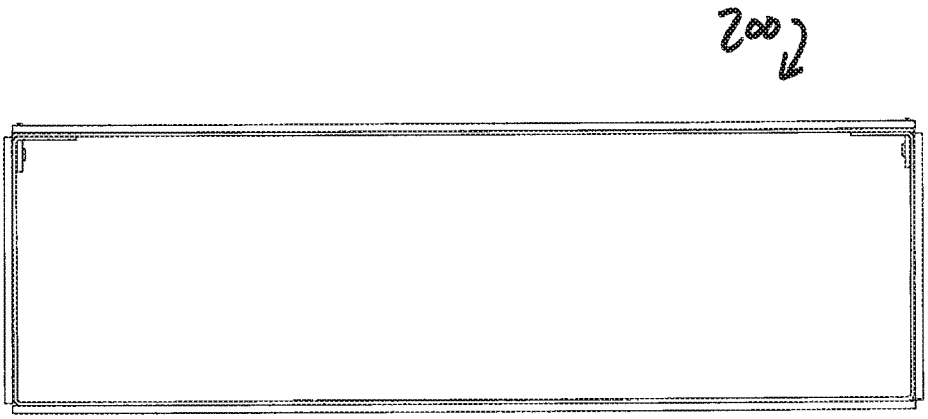
FIG. 27 is a top view thereof, the opposite side being a mirror image thereof.
Figure 28:
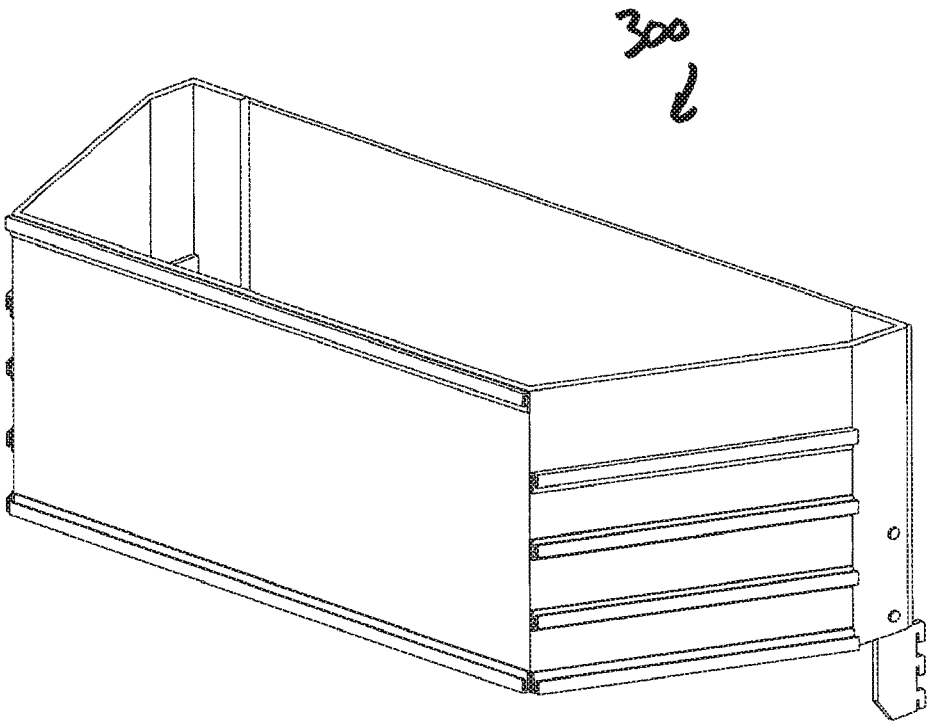
FIG. 28 is a perspective view of a signage system in accordance with the present teachings.
Figure 29:
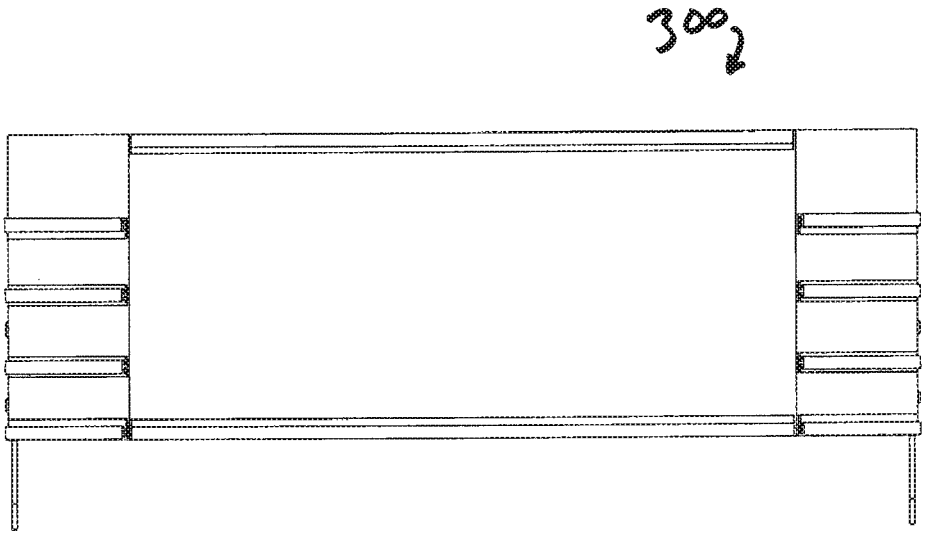
FIG. 29 is a front view thereof.
Figure 30:
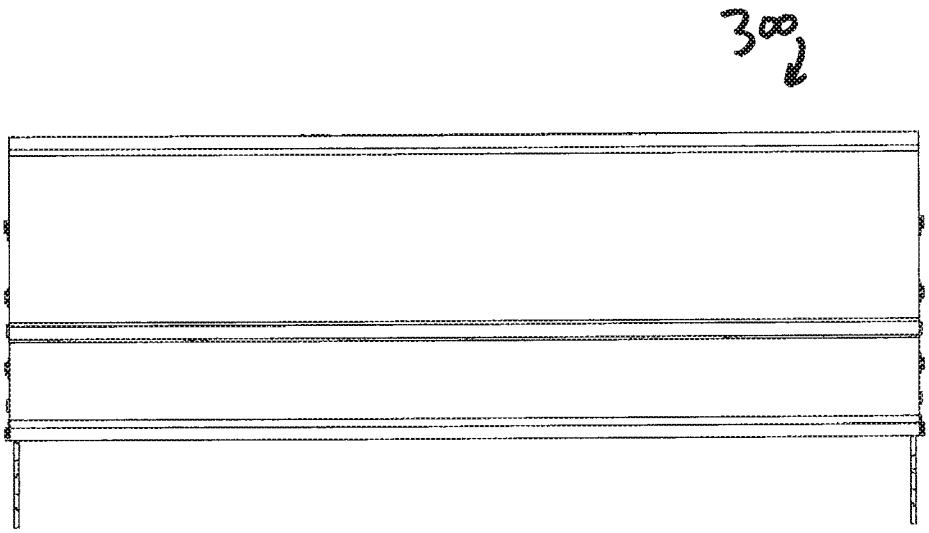
FIG. 30 is a rear view thereof.
Figure 31:
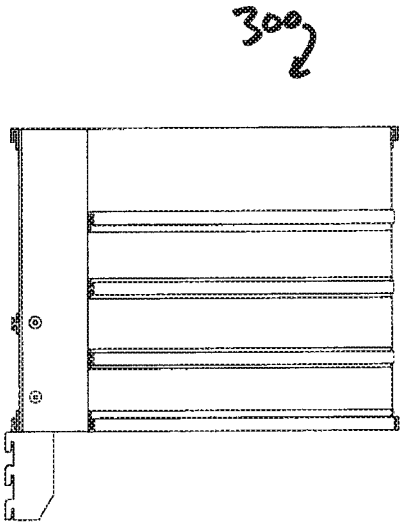
FIG. 31 is a left side view thereof.
Figure 32:
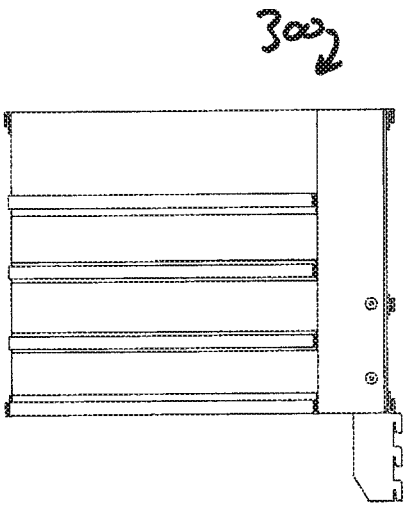
FIG. 32 is a right side view thereof.
Figure 33:
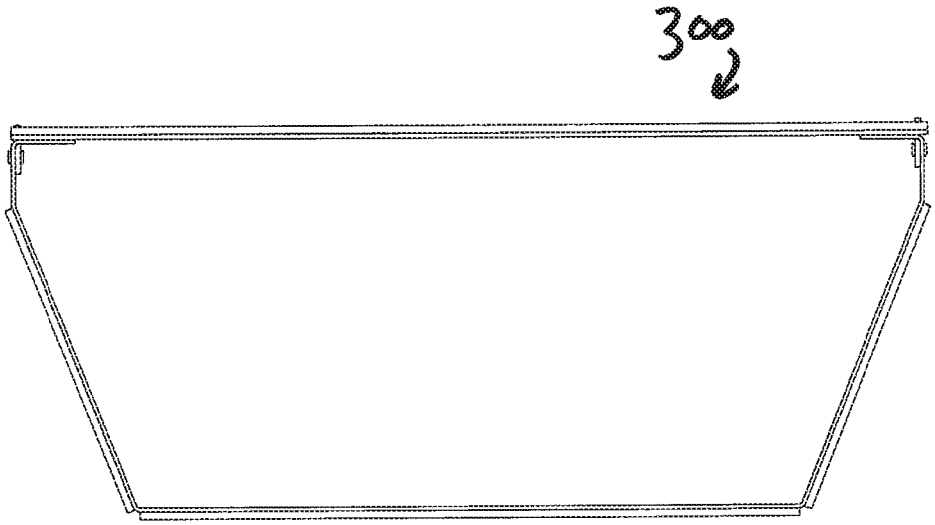
FIG. 33 is a top view thereof, the opposite side being a mirror image thereof.
Figure 34:
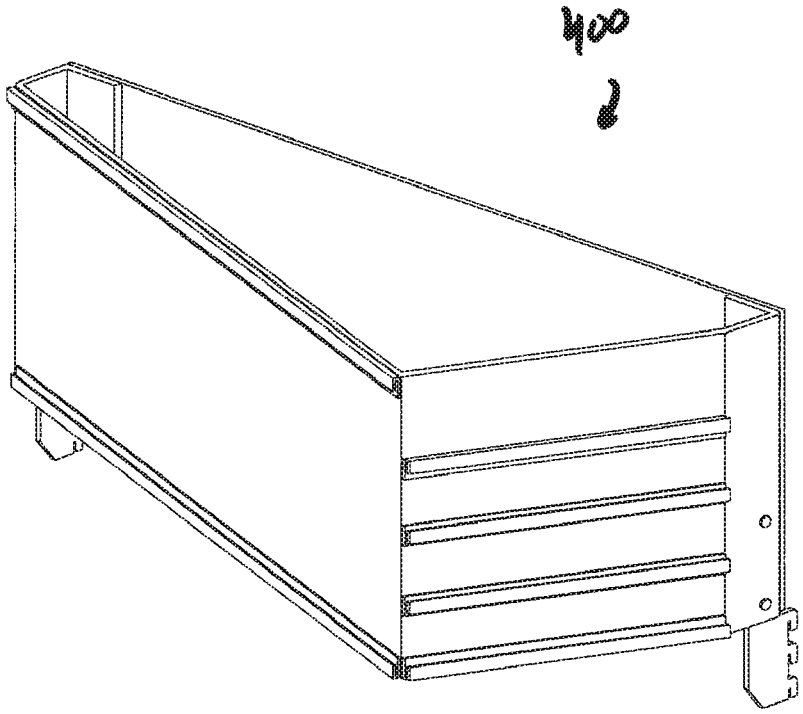
FIG. 34 is a perspective view of a signage system in accordance with the present teachings.
Figure 35:
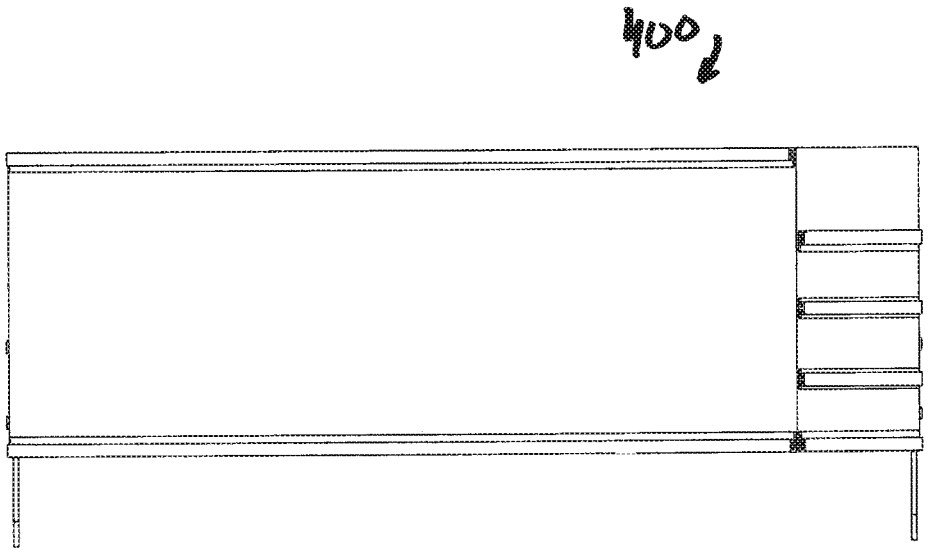
FIG. 35 is a front view thereof.
Figure 36:
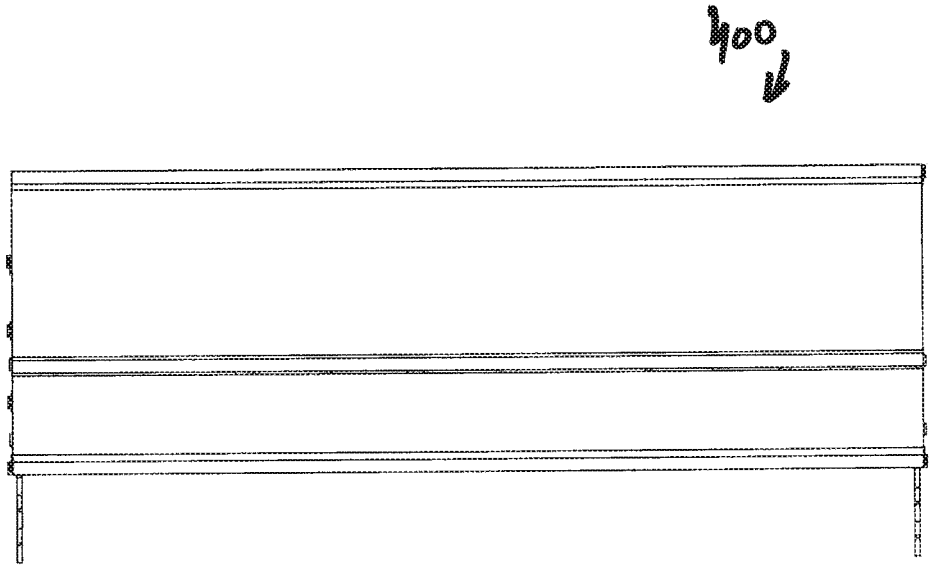
FIG. 36 is a rear view thereof.
Figure 37:
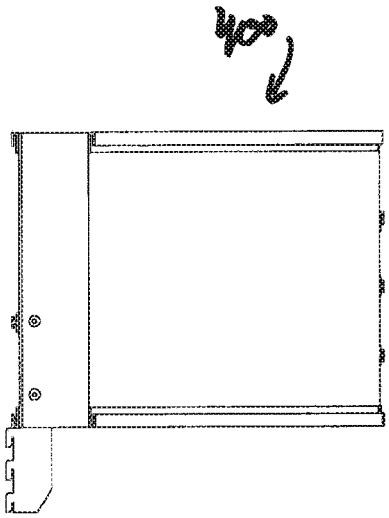
FIG. 37 is a left side view thereof.
Figure 38:
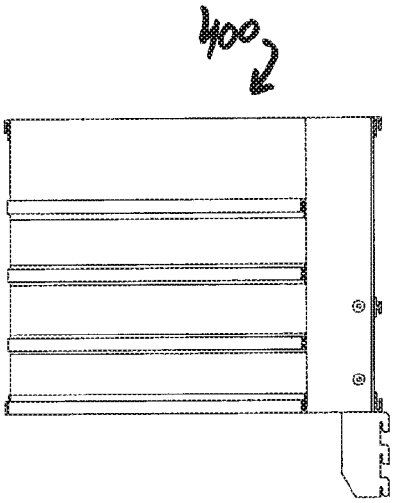
FIG. 38 is a right side view thereof.
Figure 39:
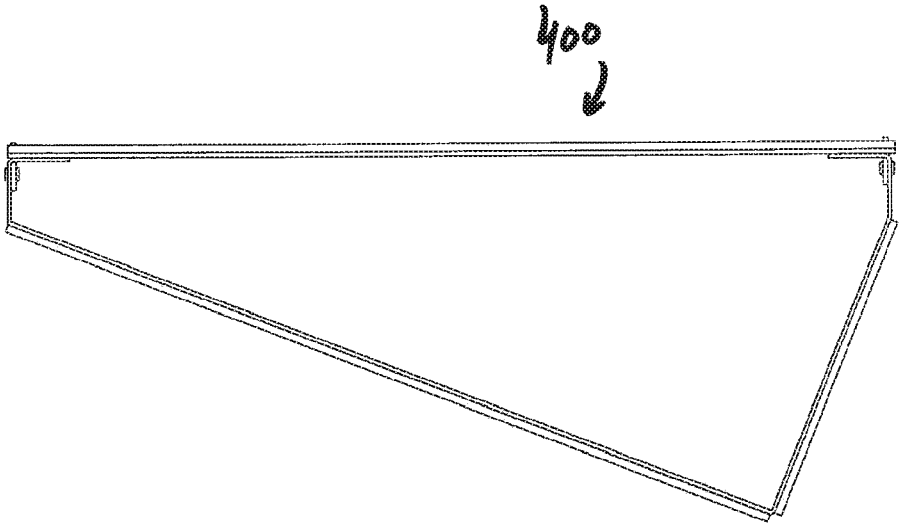
FIG. 39 is a top view thereof, the opposite side being a mirror image thereof.
Figure 40:
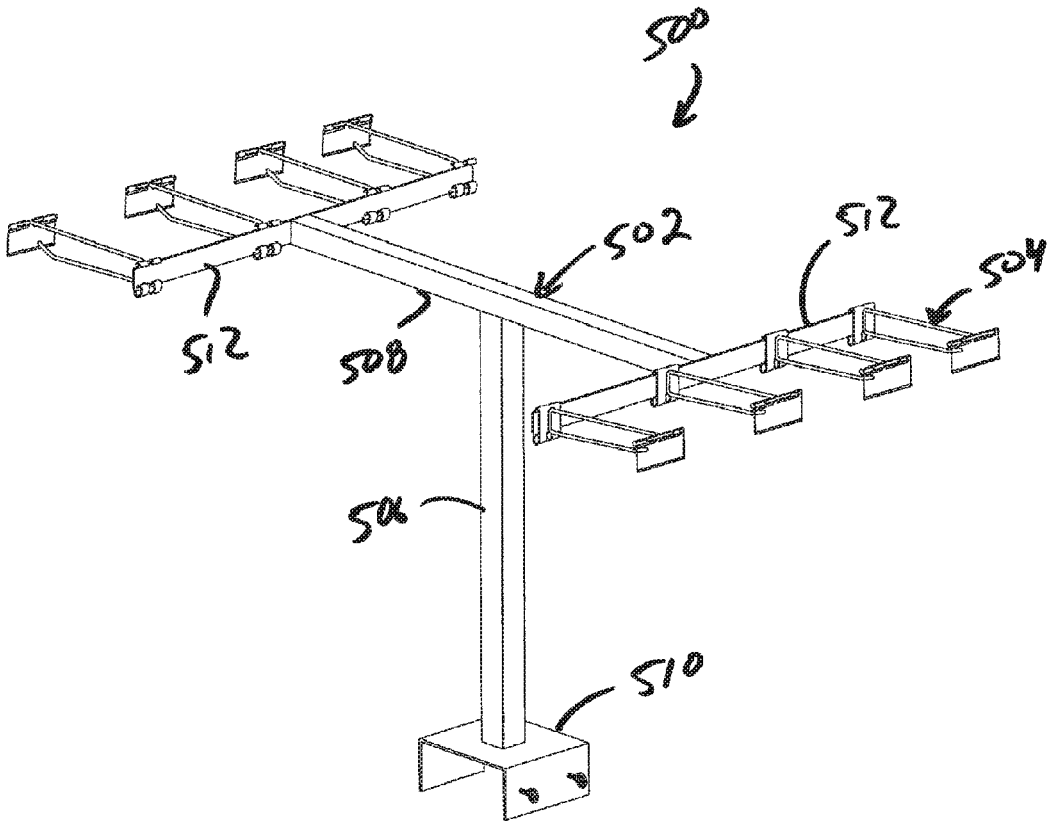
FIG. 40 is a perspective view of another merchandising display assembly in accordance with the present teachings.
Figure 41:
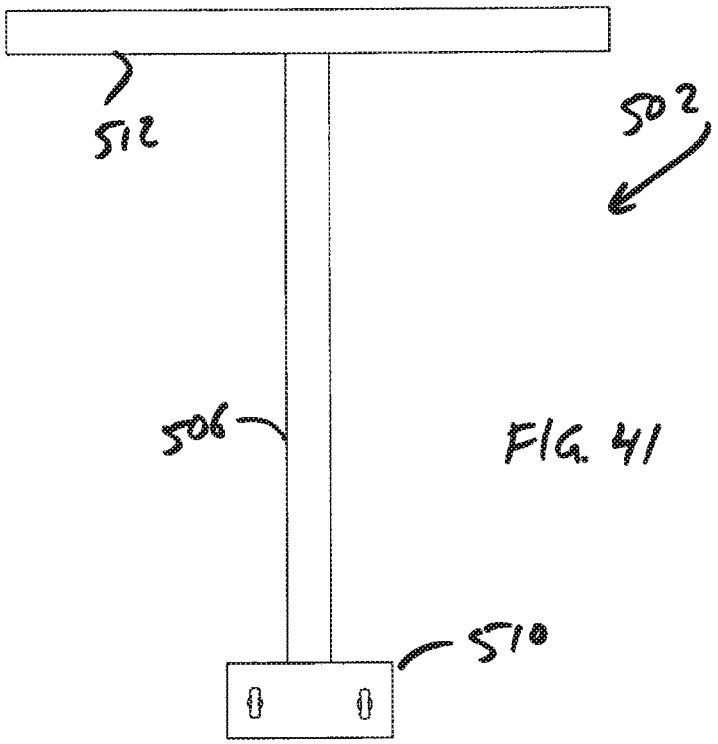
FIG. 41 is a left side view thereof, the merchandising display members removed for purposes of illustration.
Figure 42:
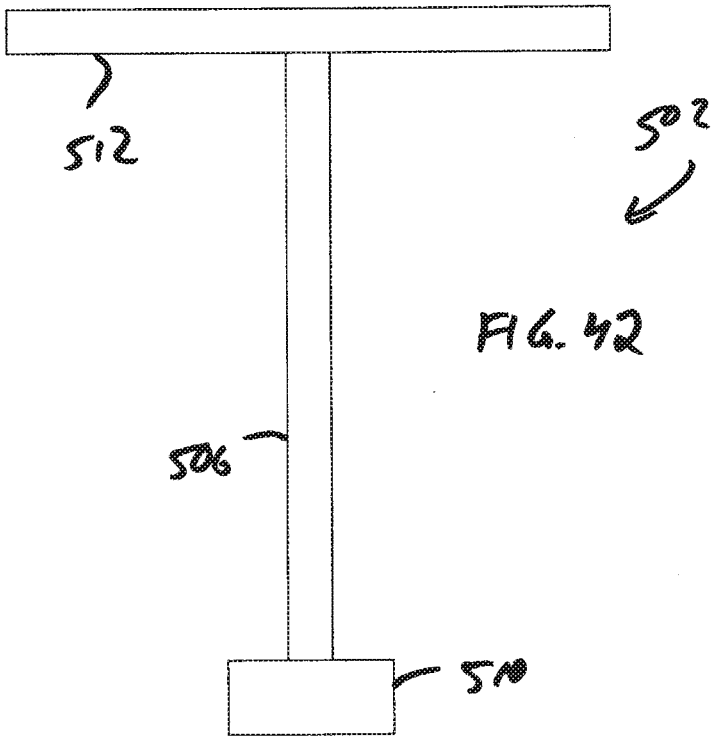
FIG. 42 is a right side view thereof.
Figure 43:
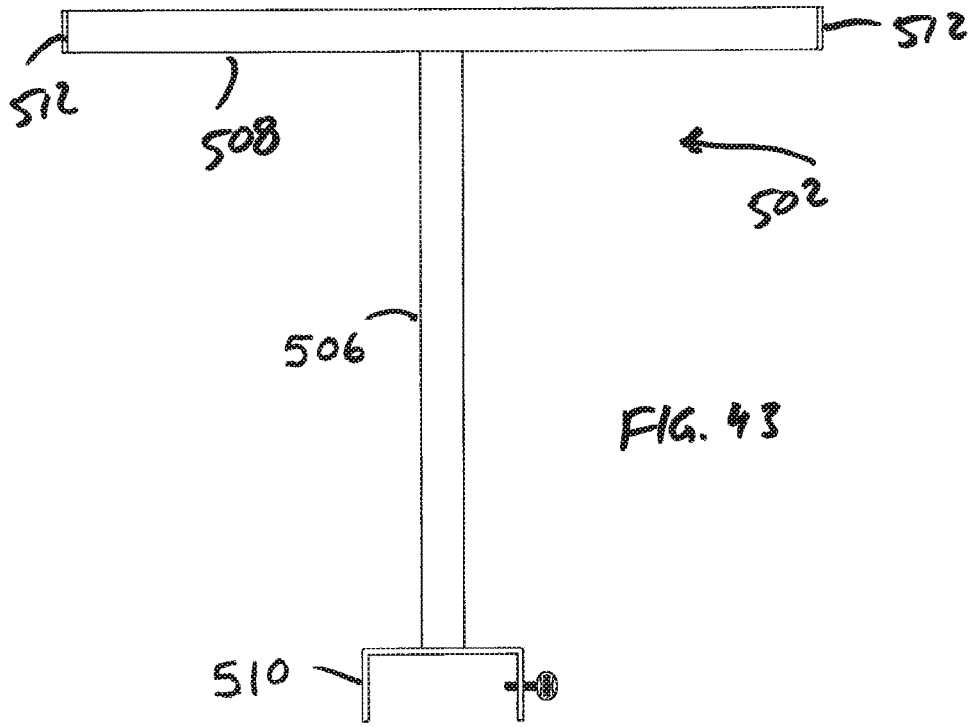
FIG. 43 is a front side view thereof.
Figure 44:
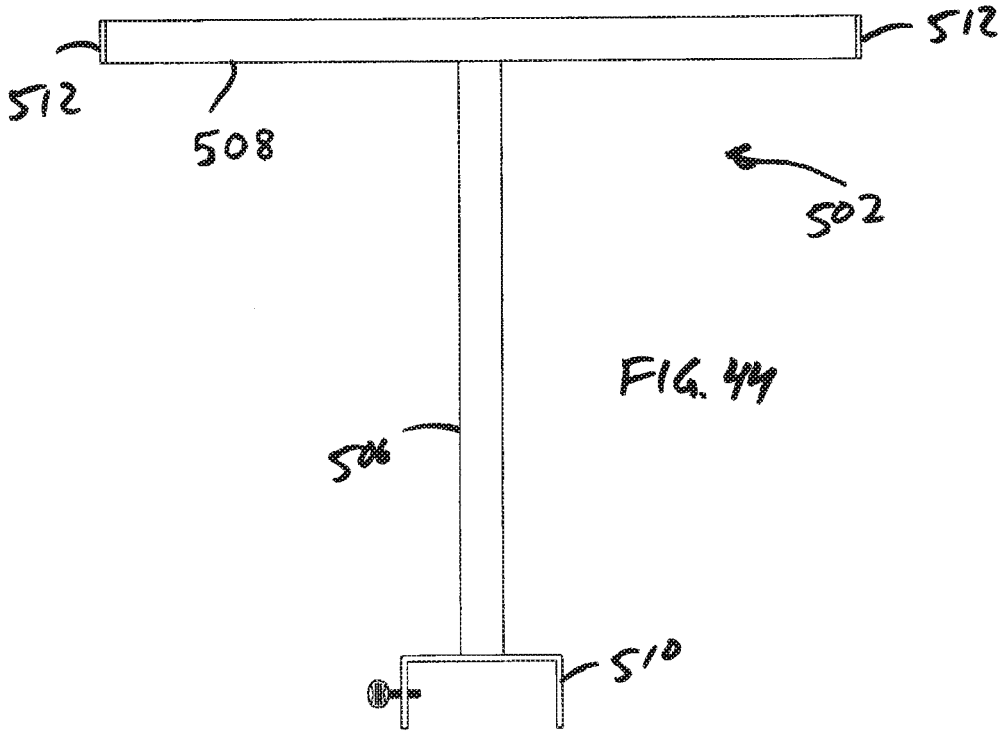
FIG. 44 is a rear view thereof.
Figure 45:
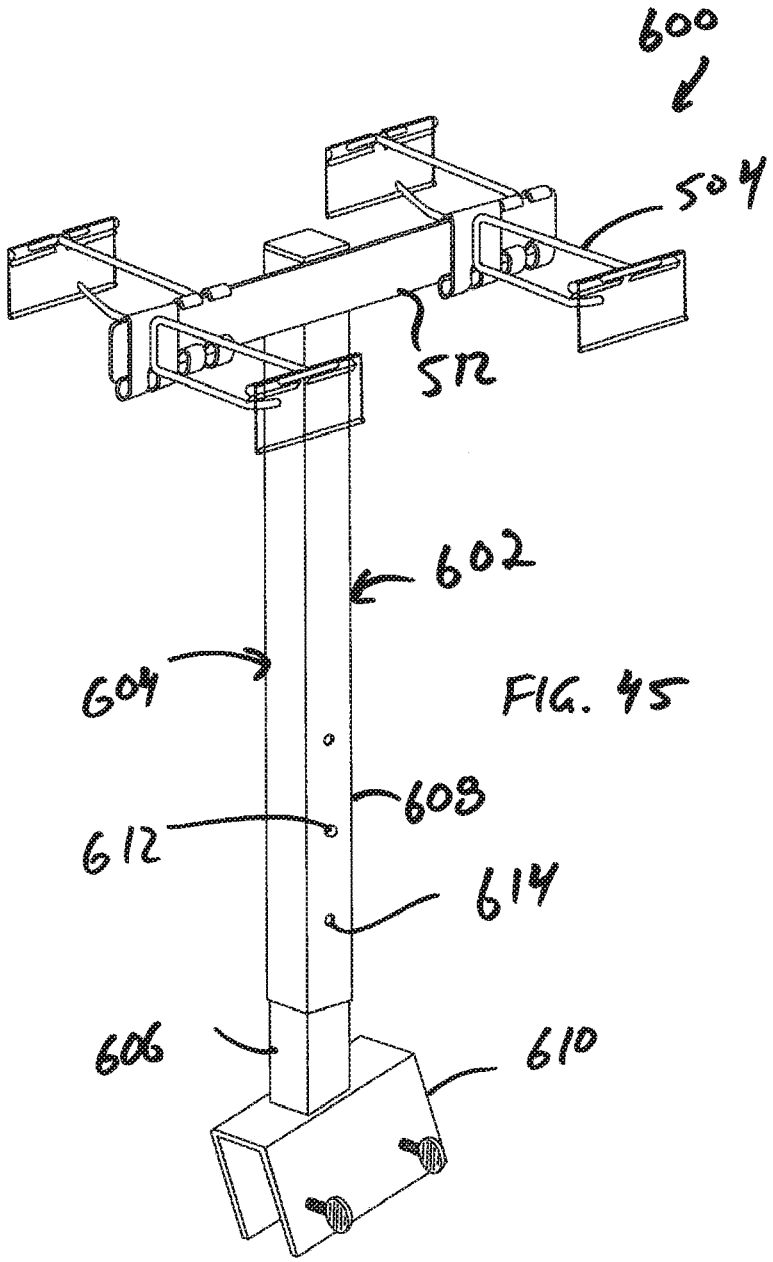
FIG. 45 is a perspective view of another merchandising display assembly in accordance with the present teachings.
Figure 46:
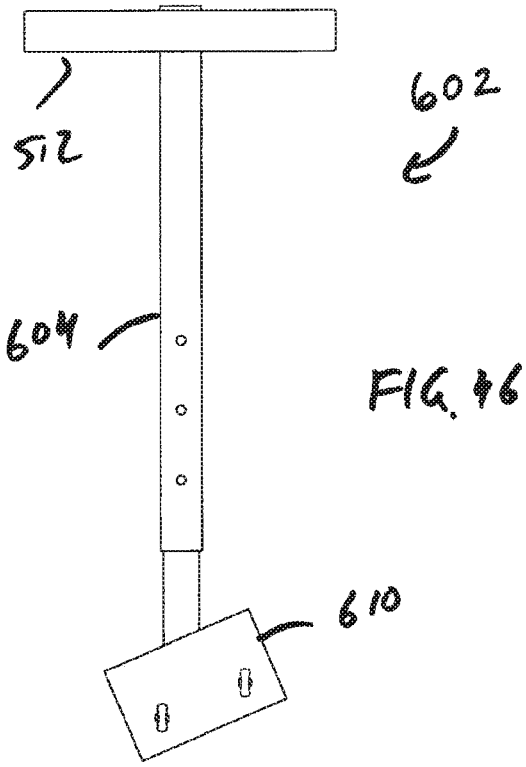
FIG. 46 is a left side view thereof, the merchandising display members removed for purposes of illustration.
Figure 47:
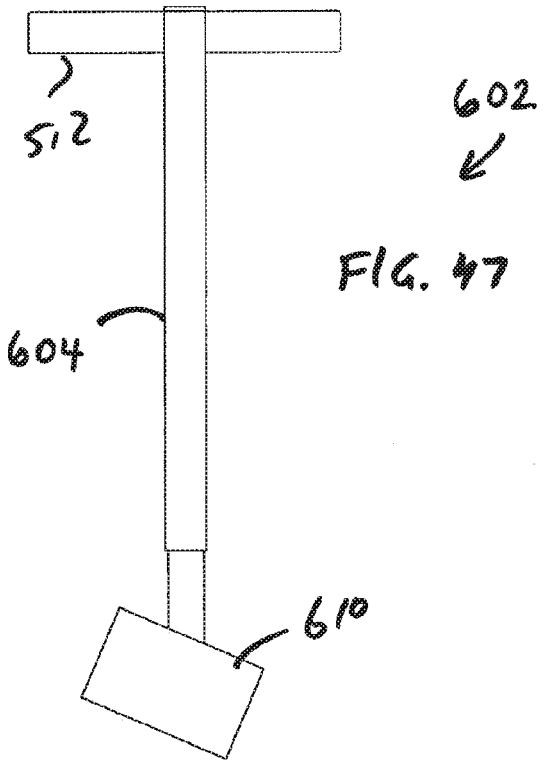
FIG. 47 is a right side view thereof.
Figure 48:
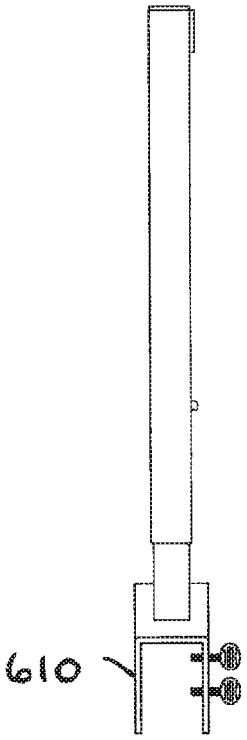
FIG. 48 is a front view thereof.
Figure 49:
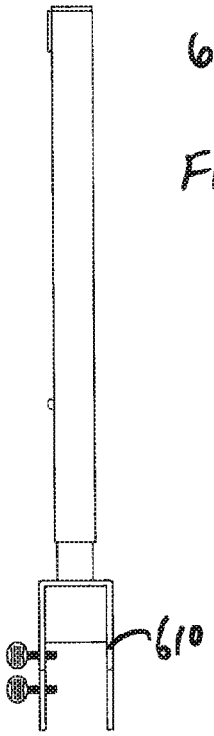
FIG. 49 is a rear view thereof.
Figure 50:
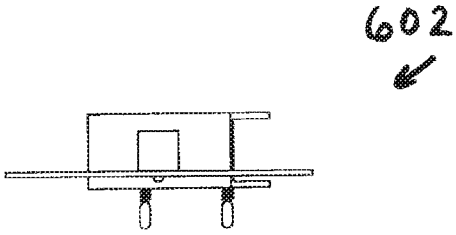
FIG. 50 is a top side view thereof, the bottom side normally not visible during use.
Figure 51:
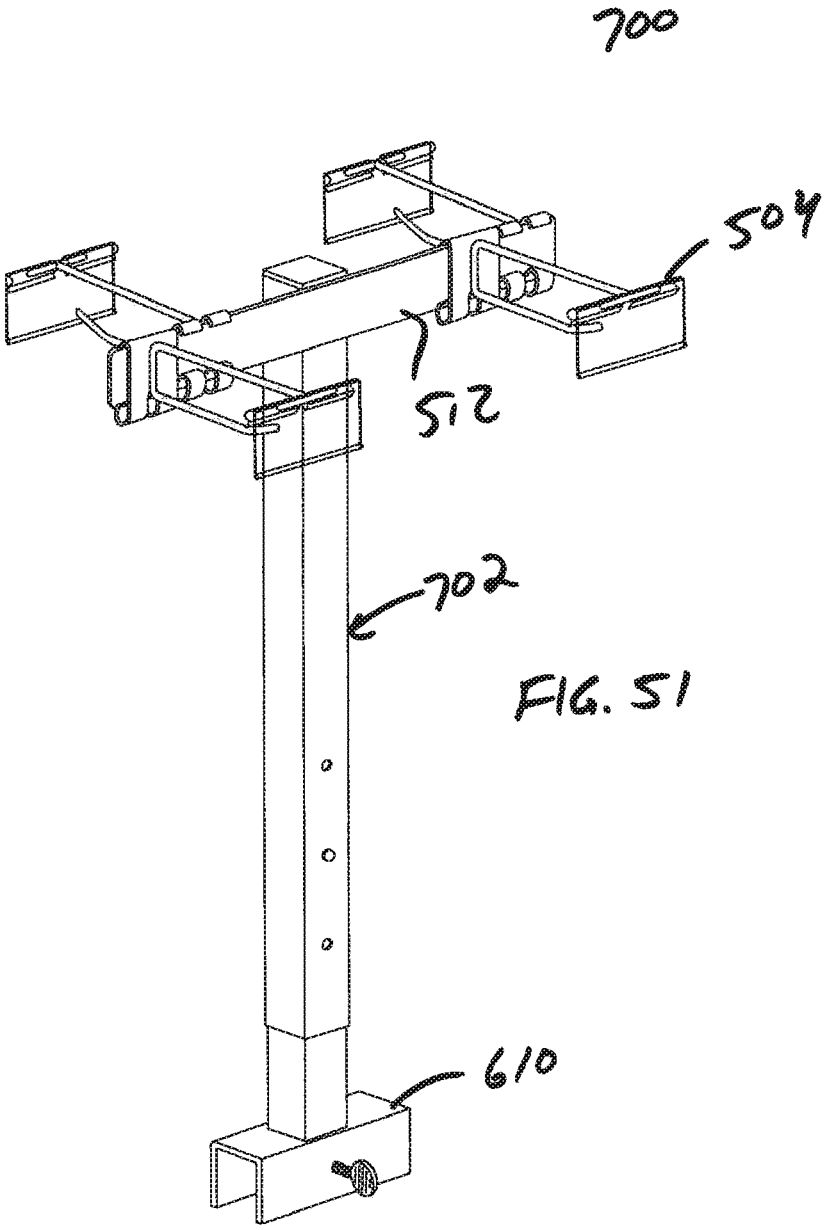
FIG. 51 is a perspective view of another merchandising display assembly in accordance with the present teachings.
Figure 52:
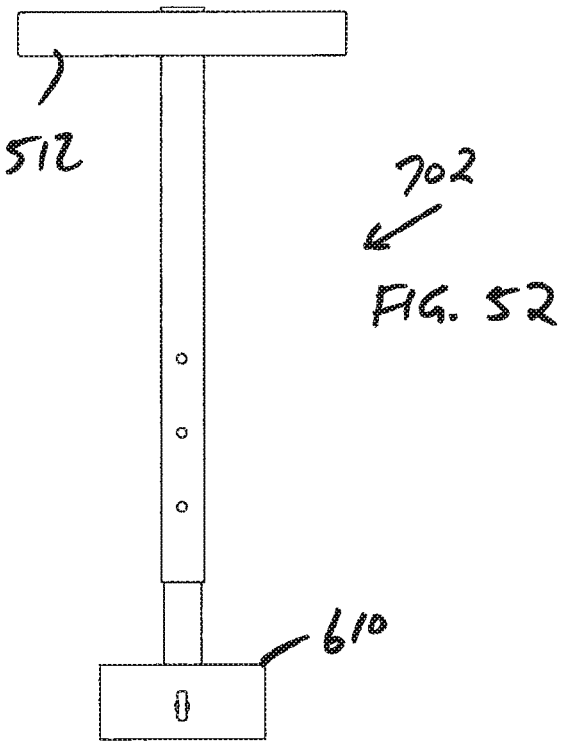
FIG. 52 is a left side view thereof, the merchandising display members removed for purposes of illustration.
Figure 53:
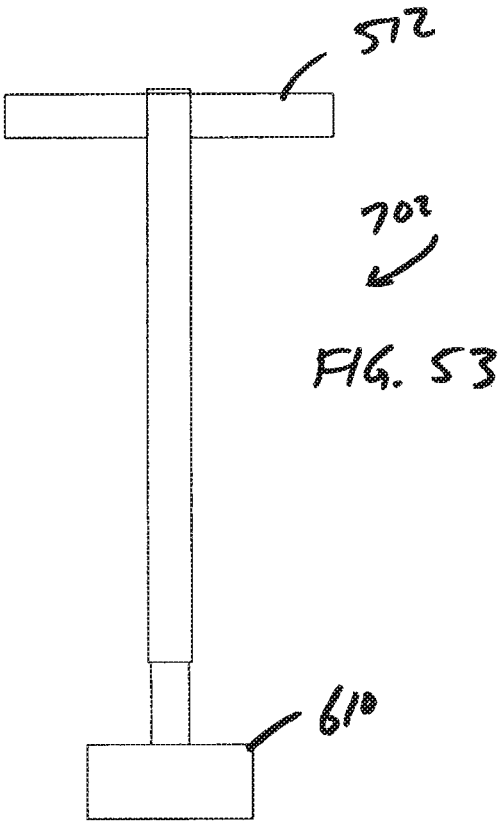
FIG. 53 is a right side view thereof.
Figure 54:
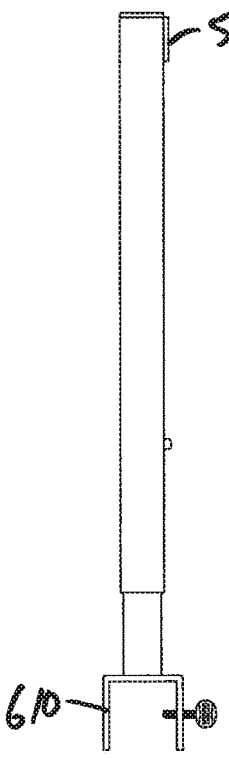
FIG. 54 is a front view thereof.
Figure 55:
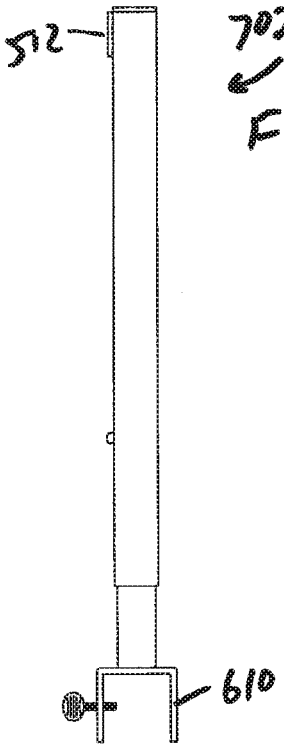
FIG. 55 is a rear view thereof.
Figure 56:
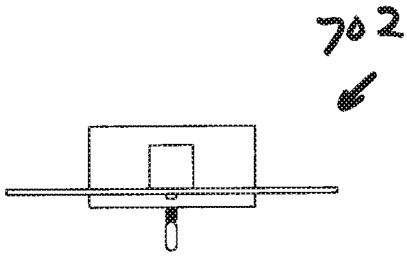
FIG. 56 is a top side view thereof, the bottom side normally not visible during use.
Figure 57:
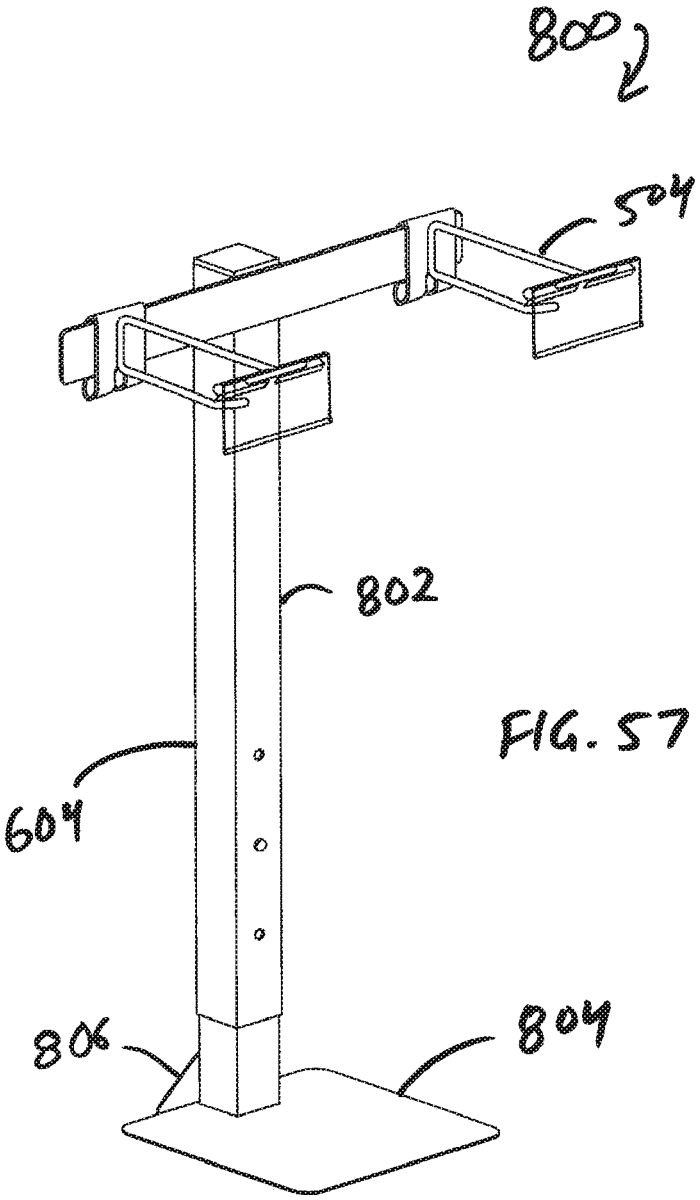
FIG. 57 is a perspective view of another merchandising display assembly in accordance with the present teachings.
Figure 58:
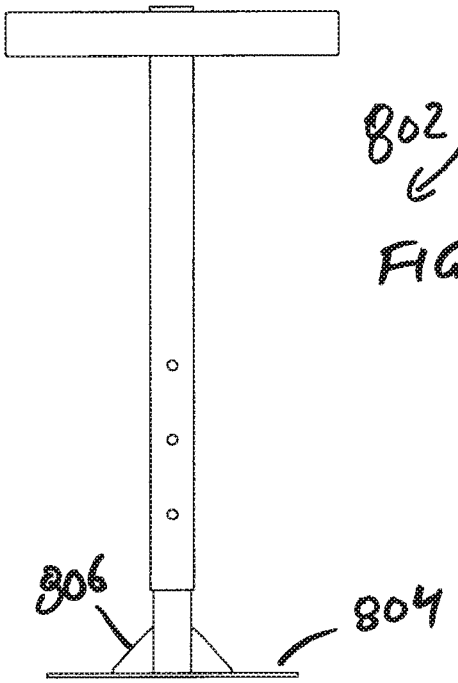
FIG. 58 is a left side view thereof, the merchandising display members removed for purposes of illustration.
Figure 59:
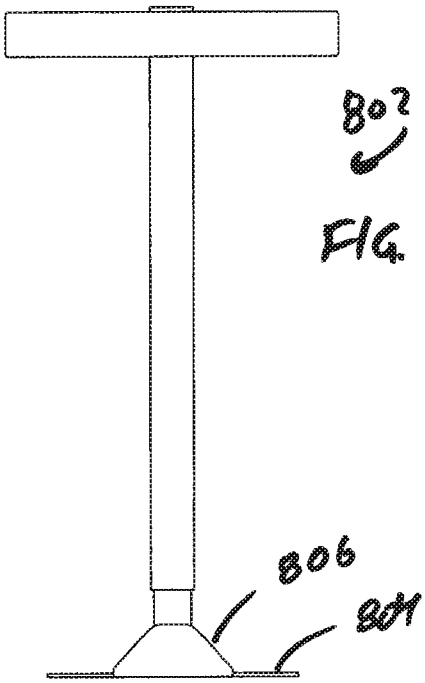
FIG. 59 is a right side view thereof.
Figure 60:
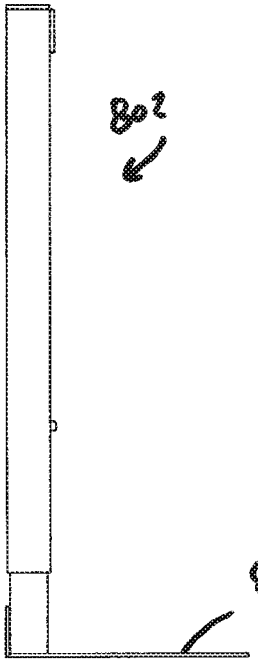
FIG. 60 is a front view thereof.
Figure 61:
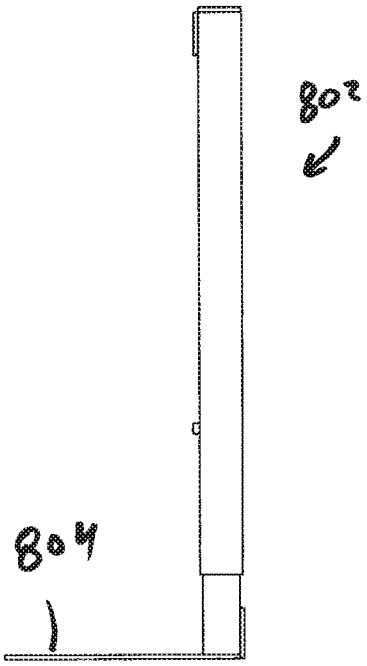
FIG. 61 is a rear view thereof.
Figure 62:
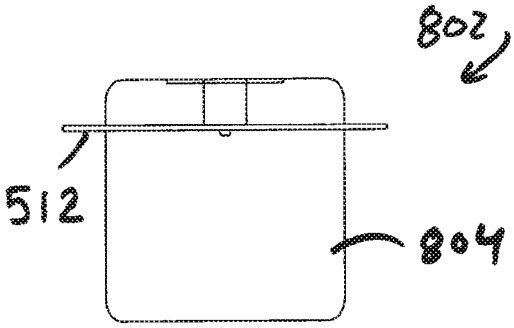
FIG. 62 is a top side view thereof, the bottom side normally not visible during use.
Figure 63:
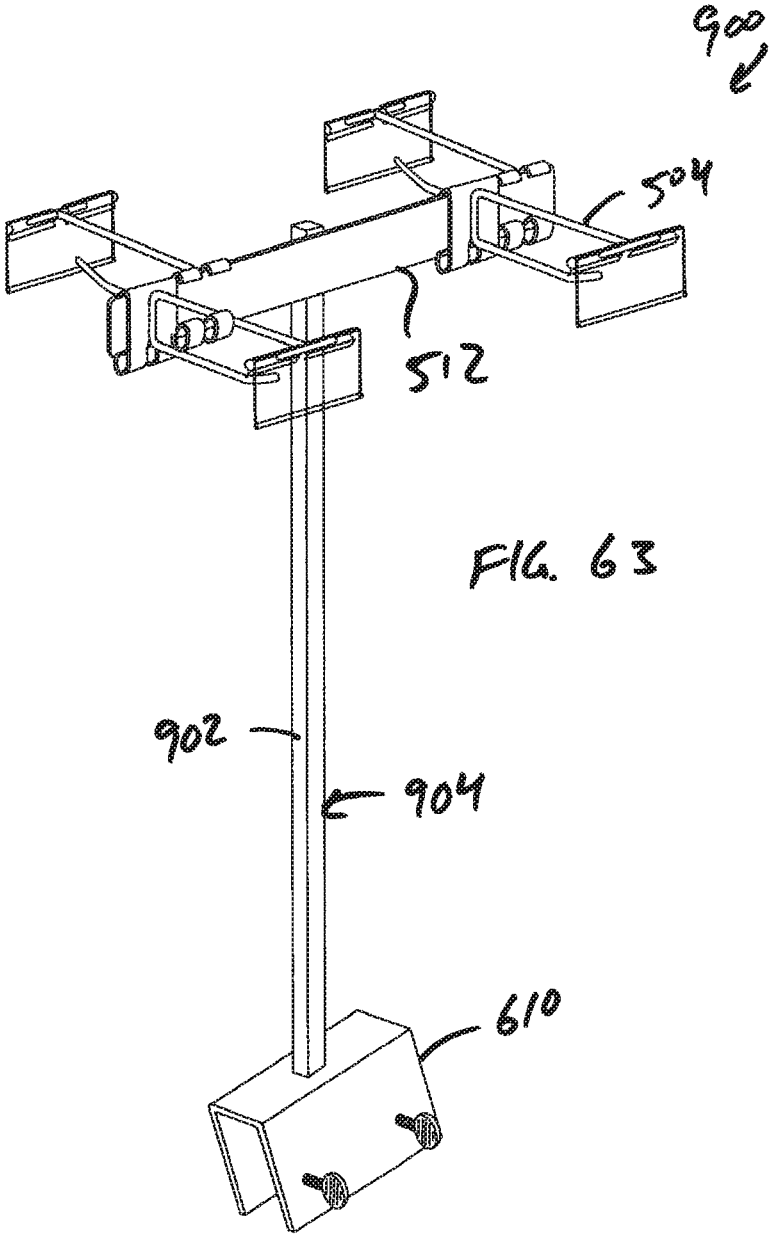
FIG. 63 is a perspective view of another merchandising display assembly in accordance with the present teachings.
Figure 64:
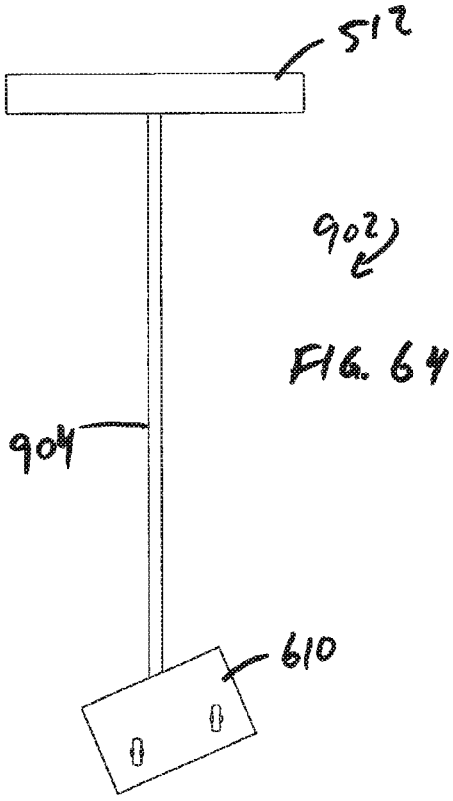
FIG. 64 is a left side view thereof, the merchandising display members removed for purposes of illustration.
Figure 65:
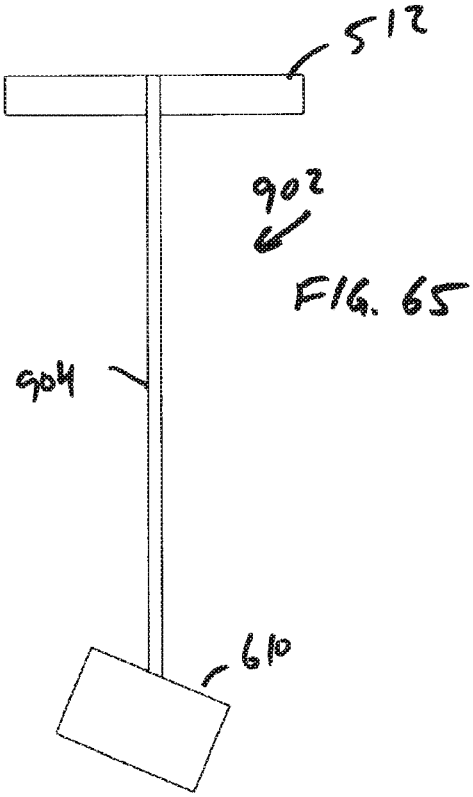
FIG. 65 is a right side view thereof.
Figure 66:
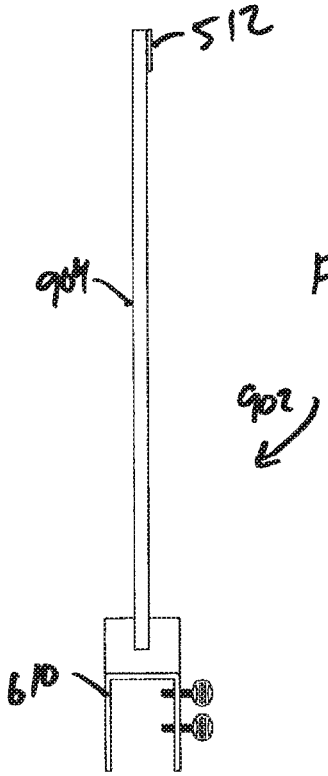
FIG. 66 is a front view thereof.
Figure 67:
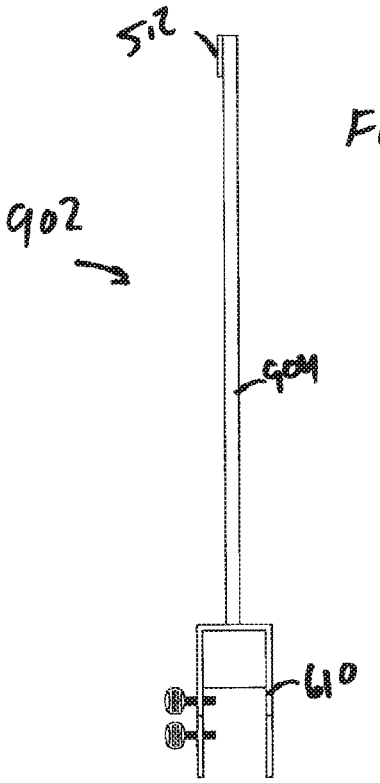
FIG. 67 is a rear view thereof.
Figure 68:
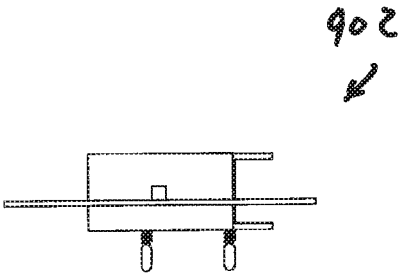
FIG. 68 is a top side view thereof, the bottom side normally not visible during use.
Figure 69:
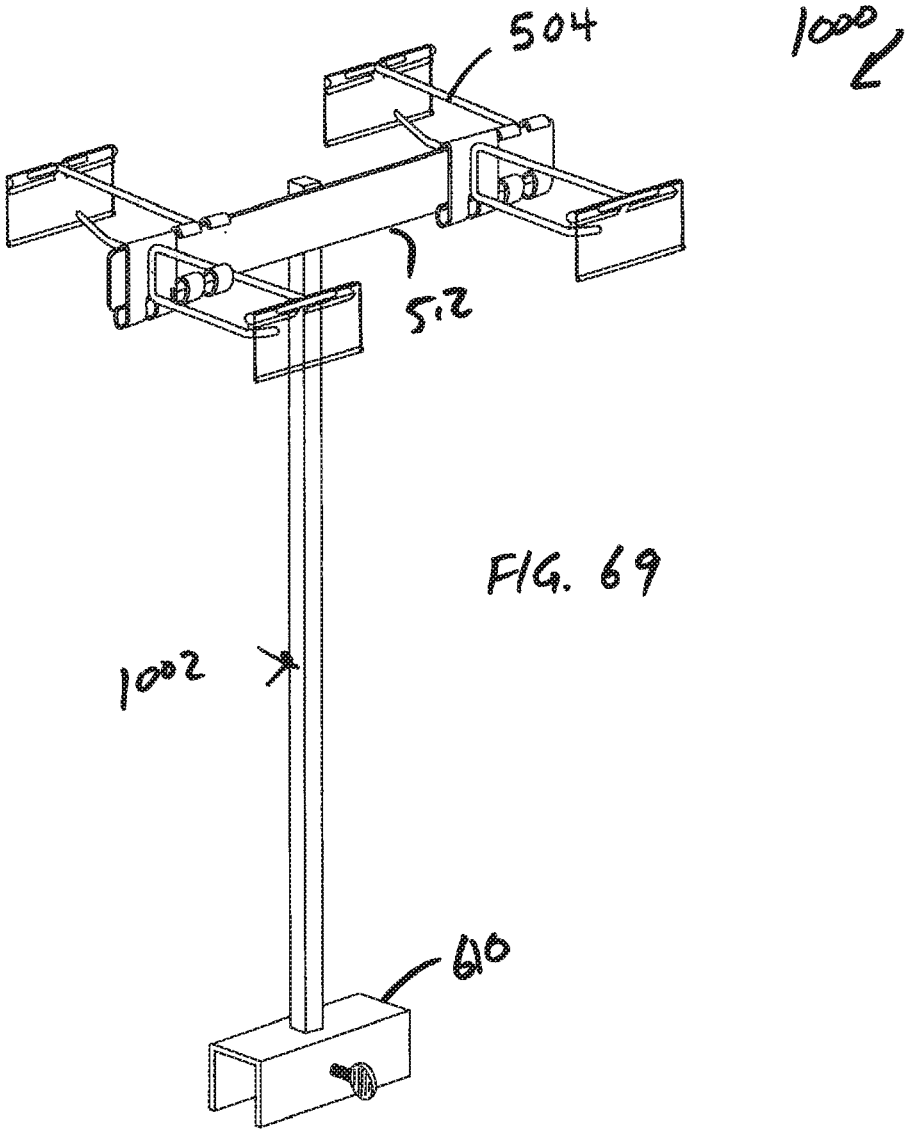
FIG. 69 is a perspective view of another merchandising display assembly in accordance with the present teachings.
Figure 70:
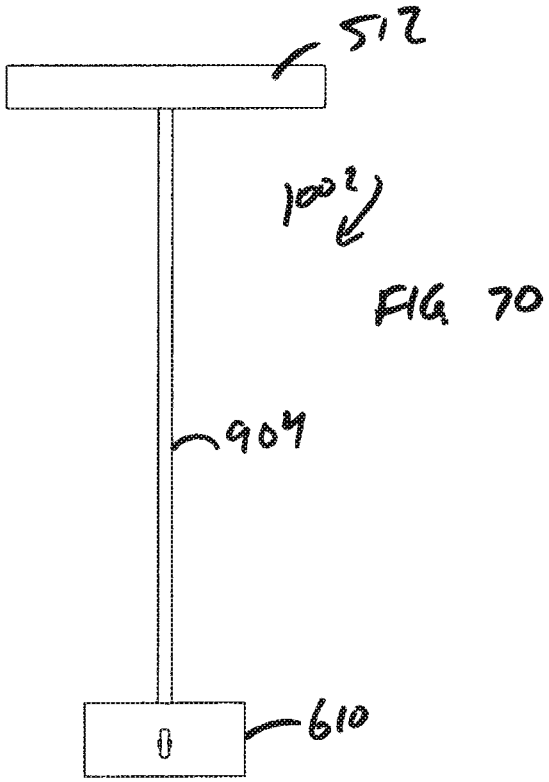
FIG. 70 is a left side view thereof, the merchandising display members removed for purposes of illustration.
Figure 71:
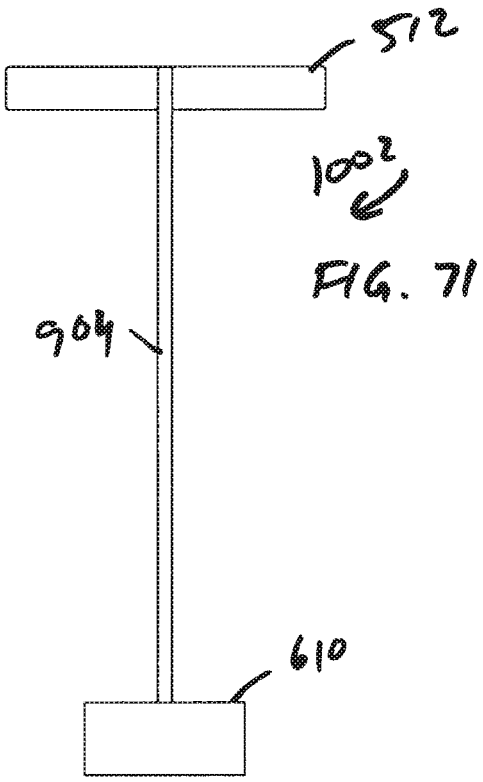
FIG. 71 is a right side view thereof.
Figure 72:
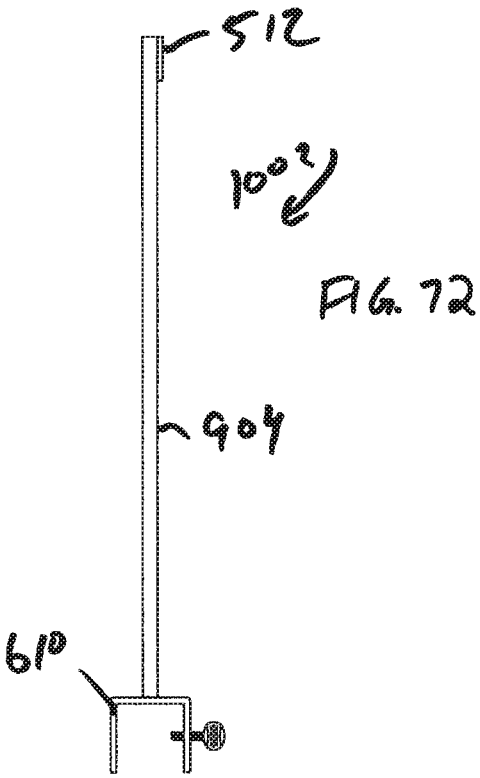
FIG. 72 is a front view thereof.
Figure 73:
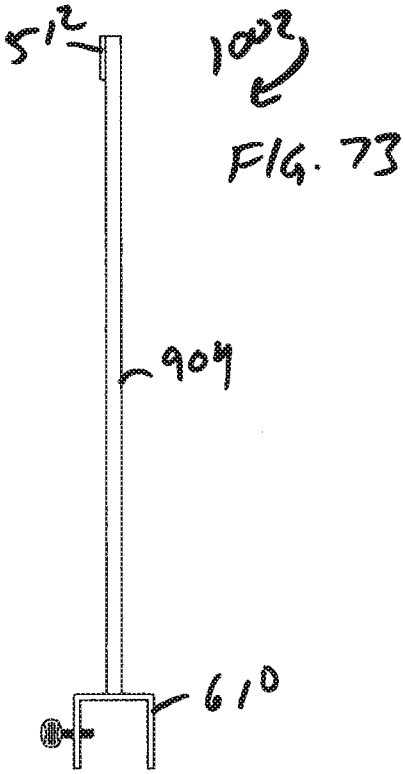
FIG. 73 is a rear view thereof.
Figure 74:
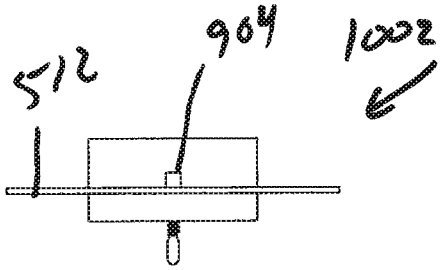
FIG. 74 is a top side view thereof, the bottom side normally not visible during use.
Figure 75:
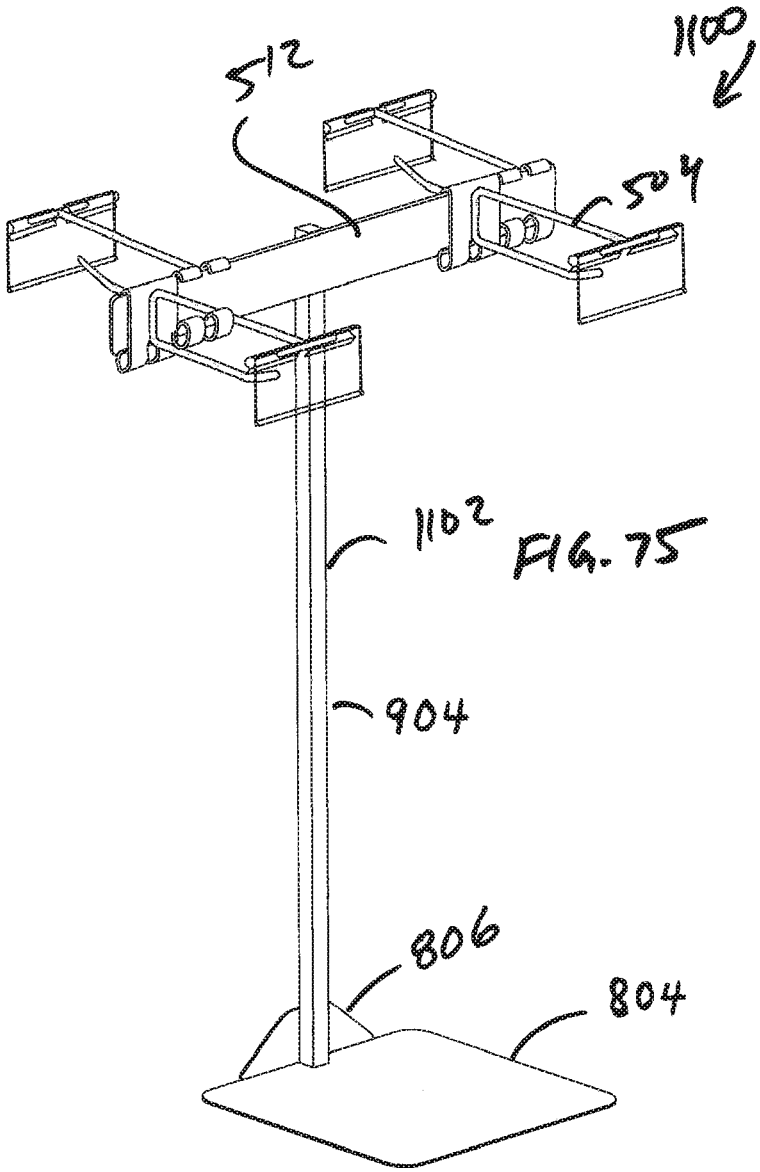
FIG. 75 is a perspective view of another merchandising display assembly in accordance with the present teachings.
Figure 76:
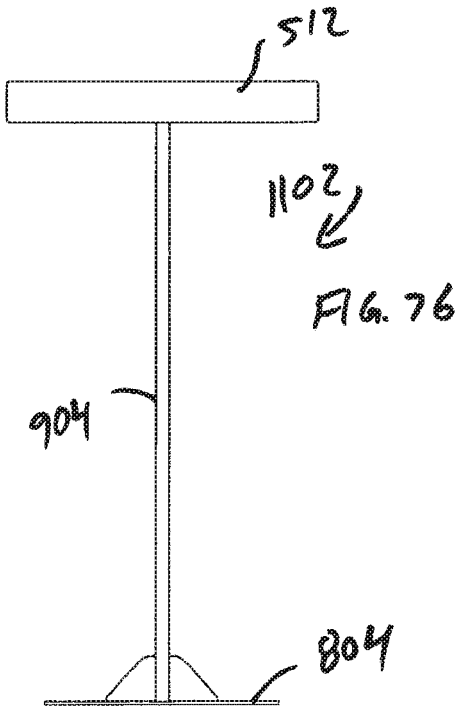
FIG. 76 is a left side view thereof, the merchandising display members removed for purposes of illustration.
Figure 77:
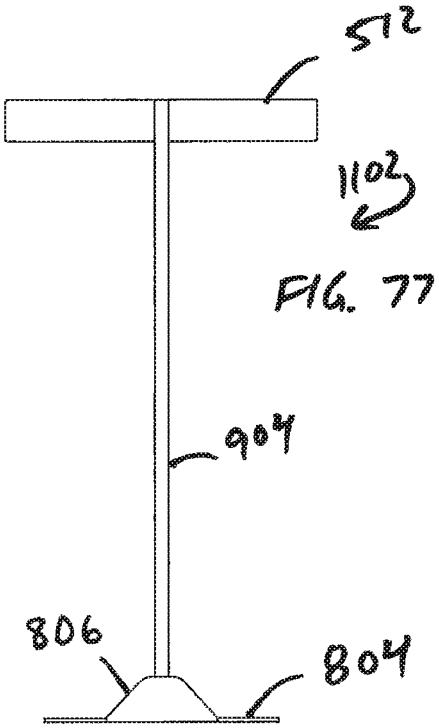
FIG. 77 is a right side view thereof.
Figure 78:
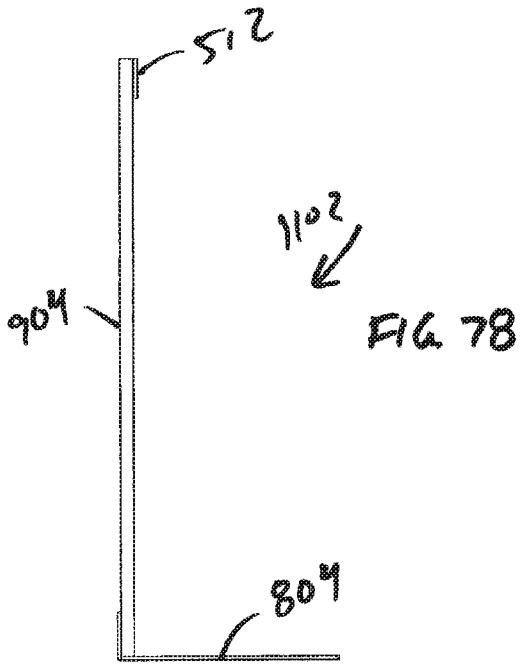
FIG. 78 is a front view thereof.
Figure 79:
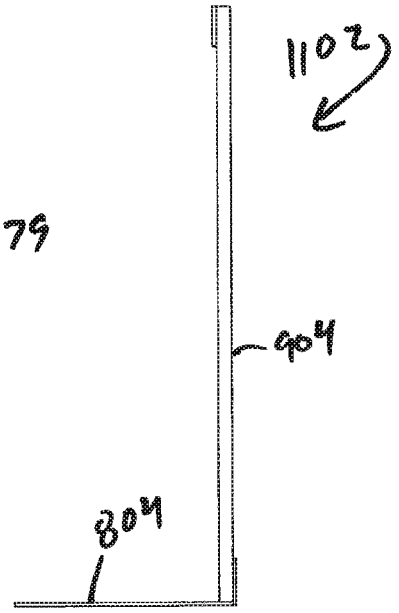
FIG. 79 is a rear view thereof.
Figure 80:
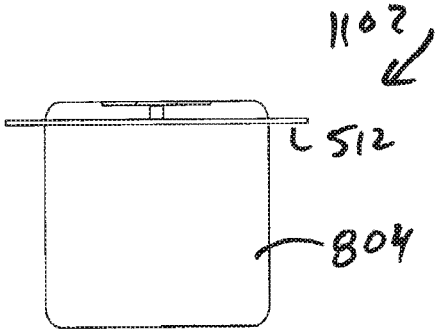
FIG. 80 is a top side view thereof, the bottom side normally not visible during use.
Figure 81:
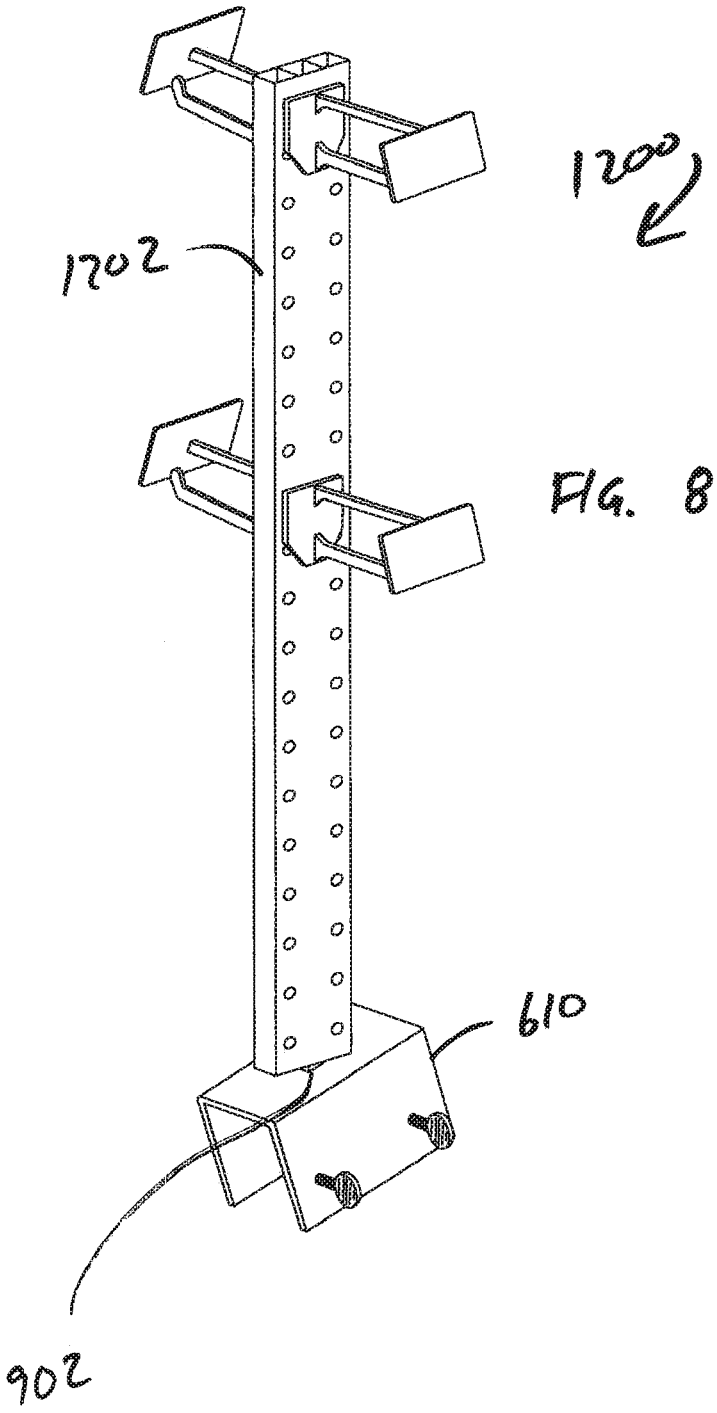
FIG. 81 is a perspective view of another merchandising display assembly in accordance with the present teachings.

With reference to FIG. 81, another merchandising support assembly constructed in accordance with the present teachings is illustrated and generally identified at reference character 1200. Given the similarities between the merchandising support assembly 1200 and the prior described merchandising support assemblies, like reference characters have been used to identify similar elements throughout the drawings. In this embodiment, the merchandising support assembly 1200 is generally illustrated to include a support structure and a plurality of merchandising support members. It will be understood that the merchandising support members are conventional in construction insofar as the present teachings are concerned.

The support structure may include a vertically extending arm 902 identical to that shown in connection with the merchandising display assembly 900. At a lower distal end thereof, the vertically extending arm may be welded or securely fastened to a mounting bracket 610.

The merchandising support assembly 1200 is further illustrated to include a display strip 1202. The display strip may be constructed of plastic or other suitable material and may be generally rectangular in shape. The display strip 1202 may be generally hollow and define one or more channels longitudinally extending therethrough. In the embodiment illustrated, the display strip 1202 may define three channels. A central one of the channels may receive the vertically extending arm 904. Opposite sides of the display strip 1202 may be formed to include a plurality of apertures for receiving the merchandising support members in a conventional manner.

Figure 82:
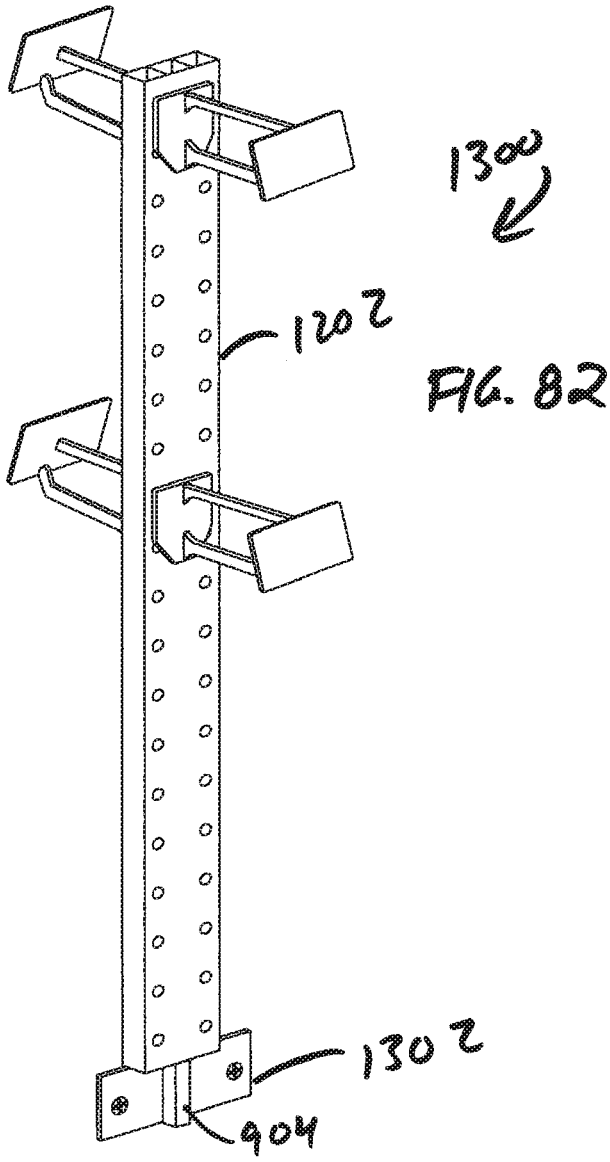
FIG. 82 is a perspective view of another merchandising display assembly in accordance with the present teachings.

With reference to FIG. 82, another merchandising support assembly constructed in accordance with the present teachings is illustrated and generally identified at reference character 1300. Given the similarities between the merchandising support assembly 1300 and the prior described merchandising support assemblies, like reference characters have been used to identify similar elements throughout the drawings. The merchandising support assembly 1300 includes alternative mounting structure.

Figure 83:
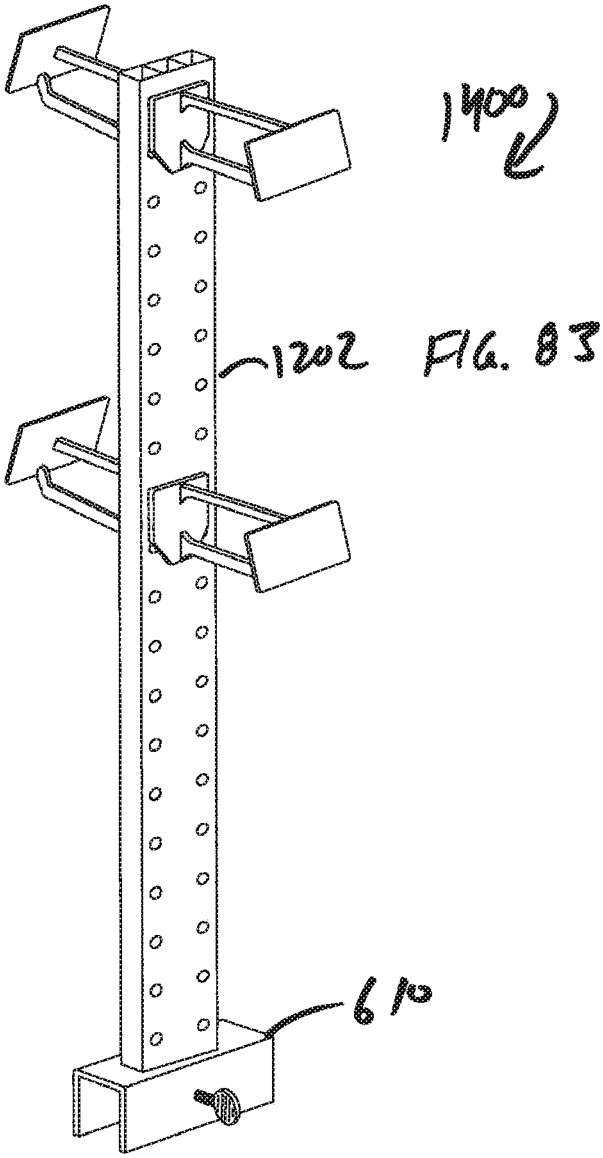
FIG. 83 is a perspective view of another merchandising display assembly in accordance with the present teachings.

With reference to FIG. 83, another merchandising support assembly constructed in accordance with the present teachings is illustrated and generally identified at reference character 1400. Given the similarities between the merchandising support assembly 1400 and the prior described merchandising support assemblies, like reference characters have been used to identify similar elements throughout the drawings. The merchandising support assembly 1400 differs from the merchandising support assembly 1200 in that it incorporates mounting member 610 of the merchandising support assembly 700.

Figure 84:
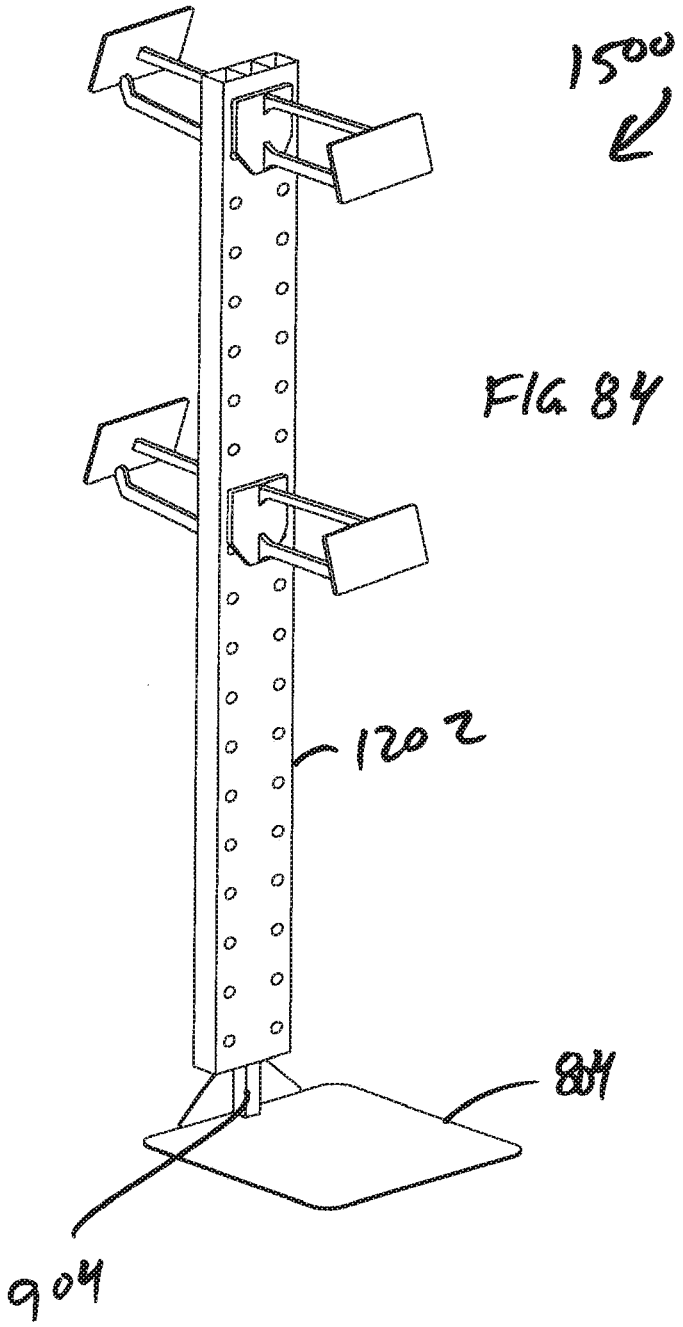
FIG. 84 is a perspective view of another merchandising display assembly in accordance with the present teachings.
Figure 85:
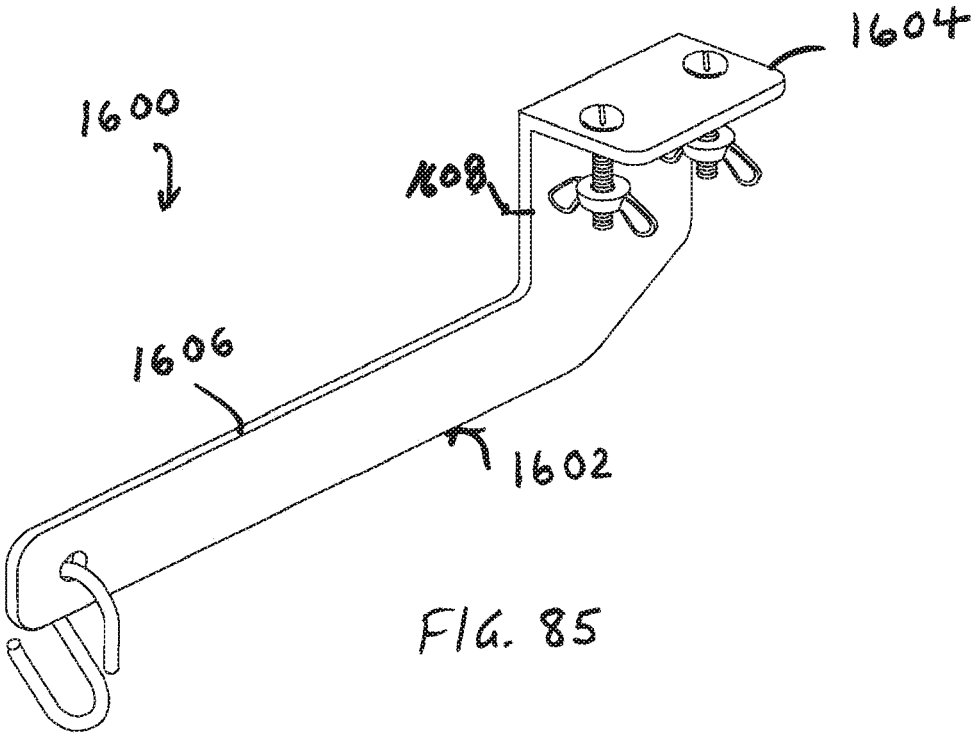
FIG. 85 is a perspective view of a merchandising display bracket in accordance with the present teachings.
Figure 92:
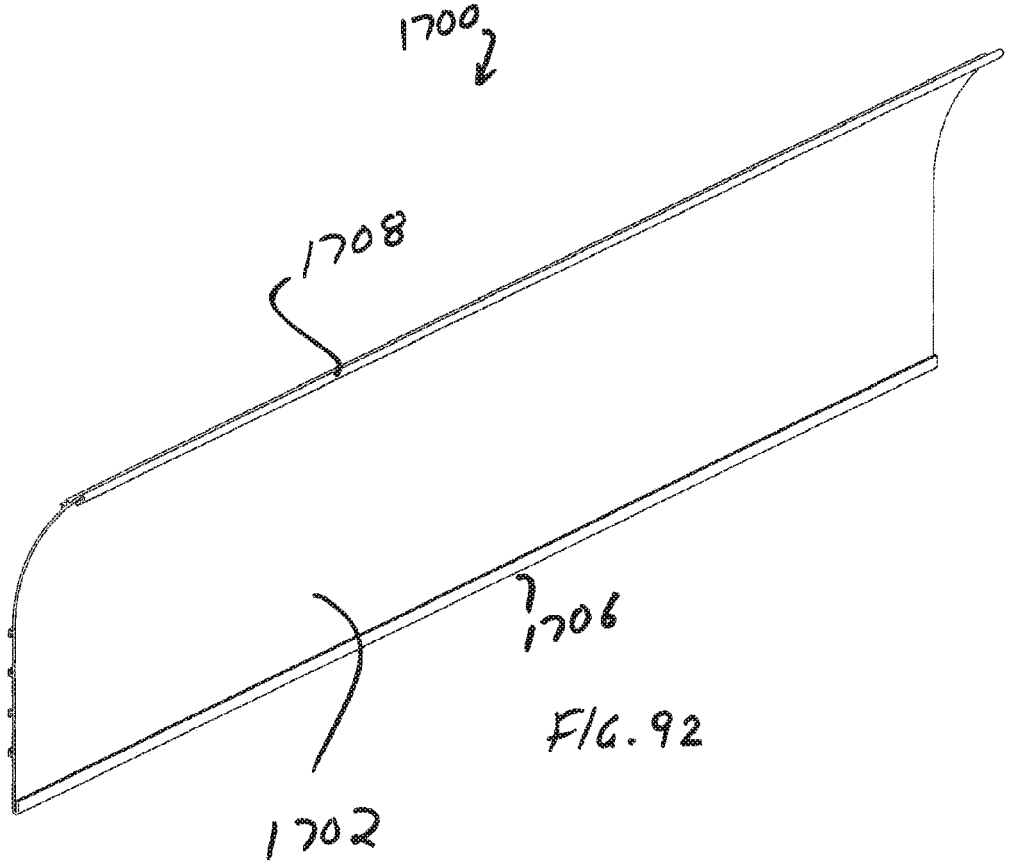
FIG. 92 is a perspective view of a sign holder for a merchandising display system in accordance with the present teachings.
Figure 93:
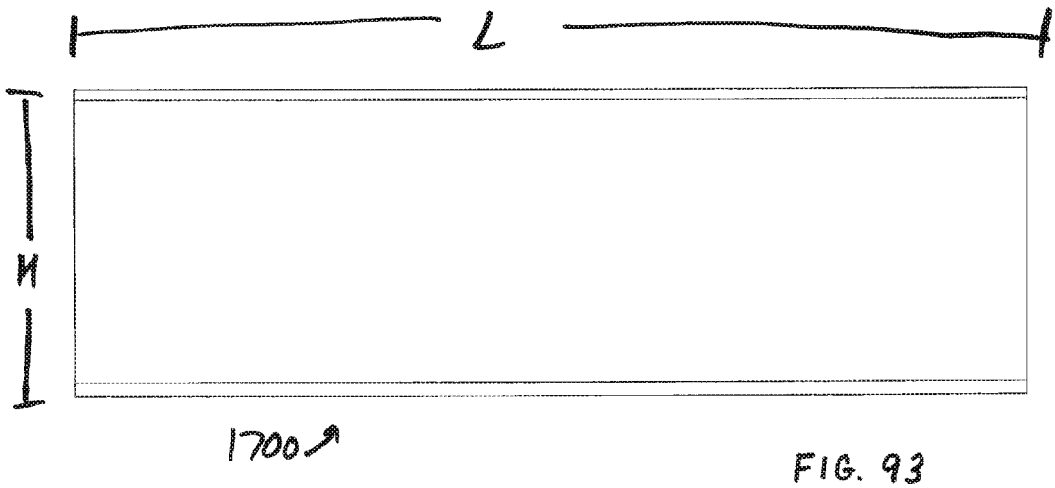
FIG. 93 is a front side view thereof, the product hooks being removed for purposes of illustration.
Figure 94:
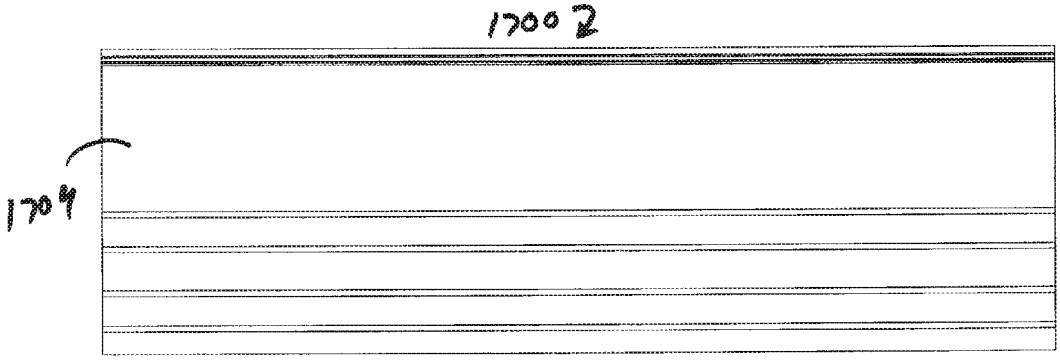
FIG. 94 is a rear side view thereof.
Figure 95:
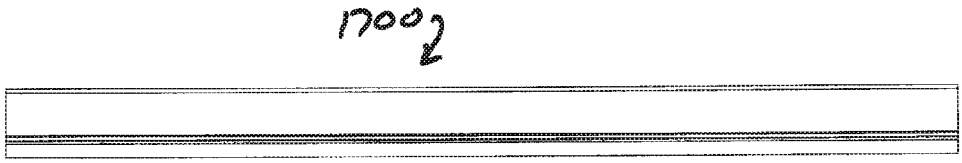
FIG. 95 is a top view thereof.
Figure 96:
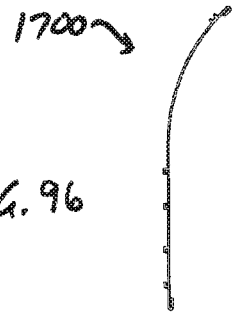
FIG. 96 is a left side view thereof.
Figure 97:
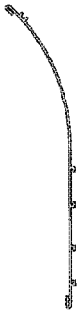
FIG. 97 is a right side view thereof.

With reference to FIG. 84, another merchandising support assembly constructed in accordance with the present teachings is illustrated and generally identified at reference character 1500. Given the similarities between the merchandising support assembly 1500 and the prior described merchandising support assemblies, like reference characters have been used to identify similar elements throughout the drawings. The merchandising support assembly 1400 differs from the merchandising support assembly 1200 in that it incorporates mounting plate 804 of the merchandising support assembly 800.

Turning now to FIGS. 85 through 91, a merchandising display bracket in accordance with the present teachings is illustrated and generally identified at reference character 1600. The merchandising display bracket 1600 is shown operatively associated with mounting hardware and a hook structure for suspending signage or product for retail display.

The merchandising display bracket 1600 is illustrated to generally include a main portion 1602 and a mounting portion 1604. The main portion 1602 is generally planar and configured in a generally L-shape having a first arm and a second arm 1606 and 1608. The first arm 1606 extends in a generally horizontal direction and proximate a free and thereof defines an aperture for receiving the hook structure. The second arm 1608 upwardly extends from the first arm 1606 in a generally vertical direction.

The mounting portion 1604 is also generally planar. In the embodiment illustrated, mounting portion 64 is oriented in a plane generally perpendicular to the main portion 1602. The mounting portion 1604 particularly configures the merchandising display bracket 1600 for under-shelf attachment.

Turning now to FIGS. 92 through 97, a sign holder for a merchandising display system in accordance with the present teachings is illustrated and generally identified at reference character 1700. The sign holder 1700 may be materially formed of a plastic material by extrusion. The sign holder 1700 is generally illustrated to include a height H, a length L, a front side 1702, a rear side 1704, a bottom edge 1706 and an upper edge 1708. The front side 1702 may be concavely curved and the rear side 1704 may be convexly curved.

The front side 1702 may be formed to define a channel for receiving a sign. The rear side 1704 may be formed to include one or more channels for mounting of the sign holder 1700 or for attachment of the sign holder 1700 to another similarly constructed sign holder.

Figure 98:
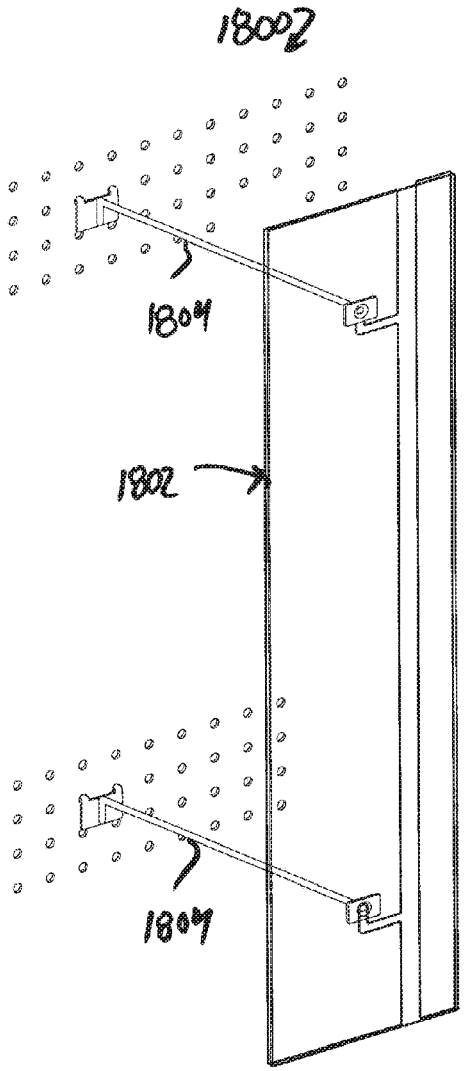
FIG. 98 is a perspective view of a merchandising display system including a sign holder in accordance with the present teachings.

Turning now to FIG. 98, a merchandising display system 1800 including a sign holder 1802 in accordance with the present teachings is illustrated. The system 1800 further illustrates a pair of mounting arms 1804 for attachment of the sign holder 1700 to a pegboard wall.

Figure 99:
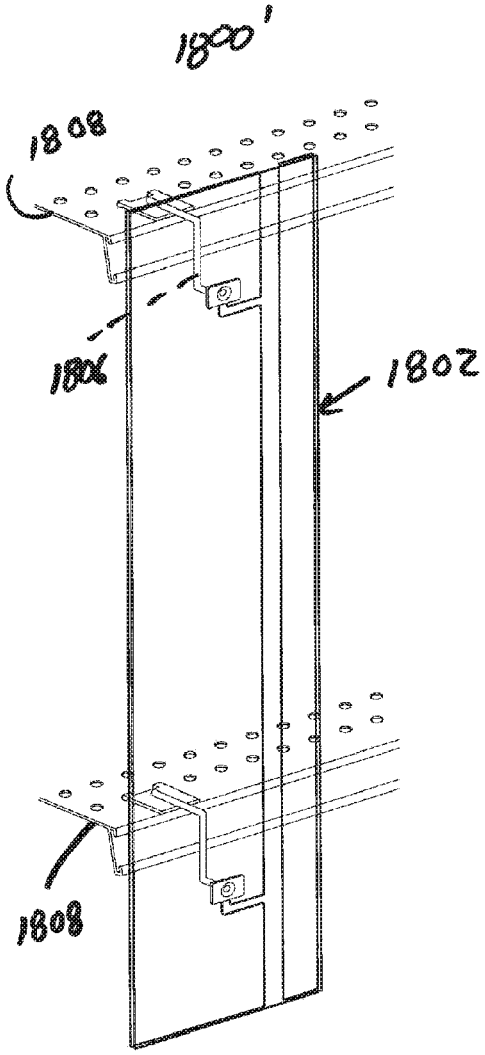
FIG. 99 is a perspective view of another merchandising display system including a sign holder in accordance with the present teachings.
Figure 100:
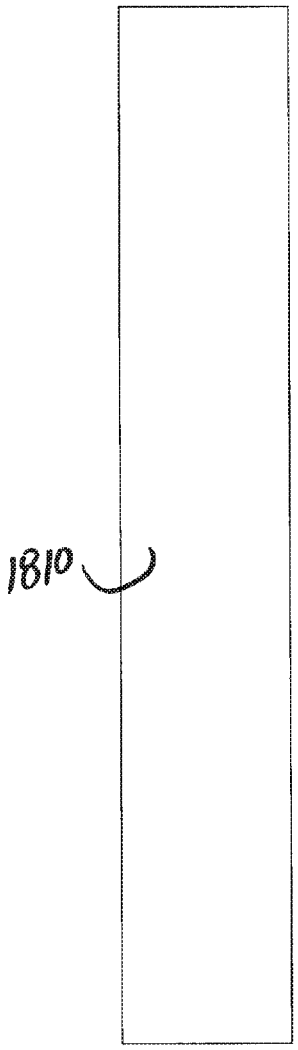
FIG. 100 is a front side view thereof of the sign holder of FIG. 99.
Figure 102:
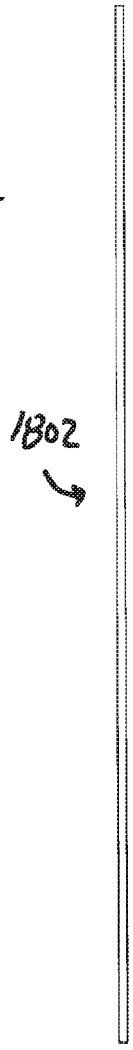
FIG. 102 is a left side view thereof, the opposite side to that shown being a mirror image thereof.
Figure 101:
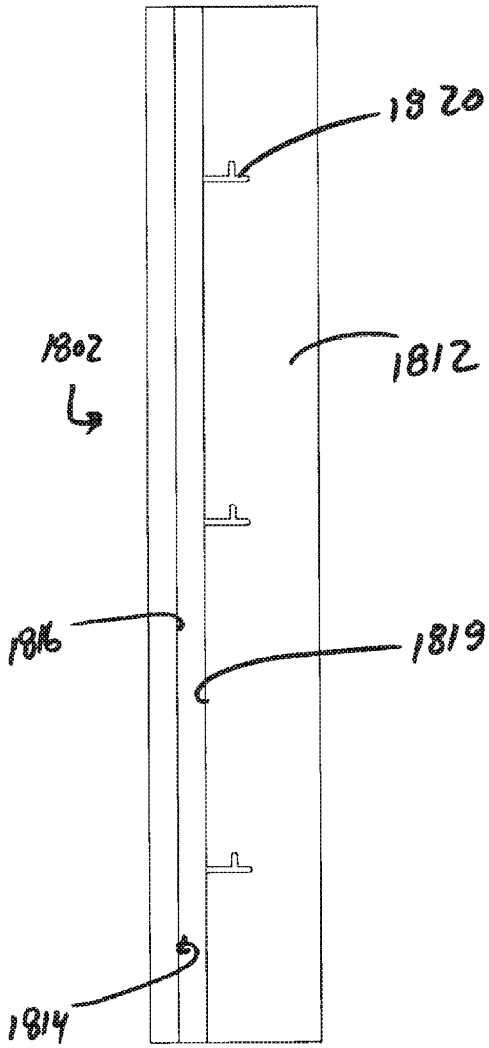
FIG. 101 is a rear side view thereof.
Figure 103:
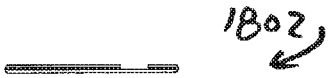
FIG. 103 is a top view thereof, the opposite side to that shown being a mirror image thereof.

Turning now to FIG. 99, another merchandising display system in accordance with the present teachings is illustrated and generally identified at reference character 1800'. It will be understood that the sign holder 1802 of FIGS. 98 and 99 is identical. The merchandising display system 1800' includes alternative mounting arms 1806 for attachment of merchandising display system 1800' to one or more shelves 1808. In the embodiment illustrated, merchandising display system 1800' is attached to a pair of shelves 1808.

With reference now to 100 through 103, the sign holder 1802 of the merchandising display systems 1800 and 1800' will be described. As illustrated, the sign holder 1802 may be materially constructed of an acrylic material and thereby clear. The sign holder includes a front side 1810 and the rear side 1812. At the rear side 1812, a longitudinally extending gap 1814 defined between first and second edges 1816 and 1818. A plurality of generally T-shaped slots 1820 are defined at the rear side 1812. A first arm of each slot 1820 communicates with the gap 1814. The mounting arms 1804 may be received within the slots 1820. A generally planar plate carried at a distal end of each arm 1804 is received within a space between the front side 1810 and rear side 1812 of the sign holder 1802. A sign (not shown) may be located between the front and rear sides 1810 and 1812 and be visible through the front side 1810.

Figure 104:
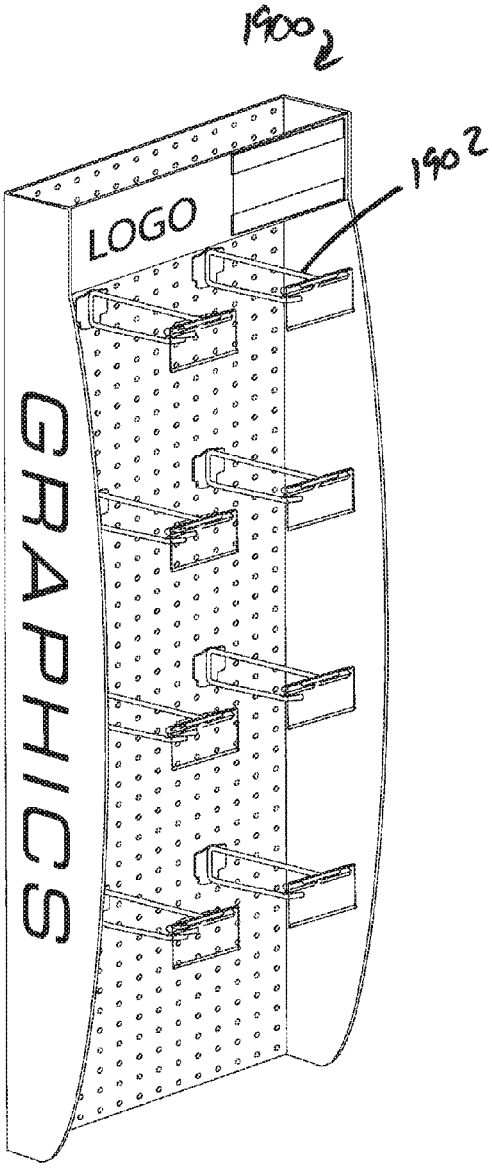
FIG. 104 is a perspective view of another merchandising display in accordance with the present teachings.

With reference now to FIGS. 104 through 109, another merchandising display system in accordance with the present teachings is illustrated and generally identified at reference character 1900. FIG. 104 illustrates the merchandising display system 1900 operatively associated with a plurality of product hooks or product display members 1902. FIGS. 105 through 109 illustrate the merchandising display system 1900 with the product hooks removed for purposes of illustration.

The merchandising display system 1900 is generally illustrated to include a back panel provided with a plurality of apertures arranged in rows and columns for conventional mounting of the product display members 1902. The merchandising display system 1900 further includes a pair of sides that may carry graphics or advertising. An upper portion of the merchandising display system 1900 may be generally rectangular.

Figure 110:
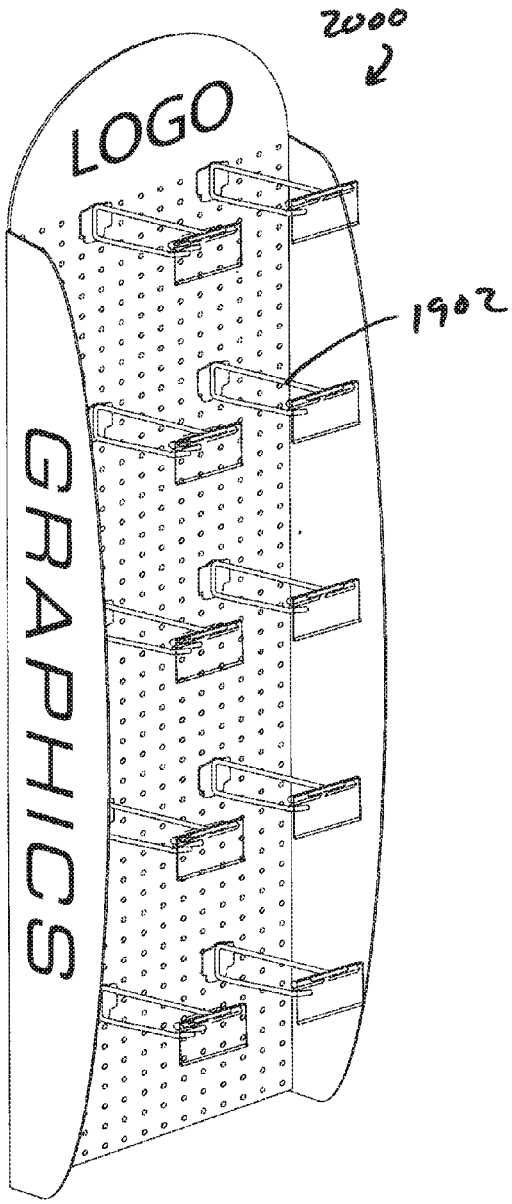
FIG. 110 is a perspective view of another merchandising display in accordance with the present teachings.
Figure 105:
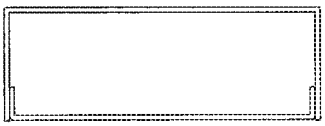
FIG. 105 is a top side view thereof, the product hooks being removed for purposes of illustration, the opposite side to that shown being a mirror image.
Figure 106:
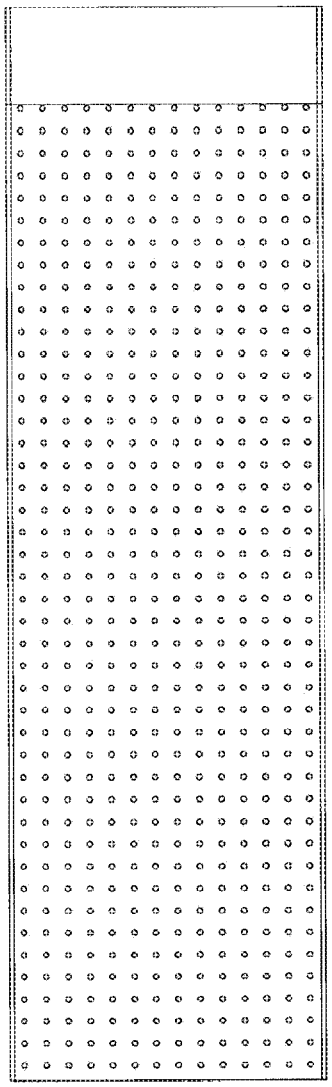
FIG. 106 is a front side view thereof.
Figure 107:
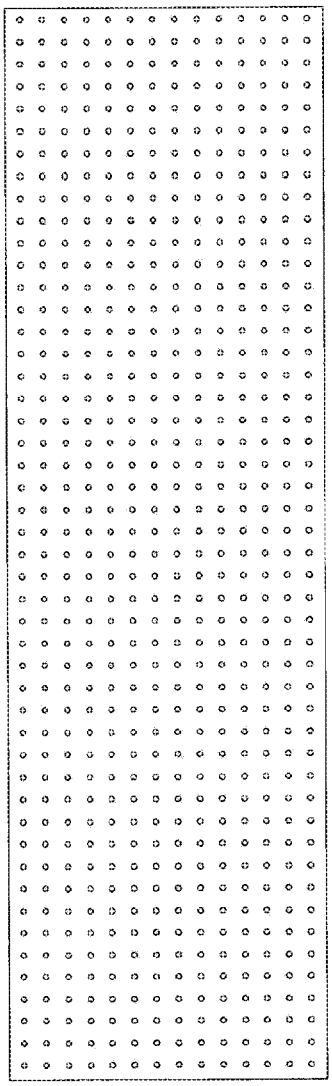
FIG. 107 is a rear side view thereof.
Figure 109:
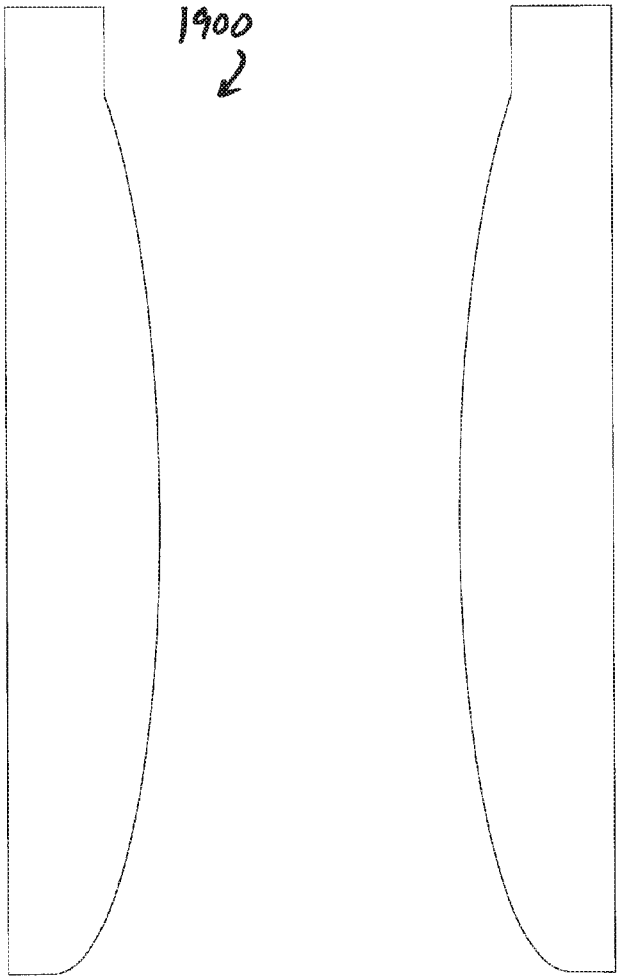
FIG. 109 is a left side view thereof.
Figure 109:
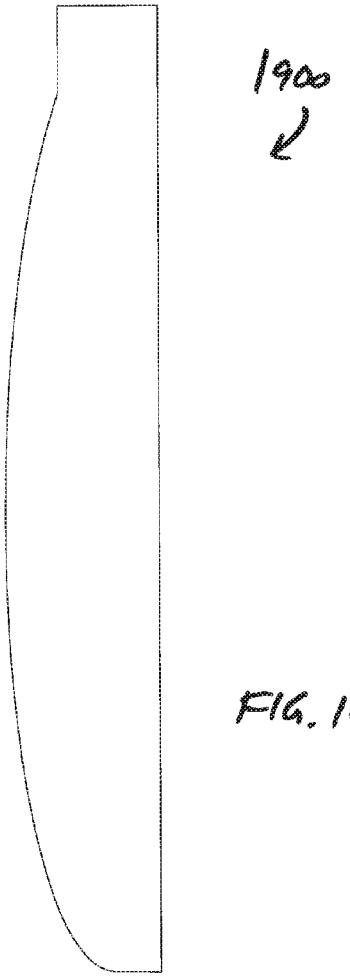

With reference now to FIG. 110, another merchandising display system in accordance with the present teachings is illustrated and generally identified at reference character 2000. The merchandising display system 2000 differs from the merchandising display system 1900 in that the upper end is alternatively constructed.

Figure 111:
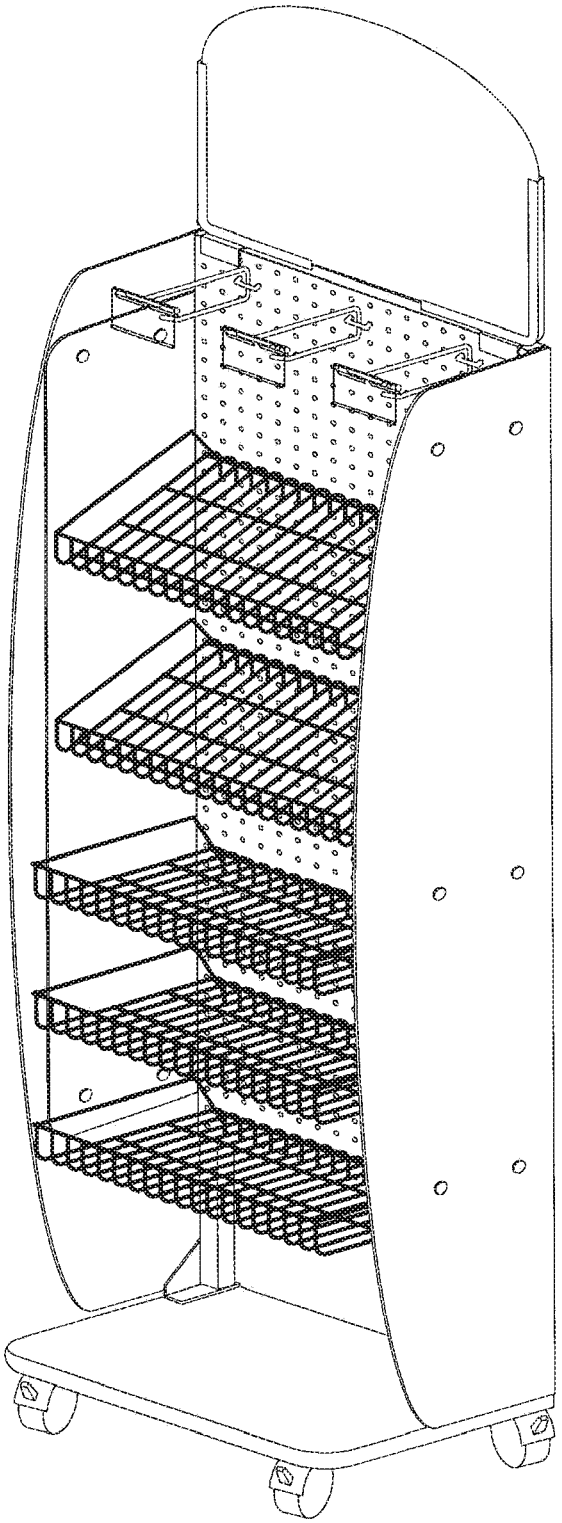
FIG. 111 is a perspective view of another merchandising display in accordance with the present teachings.
Figure 112:
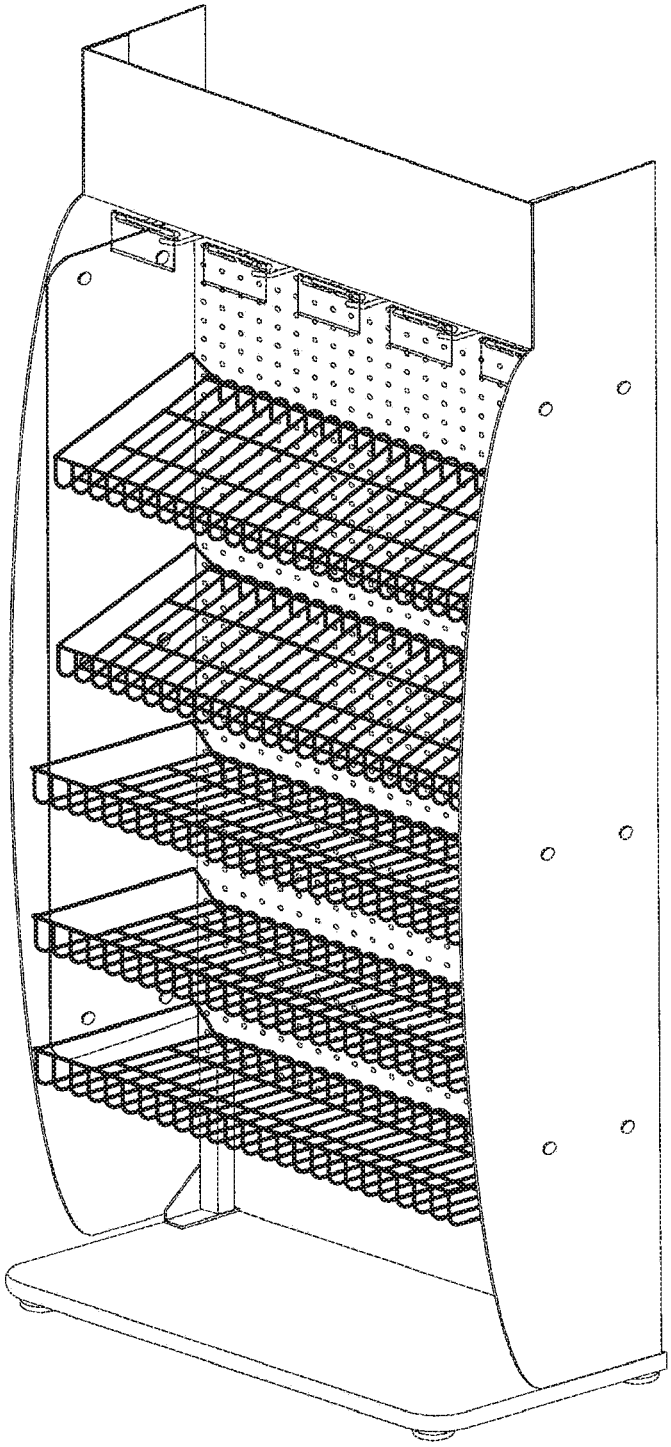
FIG. 112 is a perspective view of another merchandising display in accordance with the present teachings.
Figure 113:
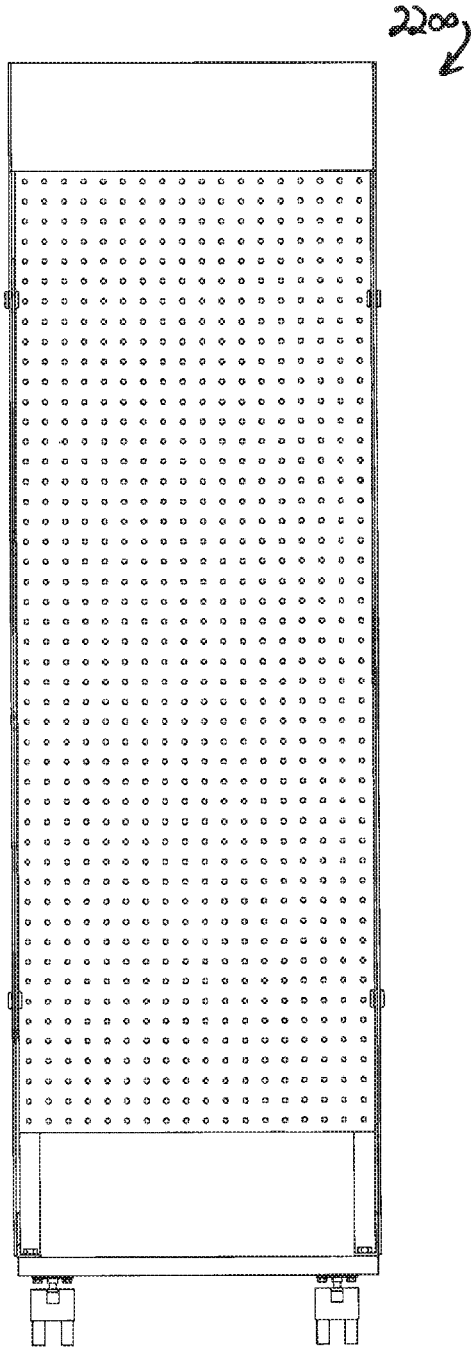
FIG. 113 is a front side view thereof, the product hooks and shelves being removed for purposes of illustration.
Figure 114:
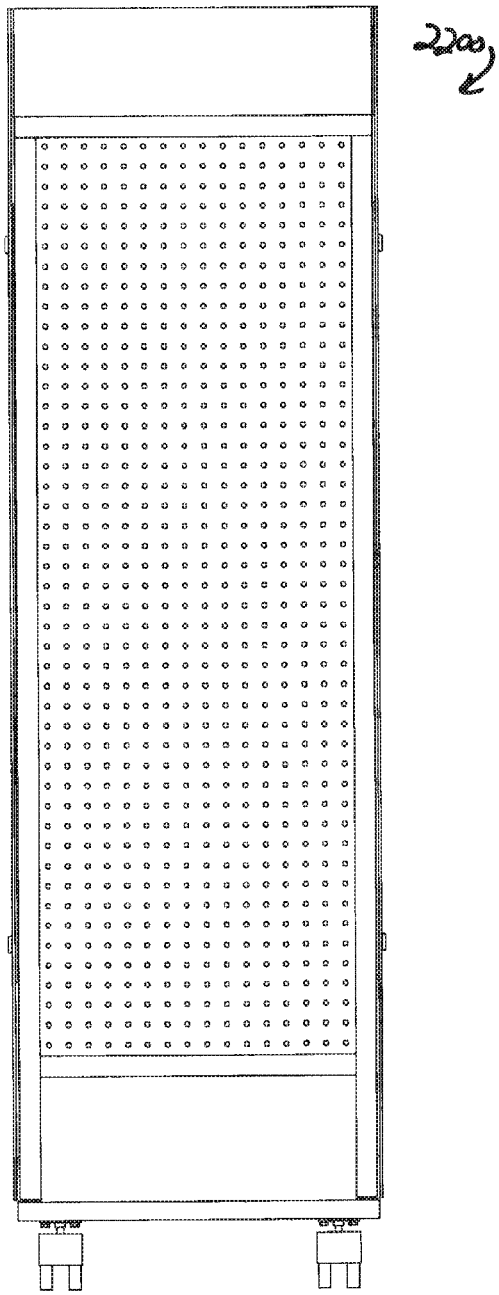
FIG. 114 is a rear side view thereof.
Figure 116:
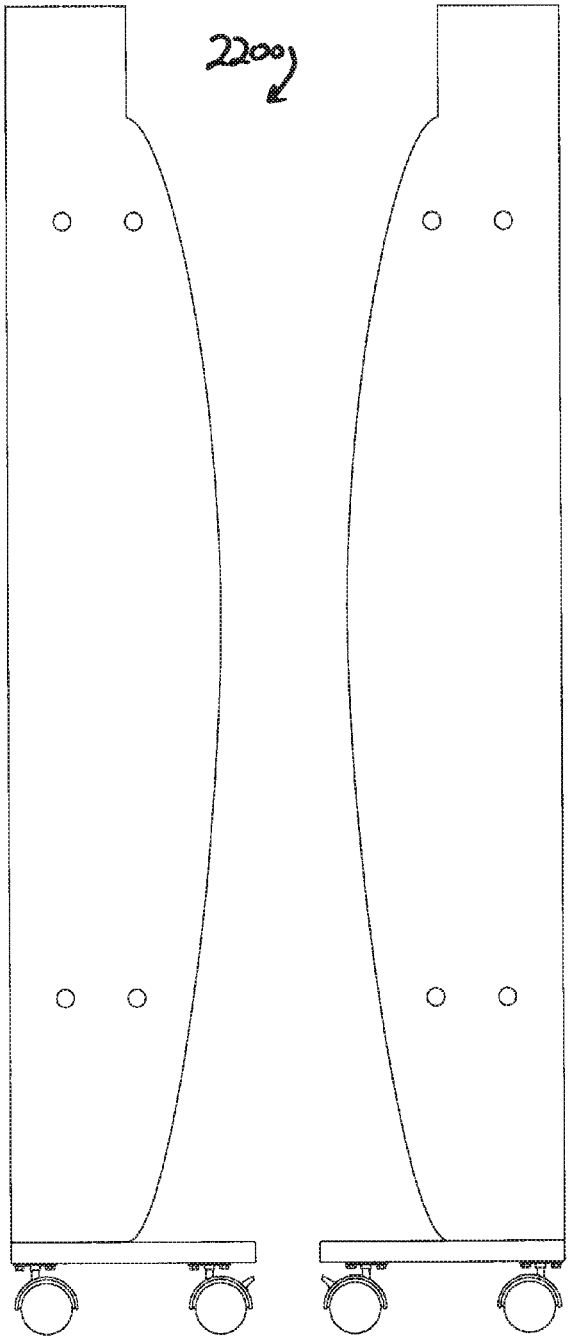
FIG. 116 is a left side view thereof.
Figure 117:
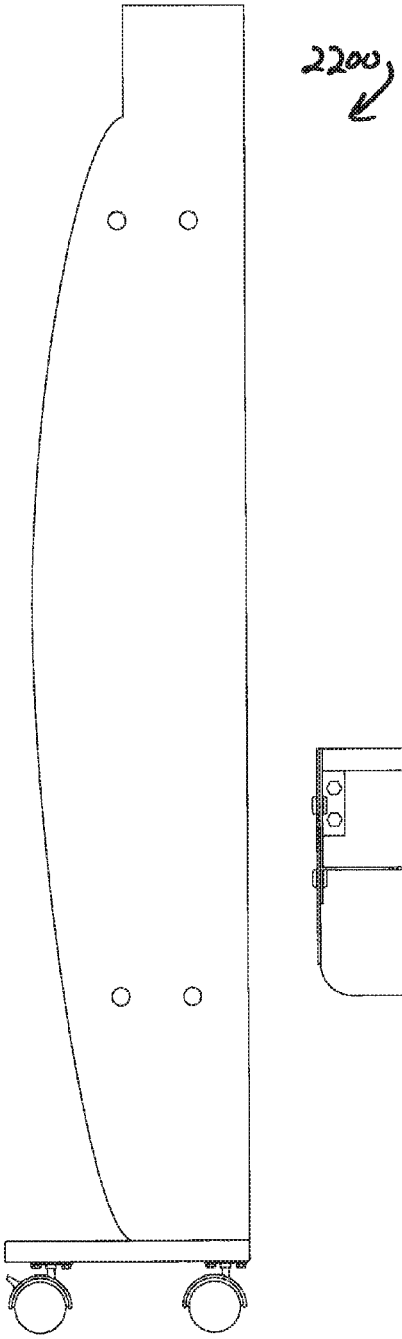
FIG. 117 is a right side view thereof.
Figure 115:
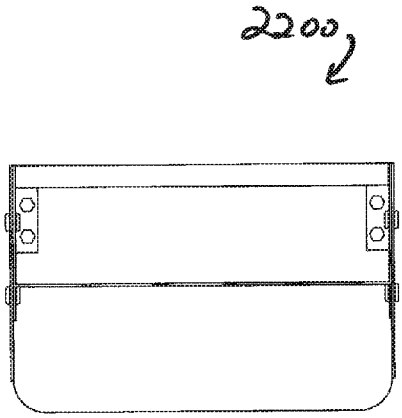
FIG. 115 is a top side view thereof.
Figure 118:
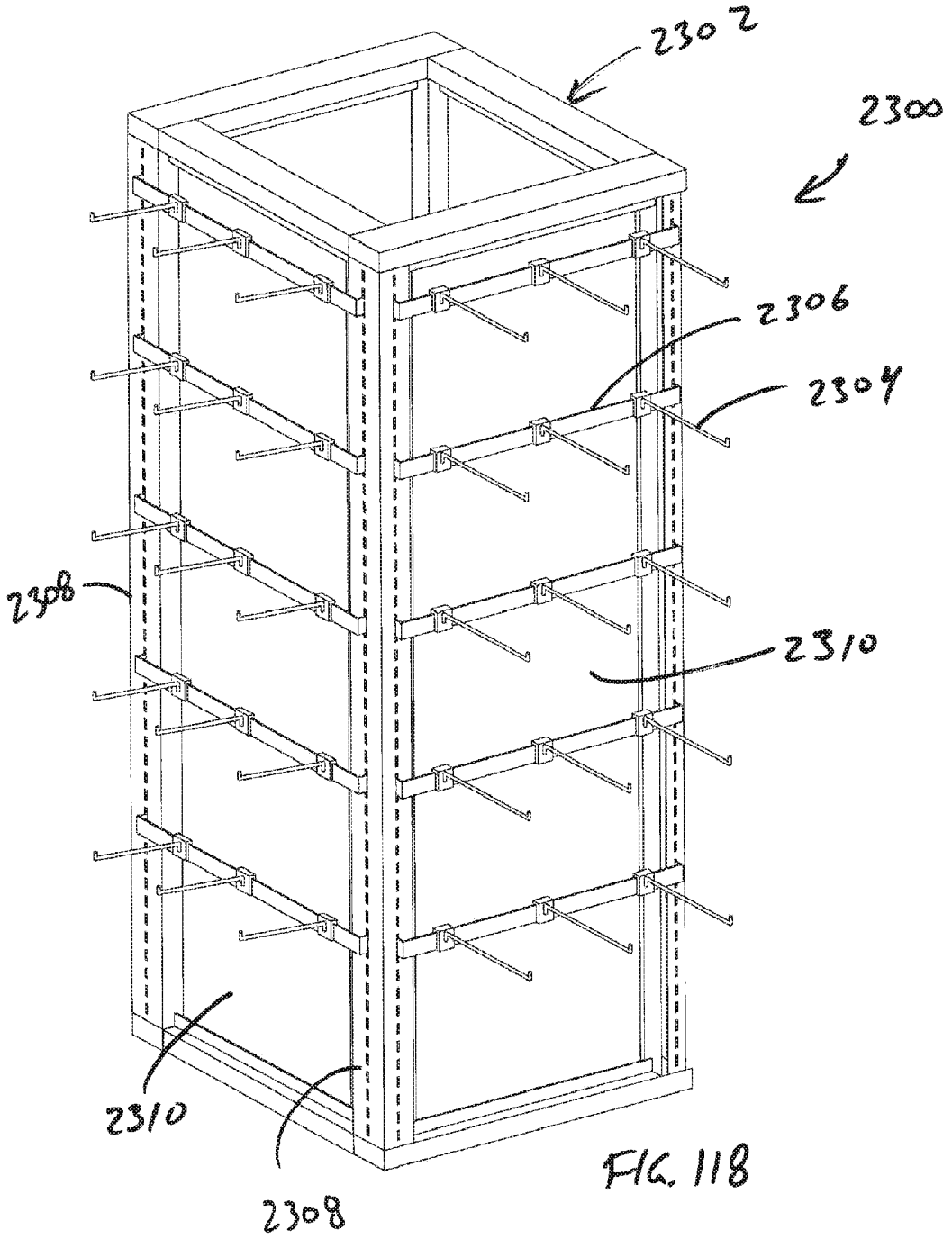
FIG. 118 is a perspective view of another merchandising display in accordance with the present teachings.
Figure 119:
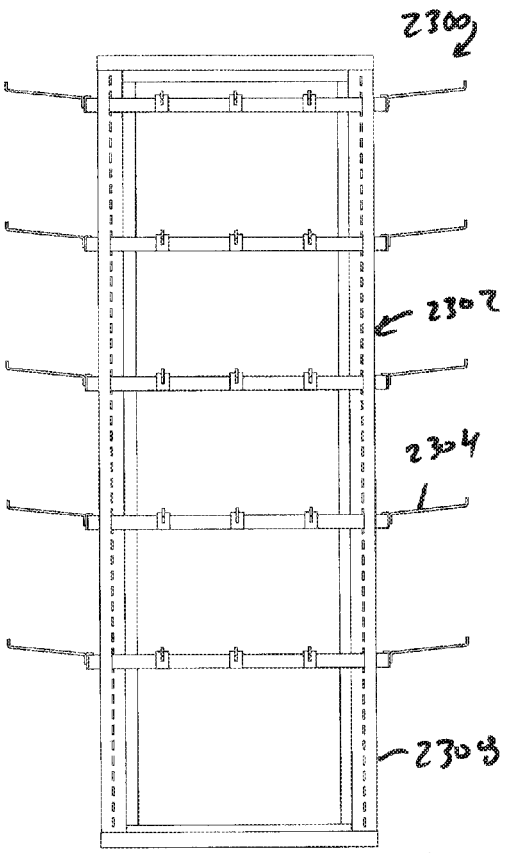
Figure 120:
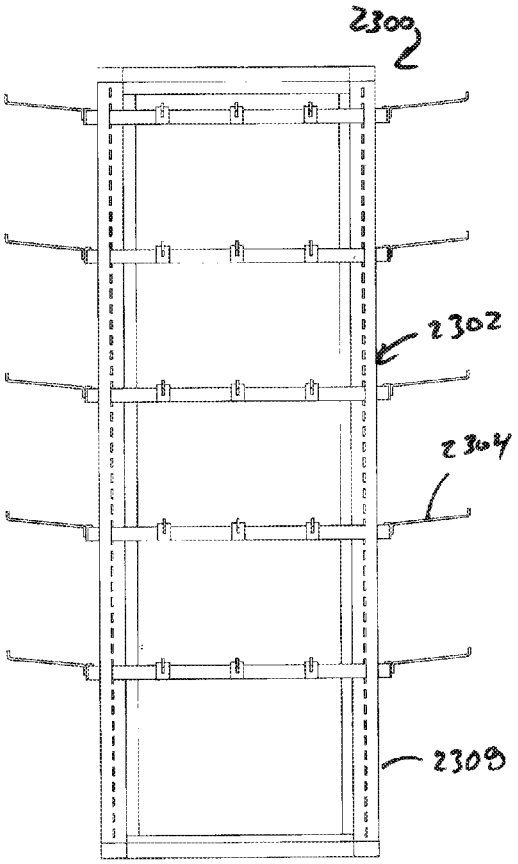
Figure 121:
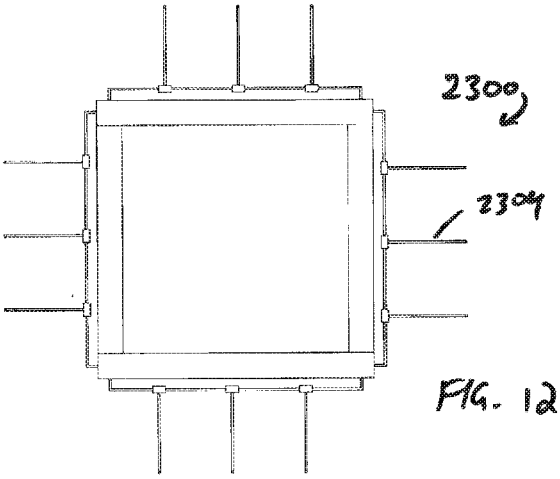
Figure 122:
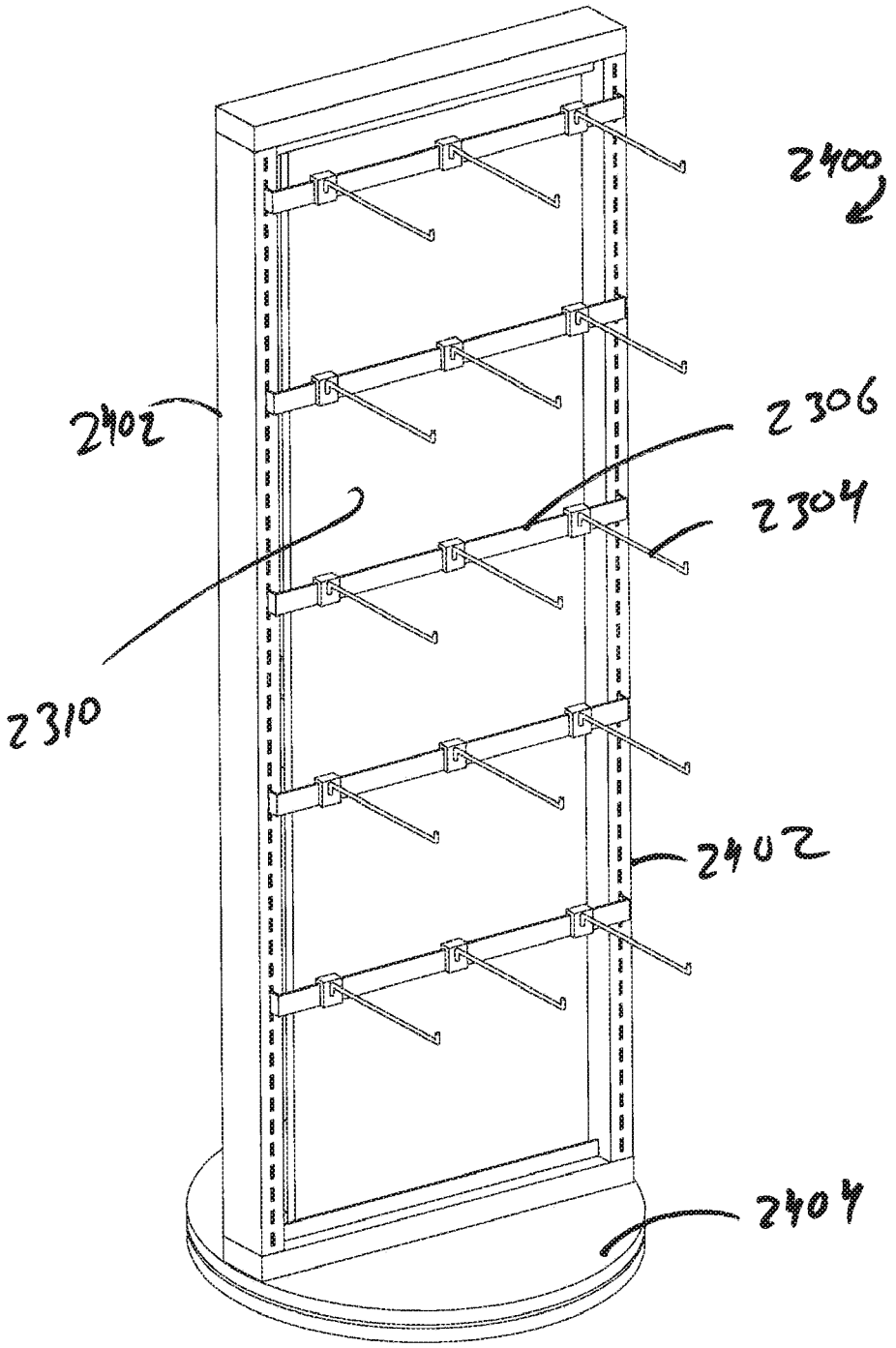
Figure 123:
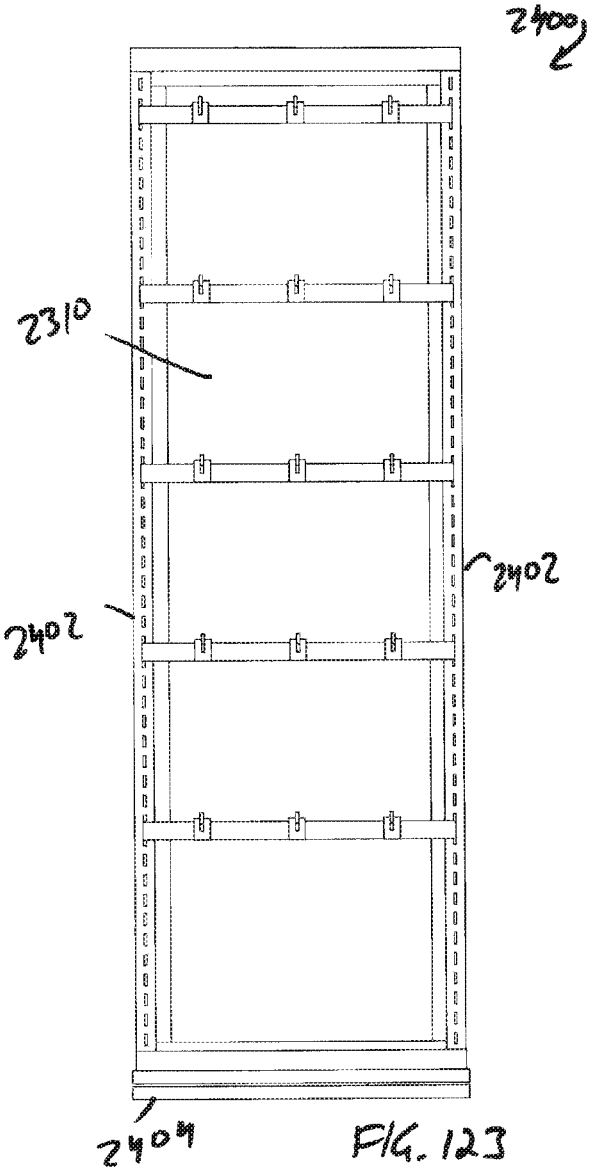
Figure 124:
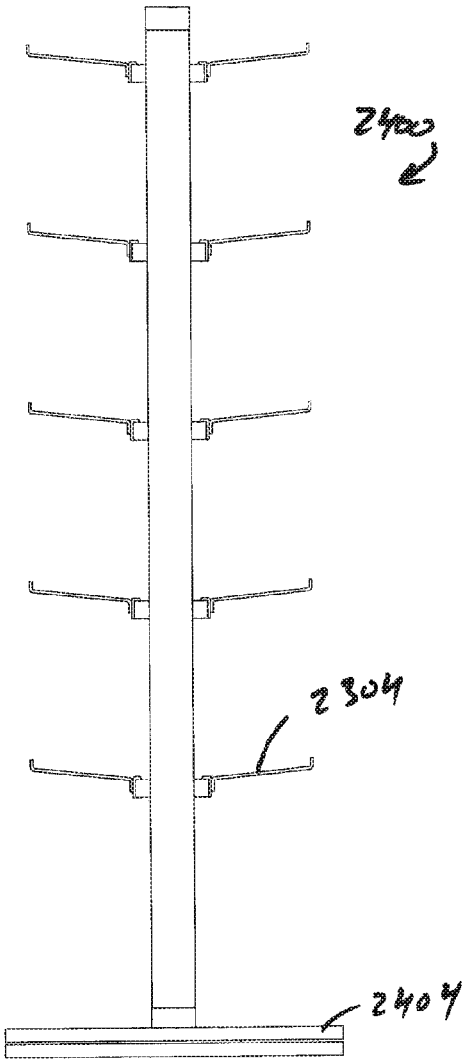
Figure 125:
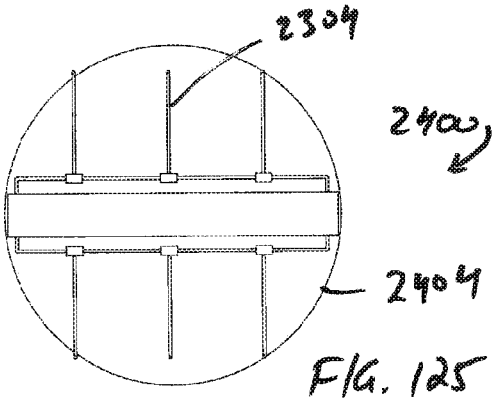
Figure 126:
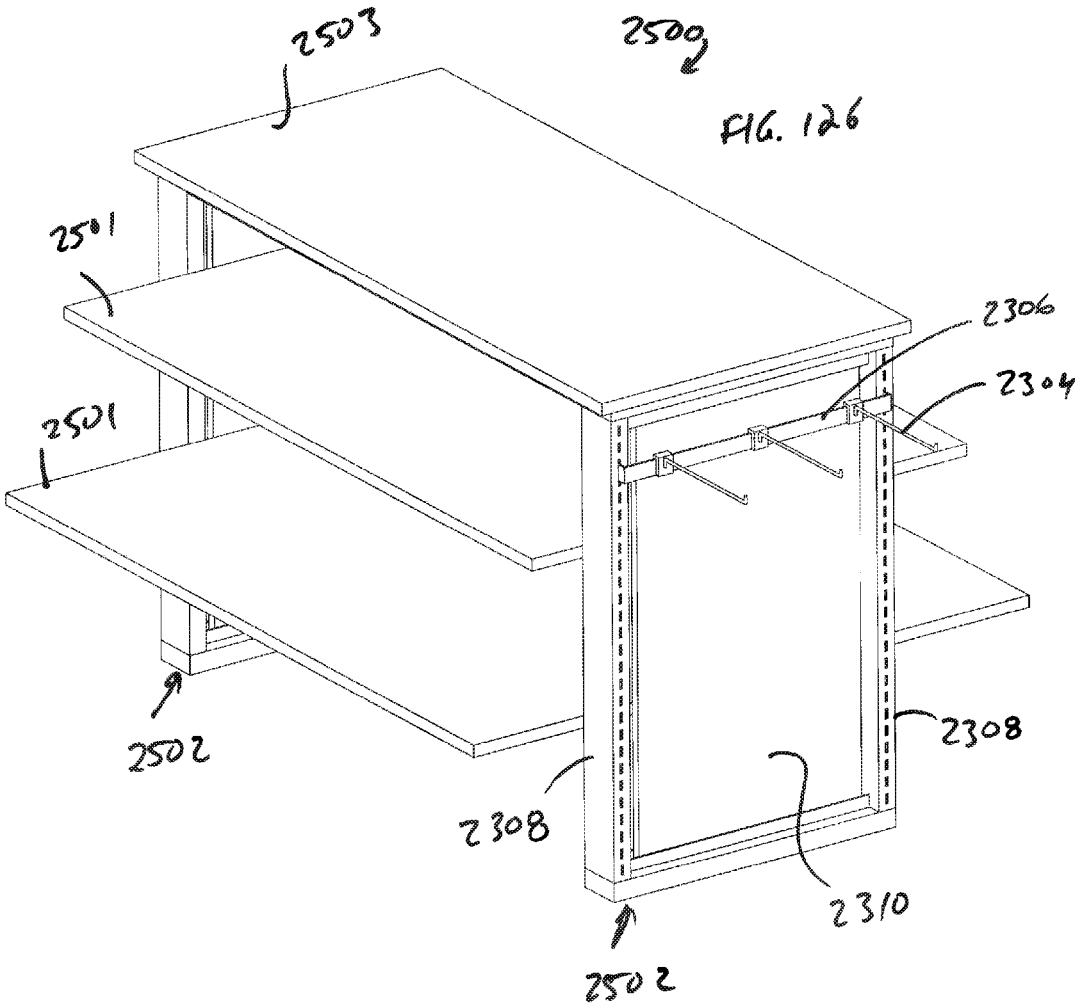
Figure 127:
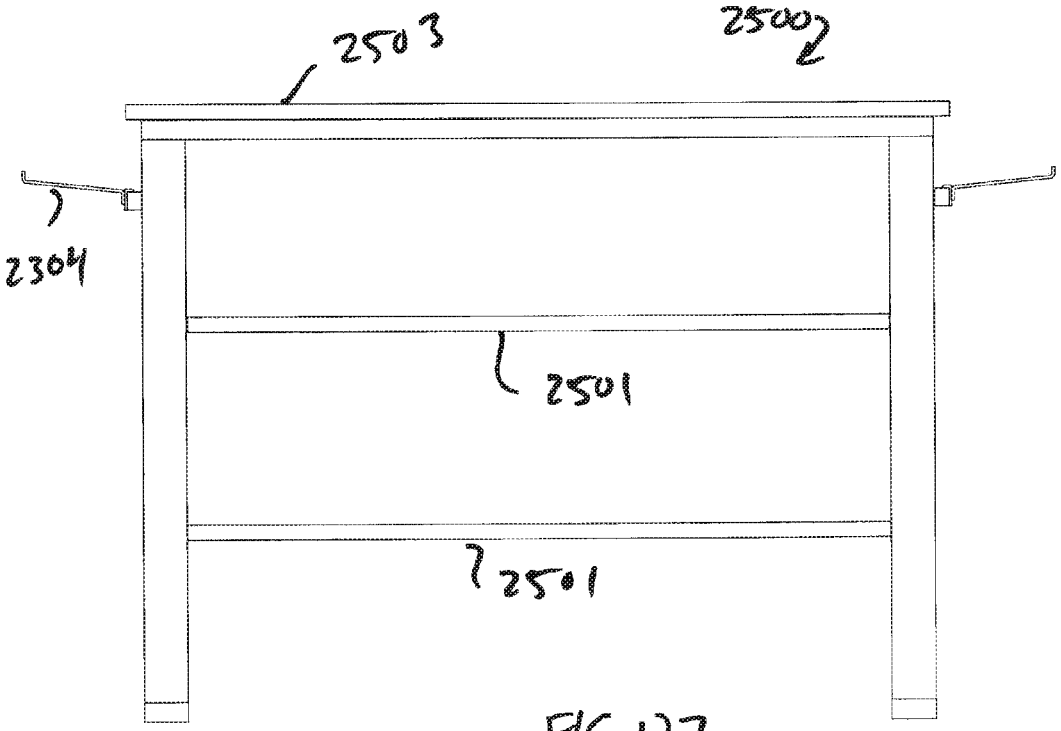
Figure 128:
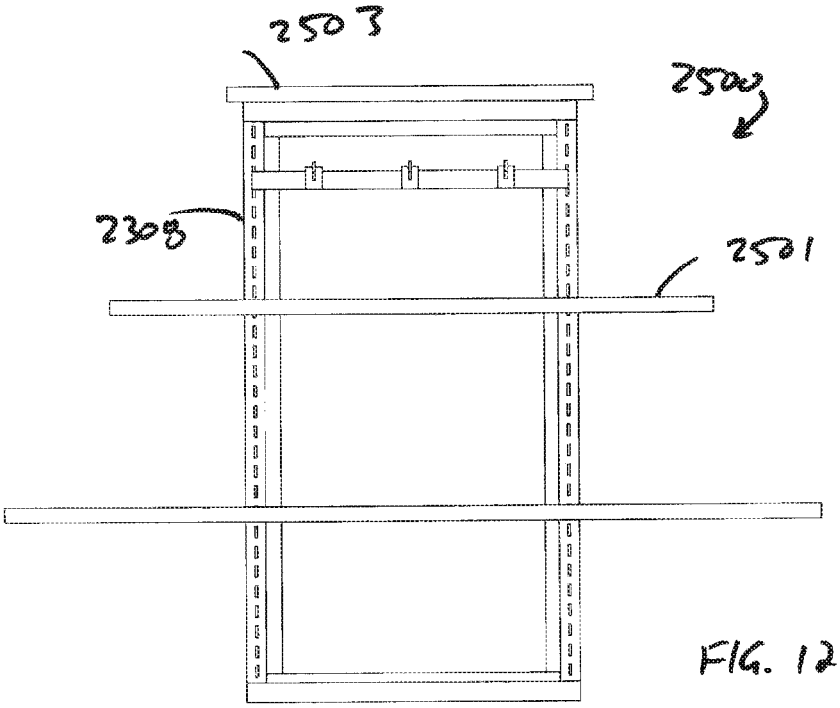
Figure 129:
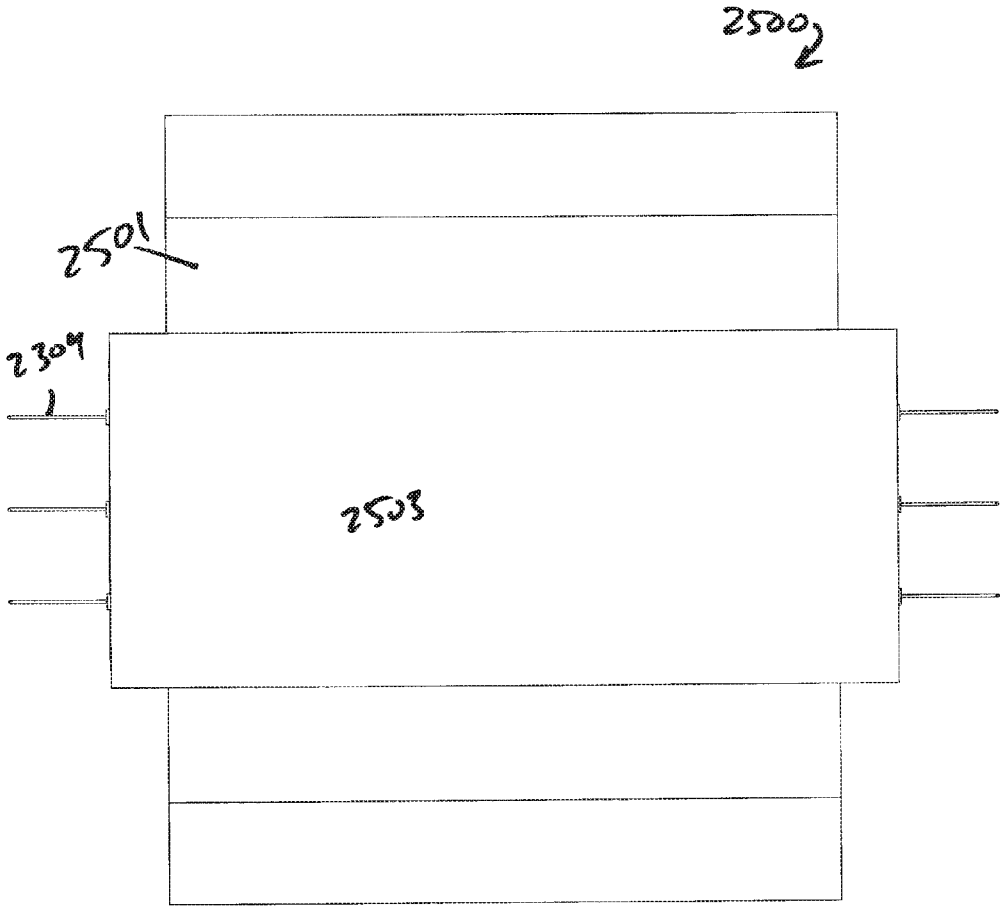
Figure 130:
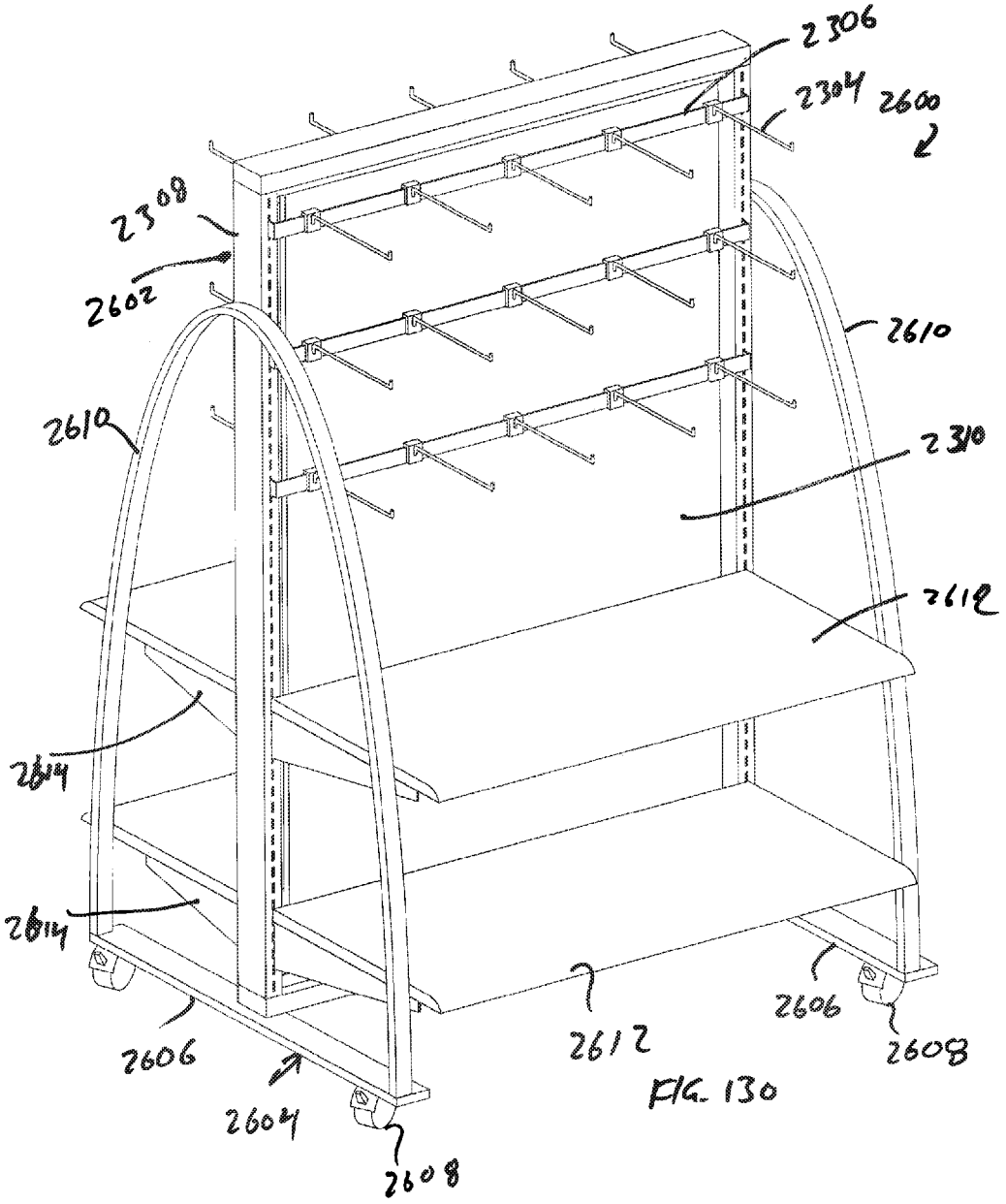

With reference now to FIG. 111, another merchandising display system in accordance with the present teachings is illustrated and generally identified at reference character

2100. Similar to the above described embodiments, the merchandising display system 2100 may include a back panel provided with a plurality of apertures arranged in rows and columns for conventional mounting of the product display members. As illustrated, shelves may also be attached to the back panel. The merchandising display system 2100 may be self supporting and may include a lower member carrying a plurality of casters. An advertising panel may be carried at an upper end of the back panel for carrying an advertising card or that may be pre-printed with advertising or other product related information.

With reference now to FIGS. 112 through 117, another merchandising display system in accordance with the present teachings is illustrated and generally identified at reference character 2200. FIGS. 113 through 117 illustrate the merchandising display system 2200 with the product hooks and shelves removed for purposes of illustration.

Turning now to FIGS. 118 through 121, another merchandising display system in accordance with the present teachings is illustrated and generally identified at reference character 2300. The merchandising display system 2300 is illustrated to be self-supporting and to generally include a frame 2302, a plurality of product display arms 2304 and a plurality of adjustable members 2306 for interconnecting the product display arms 2304 to the frame 2302.

The frame 2302 is generally rectangular in shape and is shown to include four upright members 2308 located at the corners thereof. The upright members 2308 are each generally rectangular in cross section with first and second outwardly facing sides. The outwardly facing sides are each provided with a plurality of slots or openings extending along the lengths thereof.

In the embodiment illustrated, panels 2310 may be received within channels defined by the upright members 2308. The panels may be slidably received within the channel and may be interchangeable. The panels 2310 may provide color to the merchandising display system 2300 or may be provided with panels therebetween. Alternatively, the sides of the merchandising display system 2300 between the upright members 2308 may be left open.

The adjustable members 2306 are generally planar with mounting ends for engaging select openings in two of the upright members 2308. In this fashion, the adjustable members 2306 may be selectively positioned along the height of the frame 2302. The product display arms may be slidably received on one of the adjustable members 2306.

Turning now to FIGS. 122 through 125, another merchandising display system in accordance with the present teachings is illustrated and generally identified at reference character 2400. The merchandising display system 2400 shares common features with the merchandising display system 2300. As such, common features will be used in the drawings to designate common features.

The merchandising display system 2400 differs from the merchandising display system 2300 in that it incorporates a pair of upright members 2402. Further, a generally round base 2404 is provided for stability.

Turning now to FIGS. 126 through 129, another merchandising display system in accordance with the present teachings is illustrated and generally identified at reference character 2500. Again, common reference numbers have been used to identify similar elements. In this embodiment, the merchandising display system 2500 is configured into a table-like structure having a plurality of shelves 2501 and a top 2503. The merchandising display system 2500 includes first and second sides 2502. Both of the sides 2502 may include a pair of upright members 2308. Again, the upright members 2308 may cooperate to define a channel for receiving an ornamental panel 2310.

Turning now to FIGS. 130 through 133, another merchandising display system in accordance with the present teachings is illustrated and generally identified at reference character 2600. Again, common reference numbers have been used to identify similar elements. The merchandising display system 2600 includes a frame 2602 including a pair of upright members 2308. Again, the upright members 2308 may cooperate to define a channel for receiving an ornamental panel 2310.

The merchandising display system 2600 may further include a base 2604 for supporting the frame 2602. The base 2604 may include a pair of horizontally oriented members 2606. These members 2606 may carry casters or wheels 2608. The base 2604 may further include a pair of side members 2610. The side members 2610 may be generally arcuate and may include free ends welded or otherwise securely attached to the members 2606. The side members 2610 may similarly be welded or otherwise suitable attached to the sides of the frame 2602.

The merchandising display system 2600 may further include one or more shelves 2612. The shelves 2612 may be conventionally attached to the slots of the upright members 2308 with brackets 2614.

Turning now to FIGS. 134 through 141, a merchandising display arrangement in accordance with the present teachings is illustrated and generally identified at reference character 2700. The merchandising display arrangement 2700 is illustrated to include a gondola 2702 and a plurality of merchandising display systems 2704. In FIGS. 135 through 141, one of the merchandising display systems 2704 is shown with retail product and associated suspension members removed for purposes of illustration.

As shown in FIGS. 135 through 141 each merchandising display system 2704 is generally triangular in horizontal cross section. The systems 2704 will be understood to be substantially identical. As such, this description will be limited to one of the systems 2704.

The merchandising display system 2704 is illustrated to generally include a pair of planar sides 2706 and 2708 that cooperate with the gondola 2702 to define the triangular, horizontal cross section. In the embodiment illustrated, each of the planar sides 2706 and 2708 is constructed of a pegboard material having apertures arranged in rows and columns. Retail product may be suspended from the pegboard in a conventional manner.

The planar sides 2706 and 2708 are held relative to one another by a pair of substantially identical brackets 2710. One of the brackets 2710 is positioned proximate an upper end of the merchandising display system 2704 and the other of the brackets 2710 is positioned proximate a lower end of the merchandising display system 2704.

Each bracket 2710 includes a first end, a second end and a central portion therebetween. The first end may be secured to the planar side 2706 and the second end may be secured to the planar side 2708. Such securement may be made with bolts and nuts (as illustrated) or in any other manner well known in the art. The first and second ends are angled relative to the central portion such that the central portion spans a distance between the planar sides 2706 and 2708.

The merchandising display system 2704 may include a top 2712. The top may be secured with to the planar sides 2706 and 2708 with fasteners or in any suitable manner. The bottom is not visible during use and therefore may remain open.

The merchandising display system 2704 may be attached to the gondola 2702. As illustrated, the merchandising display system 2704 may be attached to the gondola 2702 with mounting brackets 2714. It will be understood that the mounting brackets 2714 are substantially identical. Each mounting bracket 2714 includes a first side for attachment to one of the planar sides 2706 and 2708 and a second side for attachment to the gondola 2702. The brackets 2714 may be secured to the respective sides 2706 and 2708 and the gondola with fasteners. In the embodiment illustrated, four brackets 2714 are used to secure the merchandising display system 2704 to the gondola 2702.

As shown, the merchandising display system 2704 is illustrated to include an optional support device 2716. As shown in figure 2700, the merchandising display system 2704 may be supported at a lower end by the base of the gondola 2702. The optional support device 2716 may be used to raise the bottom of the merchandising display system 2704 off the gondola or to otherwise distance a bottom of the merchandising display system 2704 from the floor or other support surface.

The support device 2716 may include one or more vertically extending members. As illustrated, the support device 2716 includes first and second vertically extending members 2718 that are telescopically coupled to one another for purposes of adjustability. One of the vertically extending members 2718 is securely attached to the merchandising display system 2704. As illustrated, the one of the vertically extending members 2718 may be secured to the brackets 2710.

While specific examples and alternatives have been described in the specification and illustrated in the drawings, it will be understood by those skilled in the art that various further changes may be made by and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and any appended claims.

What is claimed is:

1. A merchandise assembly for the retail display of goods, the merchandising assembly comprising:

a generally planar member constructed to include an upper end, a lower end, a front side, and a rear side and defining a plurality openings extending therethrough, each opening of the plurality of openings having an inverted T-shape with a horizontally extending portion and a vertically extending portion, the vertically extending portion upwardly extending from the horizontally extending portion;

a merchandising support member suspended by the generally planar member, the merchandising support member monolithically constructed to include a mounting portion and first and second arms extending in opposite directions from the mounting portion, the mounting portion having an inverted U-shape opening in a downward direction, the merchandising support member passing through a first opening of the plurality of openings such that a first support member leg of the merchandising support member is adjacent the front side of the generally planar member and a second support member leg of the merchandising support member is adjacent the rear side of the generally planar member, wherein the first and second arms are aligned in a horizontal direction with the vertically extending portion of the first opening, wherein the first and second arms angle upwardly as the first and second arms outwardly extend from the mounting portion; and the vertically extending portion of the first opening upwardly extends above the mounting portion.

2. The merchandise assembly for the retail display of goods of claim 1, wherein the merchandising support member is a mirror image about the generally planar member.

3. The merchandise assembly for the retail display of goods of claim 1, wherein the mounting portion includes a plurality of projections for engaging the generally planar member.

4. The merchandise assembly for the retail display of goods of claim 1, wherein the mounting portion of the merchandising support member has a height greater than a height of the horizontally extending portion of the opening.

5. A method of assembling a merchandise assembly, the method comprising: providing a merchandise assembly of claim 1; and passing the first arm and the first support member leg through the first opening.

* * * * *